US005080342A

United States Patent [19]

Mori et al.

[11] Patent Number: 5,080,342

[45] Date of Patent: Jan. 14, 1992

[54] FINISHER FOR FINISHING PAPER SHEETS

[75] Inventors: Goro Mori, Tokyo; Masatoshi Hosoi; Yoshihide Sugiyama, both of Okazaki; Yuji Ueno, Aichi, all of Japan

[73] Assignee: Ricoh Company, Ltd., Tokyo, Japan

[21] Appl. No.: 582,491

[22] Filed: Sep. 14, 1990

[30] Foreign Application Priority Data

Sep. 14, 1989 [JP] Japan ..... 1-237113
Jan. 11, 1990 [JP] Japan ..... 2-2540

[51] Int. Cl.[5] ..... B42B 2/00
[52] U.S. Cl. ..... 270/53; 271/221
[58] Field of Search ..... 270/37, 53, 58; 271/221

[56] References Cited

U.S. PATENT DOCUMENTS 4,867,436 9/1989 Hanada ..... 271/221
4,930,761 6/1990 Naito ..... 270/53

FOREIGN PATENT DOCUMENTS 0147772 6/1988 Japan ..... 271/221

*Primary Examiner*—Edward K. Look
*Assistant Examiner*—Therese M. Newholm
*Attorney, Agent, or Firm*—Oblon, Spivak, McClelland, Maier & Neustadt

[57] ABSTRACT

A finisher having a stapler for stapling paper sheets sequentially discharged onto a two-sided copy tray of a copier, facsimile machine, printer or similar equipment or onto a bin of a sorter. A paper positioning device included in the finisher has a bin fence and a positioning member. The bin fence is provided on each bin and extends along one side edge of the bin. A positioning member is reciprocatingly movable from a standby position thereof toward the bin fence and back to the standby position. During such a reciprocating motion, the positioning member is repetitively brought into and out of contact with a stack of paper sheets to thereby position the stack. The moving speed of the positioning member is variable.

6 Claims, 58 Drawing Sheets

FINISHER FOR FINISHING PAPER SHEETS

BACKGROUND OF THE INVENTION

The present invention relates to a finisher having a stapler for stapling a stack of paper sheets transported to a two-sided copy tray incorporated in, for example, a copier, facsimile machine or printer or to a bin of a sorter. More particularly, the present invention is concerned with a finisher having a paper positioning device capable of positioning paper sheets positively and accurately with no regard to the elasticity of the sheets.

A finisher for positioning paper sheets sequentially distributed to a two-sided copy tray or any of multiple bins of a sorter and stapling a stack of such paper sheets by a stapler has been proposed in various forms in the past. A prerequisite with this type of finisher is that a stack of paper sheets driven out onto the tray or the bin be positioned first. For this purpose, this type of finisher has a paper positioning device. A paper positioning device has customarily been implemented with a jogger member which jogs toward and away from a bin fence for thereby positioning paper sheets. The jogger member is shiftable to a position matching a particular size of paper sheets used. However, difficulty has been experienced in positioning paper sheets surely and accurately with no regard to the kind and the degree of elasticity of paper sheets. On the other hand, a paper stack so positioned on the tray or the bin has to be moved to a stapling position. To this end, it is a common practice to use a mechanism which moves a stapler toward the tray or the bin or a mechanism which moves the tray or the bin toward a stapler. This kind of scheme, however, increases the overall scale of the finisher. Moveover, since the mechanism, whether it moves a stapler or a bin, does not directly handle a paper stack, it is difficult to maintain the stapling position constant. To eliminate this problem, a finisher of the type described is provided with a paper pulling device for pulling a paper stack to the stapling position of a stapler. Specifically, a paper pulling device has a pair of chucks for chucking a paper stack and moves them between a chucking position and a stapling position in the horizontal direction. The coactive chucks are rotatable toward each other to grip a paper stack and away from each other to release it. However, paper pulling devices heretofore proposed have some problems left unsolved regarding the applicability thereof to a finisher, as will be described specifically later.

SUMMARY OF THE INVENTION

It is therefore an object of the present invention to provide a finisher having a paper positioning device capable of positioning paper sheets surely and accurately on a tray or a bin with no regard to the elasticity of the paper sheets.

It is another object of the present invention to provide a generally improved finisher for finishing paper sheets.

A finisher for finishing paper sheets of the present invention comprises a sorter having a plurality of bins arranged one above another for receiving paper sheets transported one after another thereto, a stapler for stapling a stack of the paper sheets discharged onto each of the bins, and a paper positioning device for positioning the stack of paper sheets on the bin. The paper positioning device has a bin fence provided on each of the bins of the sorter and extending along one side edge of the bin, and a positioning member reciprocatingly movable from a standby position toward the bin fence and to the standby position away from the bin fence and, during the reciprocating motion, stopping at least a first stop position, a second stop position and a third stop position for positioning the stack of paper sheets in contact with the edge of the stack.

Also, a finisher for finishing paper sheets of the present invention comprises a tray for stacking paper sheets which are transported one after another thereto, a fence provided on the tray and extending along one side edge of the tray, and a positioning member reciprocatingly moveable from a standby position toward the fence and to the standby position away from the fence and, during the reciprocating motion, stopping at least a first stop position, a second stop position and a third stop position for positioning the stack of paper sheets in contact with the edge of the stack.

BRIEF DESCRIPTION OF THE DRAWINGS

The above and other objects, features and advantages of the present invention will become more apparent from the following detailed description taken with the accompanying drawings in which:

FIGS. 67, 67A, and 67B are block diagrams showing a specific construction of a control system particular to the illustrative embodiment;

FIGS. 68A, 68A-1, 68A-2,68A-3, an 68B-1, 68B-2, 68B-3 are flowcharts demonstrating the general operation of the embodiment;

FIGS. 72A, 72A-1, 72A-2, and 72B to 72I are flowcharts showing a stapling procedure;

FIGS. 73, 73A, and 73B are flowcharts showing a slow-up and slow-down procedure;

DESCRIPTION OF THE PREFERRED EMBODIMENT

To better understand the present invention, a brief reference will be made to conventional implementations for pulling a stack of paper sheets to a stapling position of a stapler.

Figure 1:
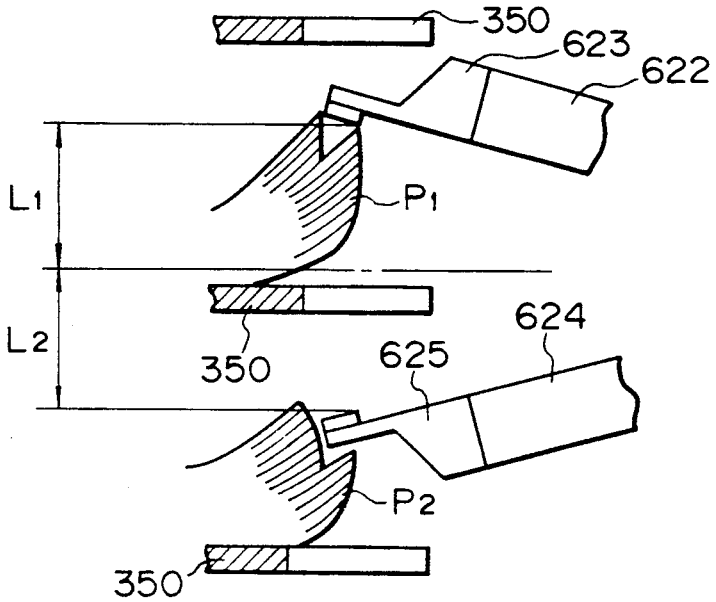
Fig. 1 PRIOR ART
FIGS. 1 and 2 each shows a different prior art paper pulling device working on curled paper sheets.
Figure 2:
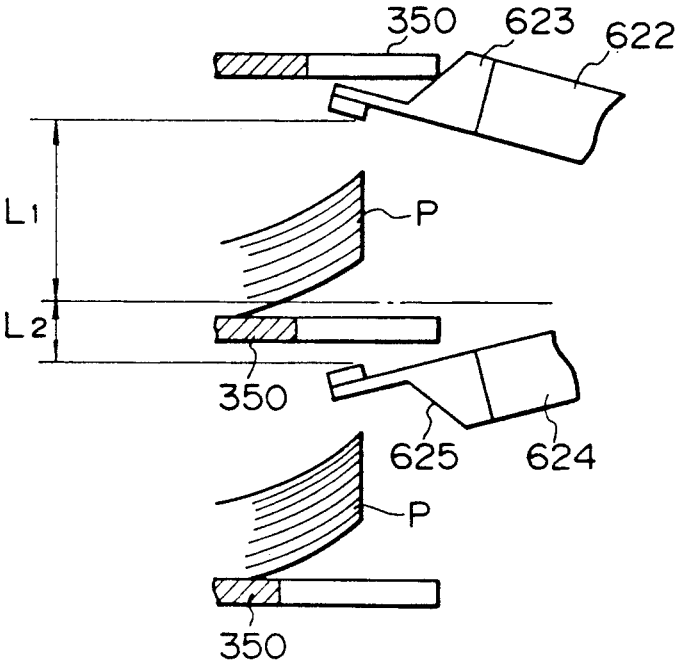
Fig. 2 PRIOR ART

FIGS. 1 and 2 each shows a different prior art paper pulling device, particularly a stack of curled paper sheets and how such a stack is caught by chucks. In the figures, there are shown bins 350 of a sorter, an upper rotatable lever 622, a lower rotatable lever 624, an upper chuck 623, and a lower chuck 625. A stack of paper sheets is generally labeled P. Assume that the upper and lower chucks 623 and 625 rotate over a substantial angular range and over distances $L_1$ and $L_2$ which are substantially the same, as shown in FIG. 1. Then, when the chucks 623 and 625 chuck the upper paper stack $P_1$, the lower chuck 625 is apt to catch the lower paper stack $P_2$ which is curled. To eliminate this problem, it has been proposed to make the distance $L_2$ smaller than the distance $L_1$, as shown in FIG. 2. The relation $L_2 < L_1$ has customarily been set up by changing the gear teeth ratio and leverage of gears which drive the upper and lower levers 622 and 624. This scheme, however, is not practicable without complicating the construction and needing an extra space and, therefore, extra cost.

Figure 3:
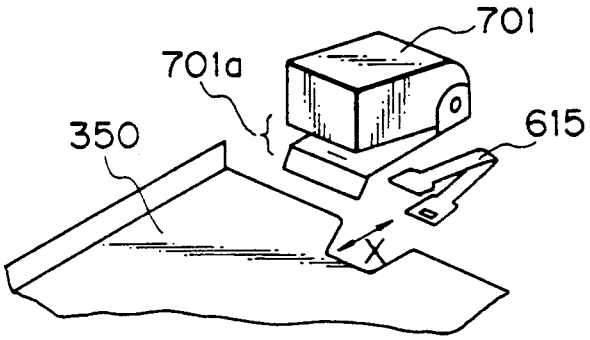
Fig. 3 PRIOR ART
FIG. 3 is an external perspective view of a prior art paper pulling device.
Figure 4:
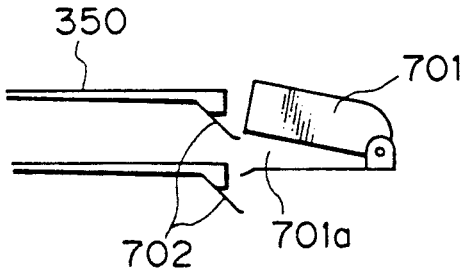
Fig. 4 PRIOR ART
FIG. 4 is a side elevation showing a prior art mechanism for pressing paper sheets.

FIG. 3 schematically shows a traditional paper stack pulling device. There are shown in FIG. 3 a pulling member 615 and a stapler 701 having an opening 701*a*. The pulling member 615 moves into a notch formed in the bin 350, chucks a paper stack loaded on the bin 350, and then pulls the paper stack into the opening 701*a* of the stapler 701. At this instant, if the paper stack has been curled, it is likely that the pulling member 615 fails to surely chuck the whole paper stack and, therefore, to bring it into the opening 701*a* of the stapler 701. FIG. 4 shows a specific configuration of a conventional mechanism for pressing such a curled paper stack. In FIG. 4, each bin 350 is provided with a guide 702 for guiding a paper stack toward the opening 701*a* of the stapler 701. This kind of approach has a problem that the guides 702 have to be affixed to the bins one by one by time- and labor-consuming operations, resulting in the increase in cost. Moreover, the cost increase with the increase in the number of bins 350.

When the above-described type of paper pulling device is constructed to grip a paper stack with chucks at a single point of the stack, a moment is apt to act on the stack due to inertia in the event of pulling and to thereby cause the latter to skew. The skew would prevent the stapling position from being maintained constant.

The paper pulling device with the above construction is movable back and forth between a chucking position for chucking a paper stack on the bin 350 and a stapling position for stapling it. Such a movement of the device is implemented by a DC motor and a ball screw. However, the use of a DC motor is disadvantageous for some reasons. Specifically, since the movement of the pulling device is effected by the start-up portions of the DC motor, it is difficult to control the rotation of the motor, i.e., to accelerate it constantly. Further, when the ball screw or similar load is not constant, the rotation of the DC motor itself fluctuates, rendering the control over the acceleration more difficult.

Figure 5:
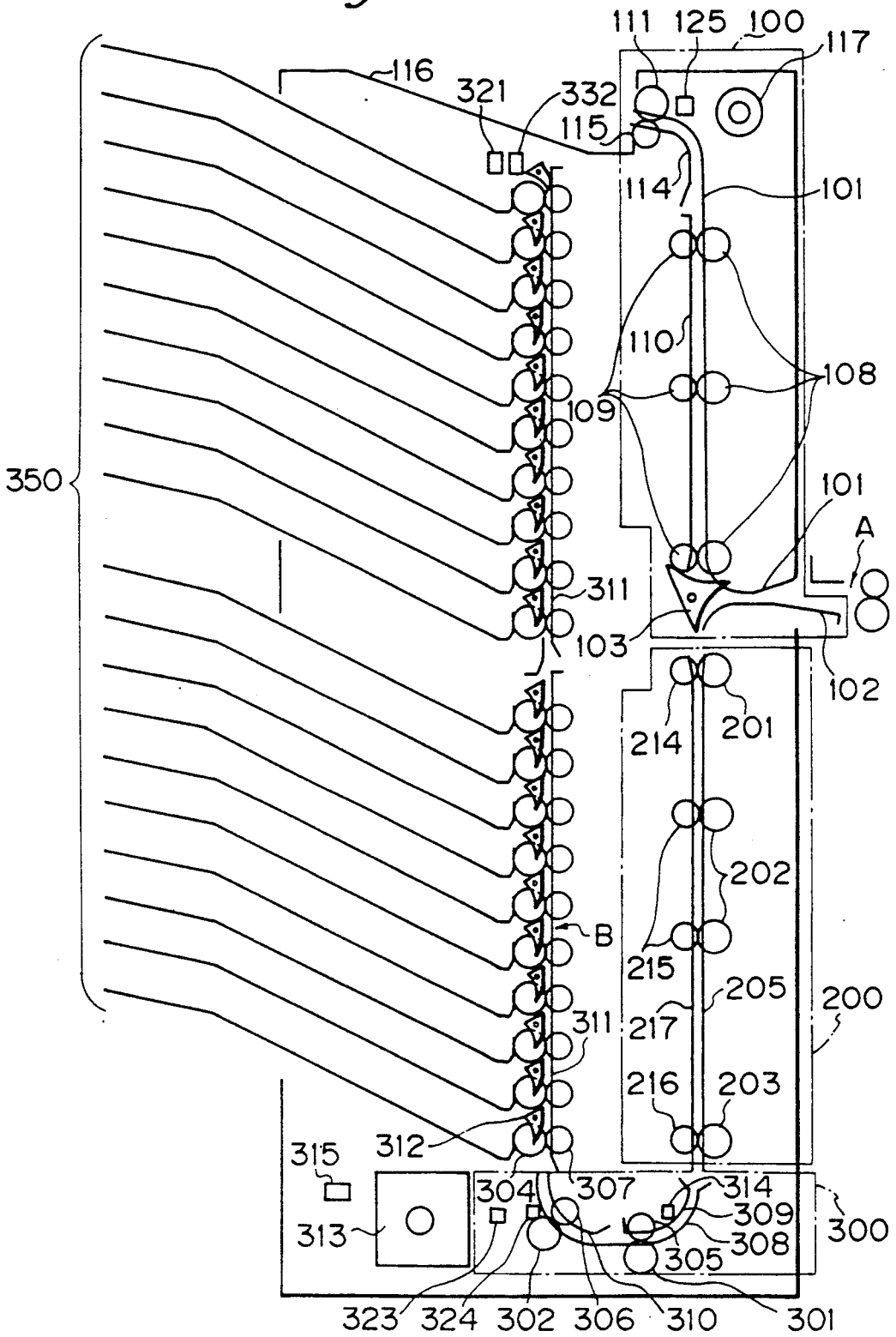
FIG. 5 is a front view of the finisher in accordance with the present invention.

Referring to FIG. 5, a finisher embodying the present invention is shown which is free from the various drawbacks particular to the prior implementations as discussed above. As shown, the finisher has an inlet A for receiving copy sheets which are sequentially driven out of a copier or similar equipment. Inlet guides 101 and 102 are located at the inlet A while a selector in the form of a pawl 103 is located downstream of the inlet guides 101 and 102. An upper transport section 100 extends upward from the pawl 103 and includes, in addition to the inlet guide 101, guides 110 and 114, transport or drive rollers 108, driven rollers 109, a discharge or drive roller 111, a driven roller 115, and a proof tray 116. A skew section 200 extends downward from the pawl 103 and includes a skew guide 308, a driven guide 217, a guide plate 308, driven guide plates 308 and 309, an inlet roller 201, skew rollers 202, an outlet roller 203, driven rollers 214 and 216, and balls 215. The skew section 200 terminates at a deflecting section B via transport rollers 301 and 302 and driven rollers 305 and 306.

A deflecting pawl and a discharge roller 304 are associated with each bin 350 in the deflecting section B. Driven rollers 307 each is pressed against respective one of the discharge rollers 304 with the intermediary of a vertical transport path. A proof motor 117 drives the transport rollers 108 and outlet roller 111 while a drive motor 313 drives the inlet roller, screw rollers 202, outlet roller 203, transport rollers 301 and 302, and discharge rollers 304. A pulse generator 315 is provided in a driving section so as to generate pulses proportional in number to the rotations of the motor 313.

Figure 6:
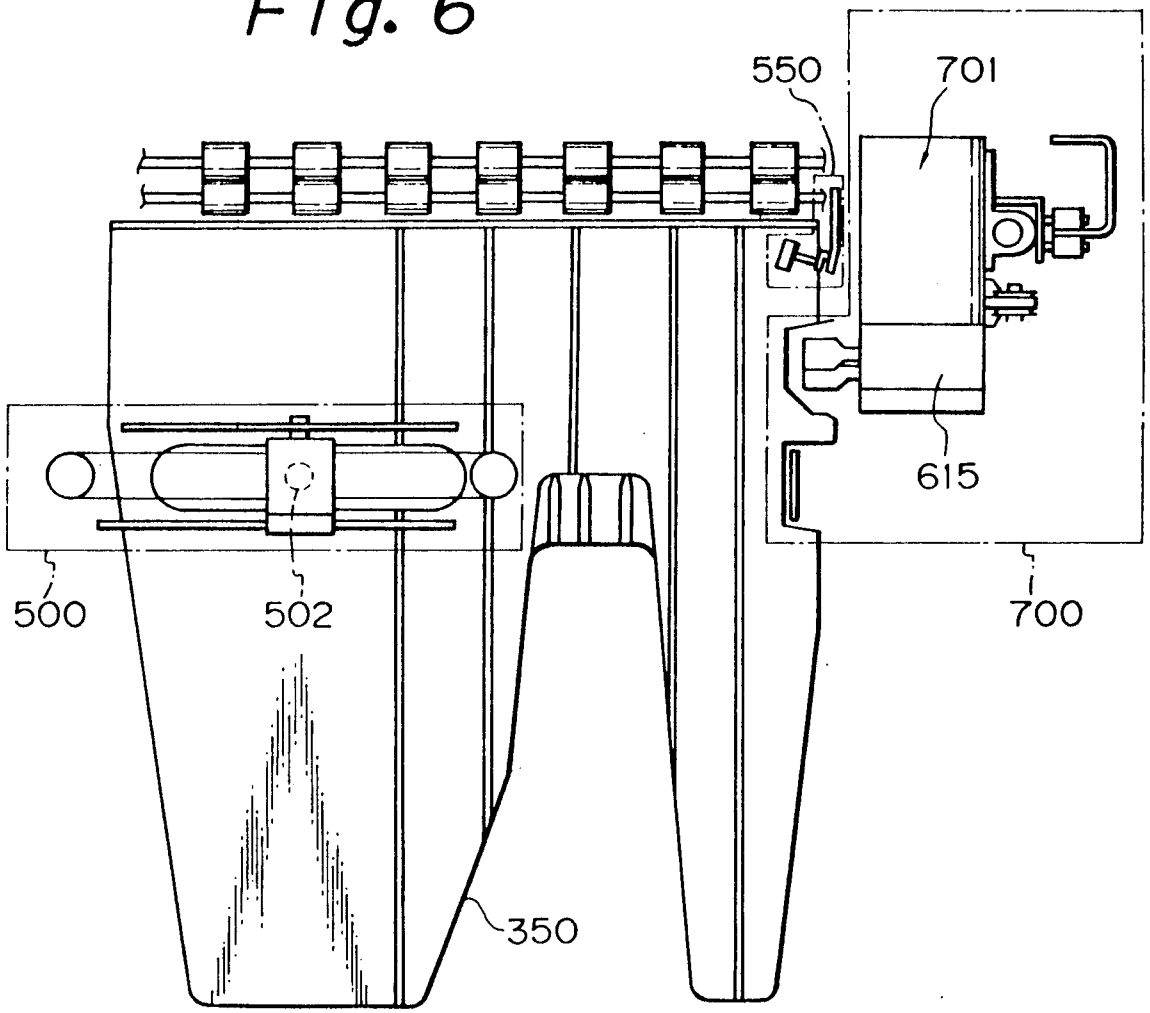
FIG. 6 is a top view of the bins.

As shown in a plan view in FIG. 6, a stapler device 700 is located at one side of the group of bins 350 and has a stapler 701, a pulling device or chucking section 615 for pulling a paper stack to the stapler 701, and a mechanism for moving the stapler 701 and chucking section 615 up and down to the individual bins. A jogging device 500 is disposed at the other side of the group of bins 350 and has a jogger shaft 502 for positioning a paper sheet before a stapling operation, and an arrangement for moving the shaft 502 to a size matching a particular paper size. A positioning roller device 550 is positioned in close proximity to that side of the bin 350 where the stapler unit 700 is located.

As shown in FIG. 5, the finisher or sorter has twenty bins in total. A bin sensor 321 and a paper sensor 322 are located in an upper portion of the sorter while a bin sensor 323 and a paper sensor 324 are located in a lower portion of the same. The sensors 321 to 324 each is implemented as an optical sensor made up of an LED (Light Emitting Diode) and a phototransistor. The paper sensors 322 and 324 are responsive to the discharge of paper sheets, and the bin sensors 321 and 323 are responsive to the presence of paper sheets in the bins 350. A discharge sensor 125 is associated with the upper transport path 100 to see if paper sheets, or copy sheets, have been driven out onto the proof tray 116. An inlet sensor 314 is provided in the lower transport section 300 for implementing, for example, the timings at which paper sheets should be distributed to the individual bins 350. The sensors 115 and 314 each comprises a photointerrupter with an actuator.

Figure 7:
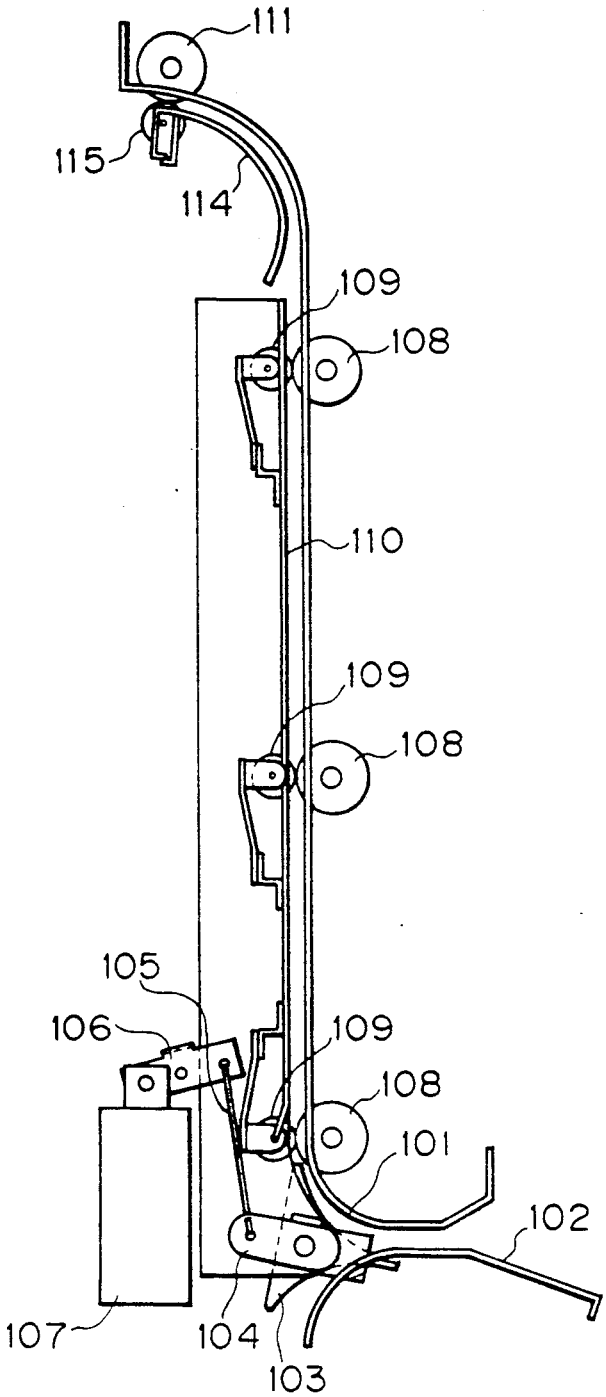
FIG. 7 is a front view of an upper transport section included in the embodiment.
Figure 8A:
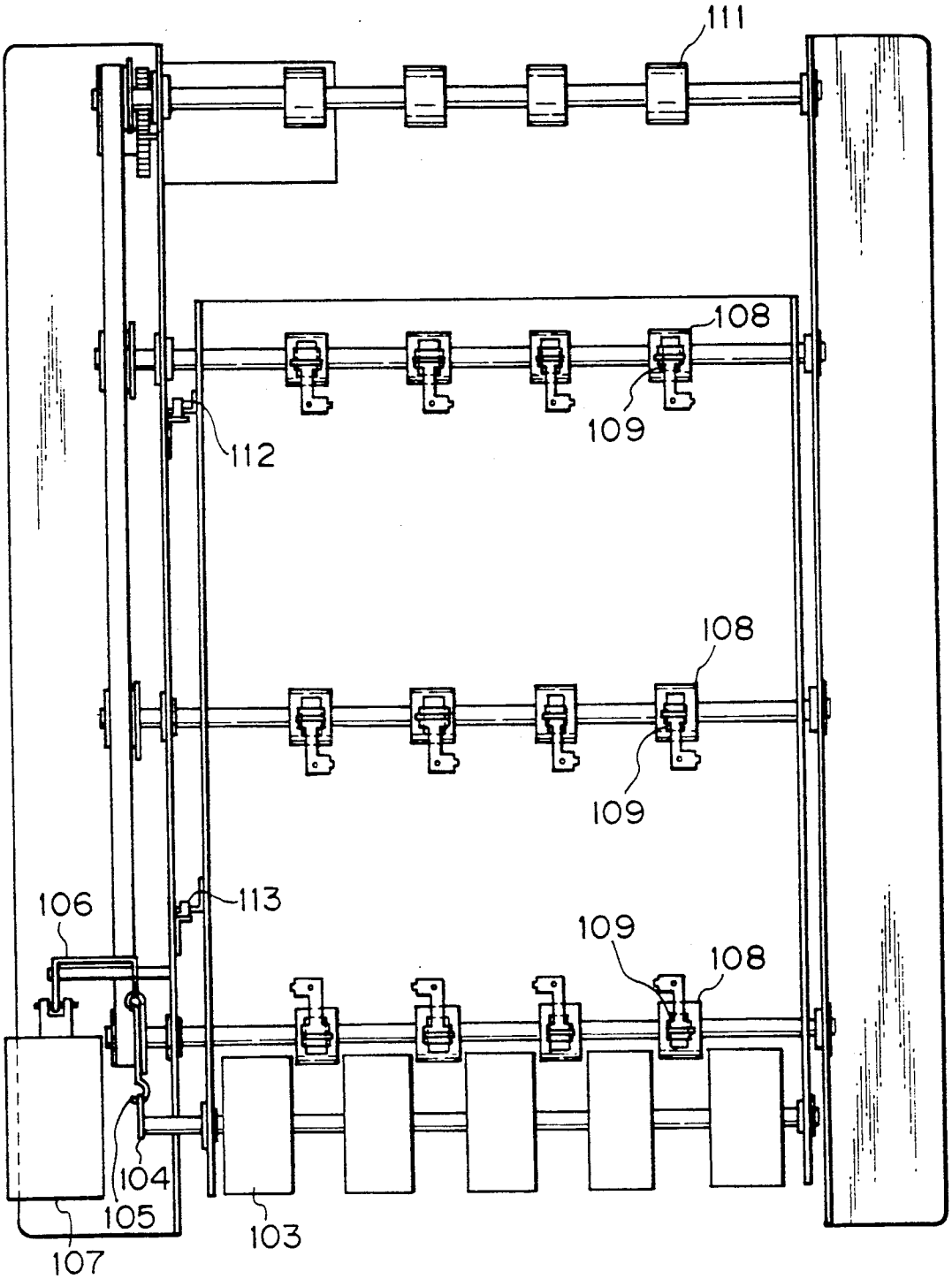
FIG. 8A is a side elevation of the upper transport section.

FIGS. 7 and 8A show the upper transport section 100 in detail in a front view and a side elevation, respectively. A paper sheet or copy sheet driven out of the copier body is guided by the guides 101 and 102 toward the pawl 103. The pawl 103 is connected to a solenoid (SOL) 107 by links 104, 105 and 106. When the solenoid 107 is turned off, the pawl 103 steers the paper sheet toward the skew section 200 located below the transport section 100. When the solenoid 107 is turned on, the pawl 103 feeds the paper sheet into the upper transport section 100.

Specifically, on the turn-on of the solenoid 107, the pawl 103 steers the paper sheet toward the transport roller 108 disposed immediately above the pawl 103. The transport roller 108 is made of EPDM or chloroprene rubber. The driven roller 109 associated with the transport roller 108 is constantly pressed against the latter by a leaf spring or similar biasing member. Three pairs of such transport and driven rollers 108 and 109 are arranged along the upper transport path 100 to drive the paper sheet upward toward the proof tray 116 through between the guides 101 and 110.

Figure 8B:
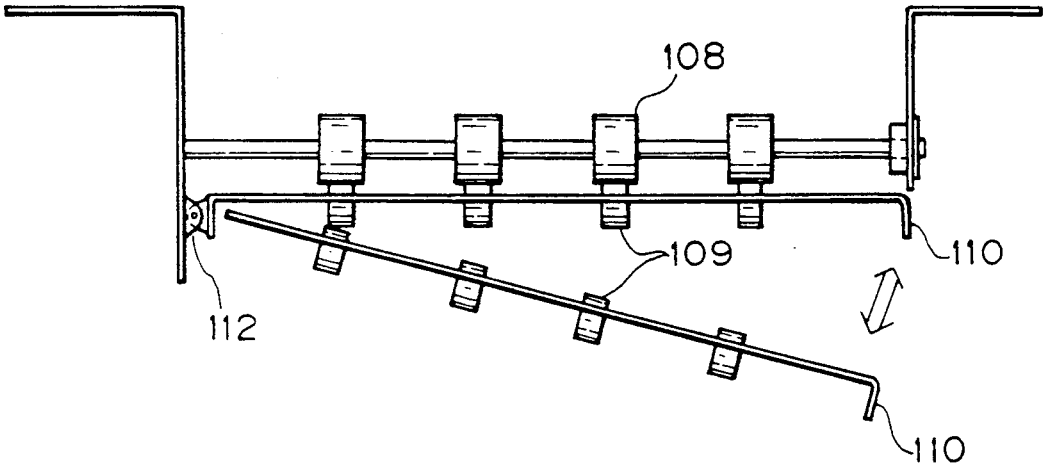
FIG. 8B is a plan view of a guide portion included in the upper transport section.

The driven rollers 109 and pawl 103 are mounted on the guide 110. As shown in FIG. 8B, the guide 110 is hinged to the framework of the sorter by a pin 112 so that it may be opened to uncover the pawl 103 and driven rollers 109. This will promote easy work in the event of a paper jam or similar occurrence.

The paper sheet is guided by the guides 101 and 114 to reach the outlet roller 111 which is also made of EPDM or chloroprene rubber. The driven roller 115 is constantly pressed against the outlet roller 111 by a leaf spring or similar biasing member. The rollers 111 and 115 cooperate to drive the paper sheet onto the proof tray 116. As shown in FIG. 5, the proof tray 116 is located closer to the copier body, i.e., the operator than the bins 350. This not only allows the operator to see and pick up the copy sheets with ease but also reduces the paper transport distance and, therefore, transport time to the proof tray 116. If desired, the proof tray 116 may be implemented as a part of an upper cover of the sorter.

Figure 9:
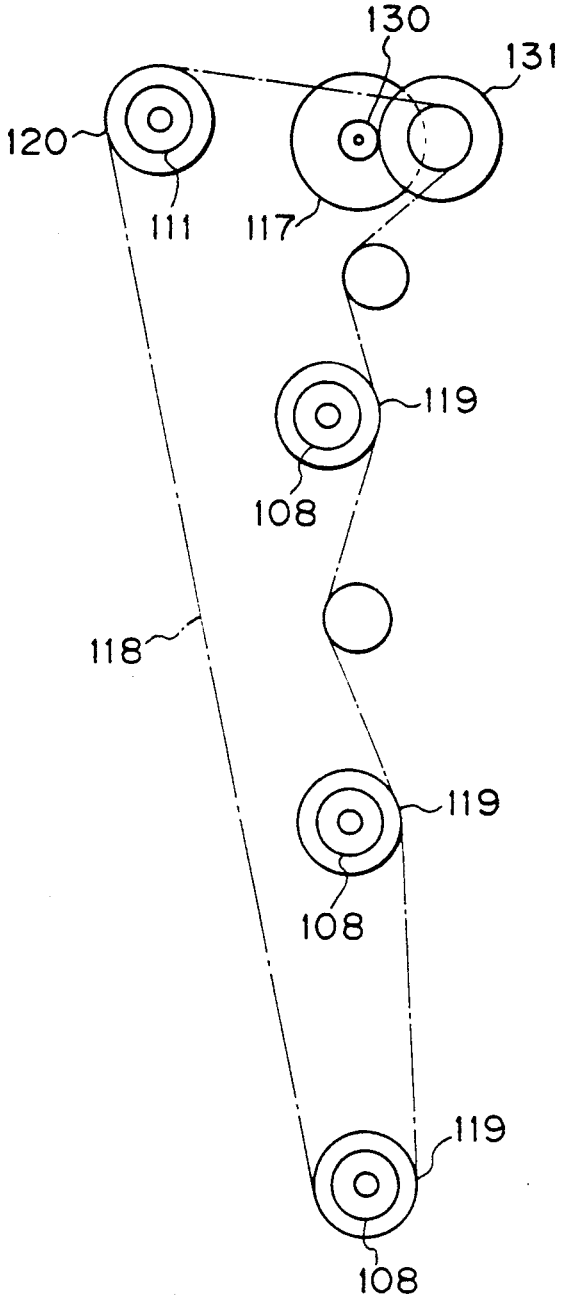
FIG. 9 is a view representative of a drive system associated with the upper transport section.

FIG. 9 shows a drive mechanism associated with the upper transport section 100. As shown, the upper transport section 100 has an exclusive motor 117. The rotation of the motor 117 is transmitted to the transport rollers 108 and outlet roller 111 via gears 130 and 131, a timing belt 118, and timing pulleys 119 and 120. The timing pulleys 119 and 120 are affixed respectively to the shafts of the transport rollers 108 and outlet roller 111.

It is noteworthy that the upper transport section 100 does not have any transport roller between the pawl 103 and the output of the copier body. In such a configuration, in an operation mode which uses the proof tray 116, a copy sheet is transported with only the motor 100 of the upper transport section 100 and the solenoid 107 being operated. On the other hand, in an operation mode which uses the bins 350, the drive motor 117 and solenoid 107 do not have to be powered. This is desirable from the efficient power supply standpoint. In addition, the two fully independent transport paths promote easy jam recovery, for example.

Figure 10:
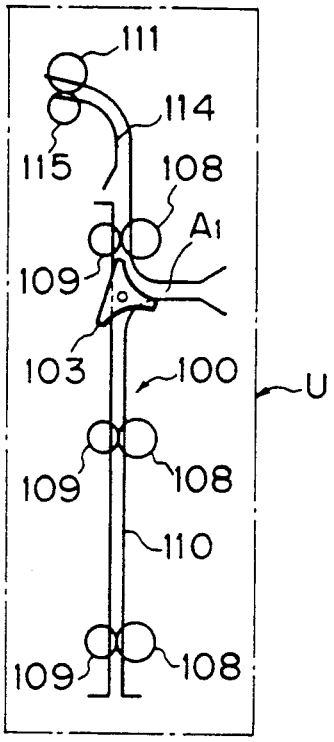
FIG. 10 is a front view showing another specific configuration of the upper transport section.

The upper transport section 100 is constructed into a unit and is easy to remove. FIG. 10 shows another specific configuration of the upper transport section 100, i.e., a unit U having an inlet $A_1$. It will be seen that the finisher is usable with a copier body having an outlet at a different level only if the unit U is replaced with another. In FIG. 10, the same components as those shown in FIG. 5 are designated by the same reference numerals.

Referring again to FIG. 5, the skew section 200 is a unit for changing, when a paper sheet is driven out of the copier body with the center thereof being used as a reference, the reference to the front edge of the paper sheet within the transport path. The skew section 200 is situated in the vertical portion below the pawl 103. Using the vertical portion is successful in reducing the overall size of the sorter.

In a sort or stack mode which uses the bins 350, the paper sheet or copy copy sheet fed from the copier body is steered by the pawl 103 toward the inlet roller 201 of the skew section 200. The inlet roller 201 is made of EPDM or chloroprene rubber. The driven roller 214 is constantly pressed against the inlet roller 201 by a leaf spring or similar biasing member.

Figure 11:
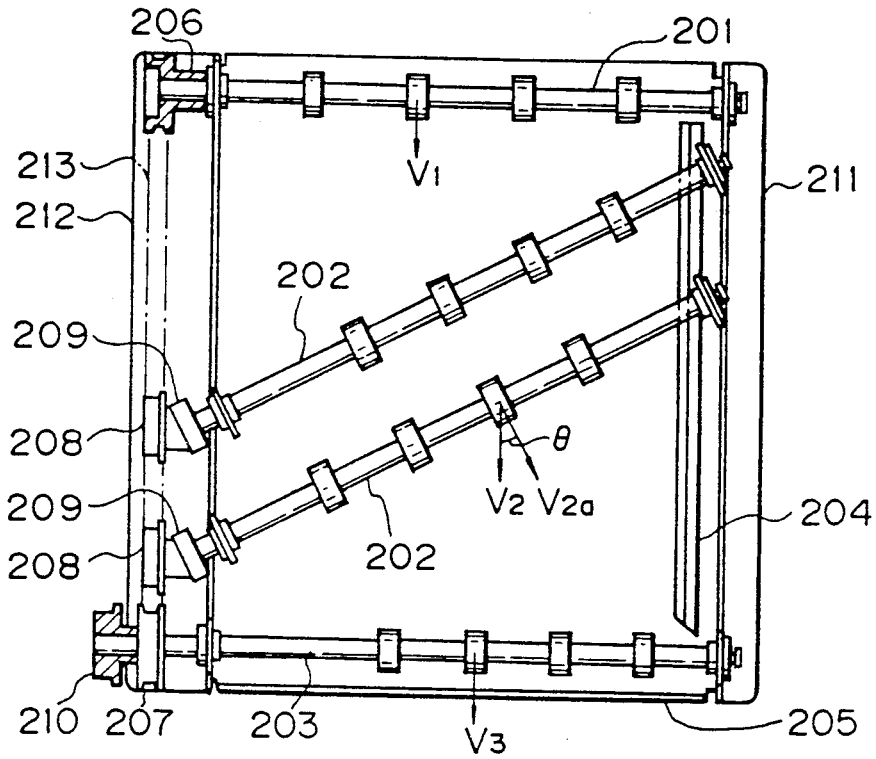
FIG. 11 is a side elevation of skew rollers.
Figure 12:
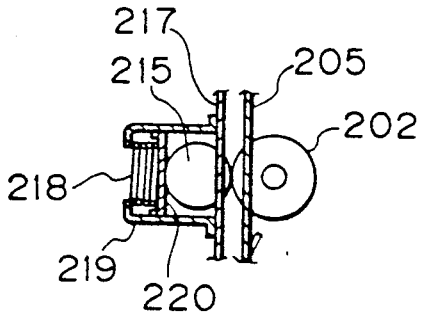
FIG. 12 is an enlarged view of a driven ball and its associated elements.

FIG. 11 shows a part of the skew section 200 where the skew rollers 202 are positioned. As shown, the two skew rollers 202 each is inclined by about 25 to 30 degrees such that the paper sheet is directed toward a reference guide 204. The skew rollers 202 are also made of EPDM or chloroprene rubber. As shown in FIG. 12, the driven rollers 215 associated with the skew rollers 202 each is implemented with a ball 215 which is biased by a compression spring 218. Such a configuration increases the freedom regarding the rotating direction of a paper sheet and, when the copy sheets abuts against the reference guide 204, prevents it from being bent or otherwise deformed. The paper sheet driven askew into abutment against the reference guide 204 reaches the outlet roller 203. The outlet roller 203 is made of the same material as the inlet roller 201 and insures the transport of the paper sheet to the following transport path. In FIG. 12, a case 219, a pressing member 220 and the compression spring 218 cooperate to press the ball 215 in the vertical transport path. The rotation speed $V_1$ of the inlet roller 201 is nearly equal to the rotation speed $V_2$ of the skew rollers 202 which is in turn lower than the rotation speed $V_3$ of the outlet roller 203. It is to be noted that since the rotation speed $V_2$ of the skew rollers 202 is a downward transport component, it is selected to be $V_{2a} \times \cos\theta$. In illustrative embodiment, the speed $V_2$ is $V_3 \cos\theta$ because $V_{2a}$ is equal to $V_3$. Further, the transporting force $F_1$ of the inlet roller 201 is greater than the transporting force $F_2$ of the skew rollers 202 which is in turn nearly equal to the transporting force $F_3$ of the outlet roller 203. Providing only the inlet roller 201 with such a great transporting force $F_1$ is advantageous in that after the leading edge of a paper sheet has reached the skew rollers 202, the sheet is prevented from being driven askew until the leading edge thereof moves away from the inlet roller 201, whereby the skew timing is maintained constant. The transporting force $F_3$ of the outlet roller 203 which is selected to be equal to the transporting force $F_2$ of the skew rollers 202 insures some margin regarding the skew transport distance.

Figure 13:
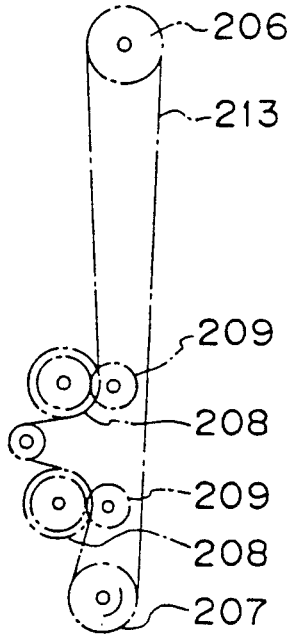
FIG. 13 is a view showing a drive system associated with a skew section.
Figure 14:
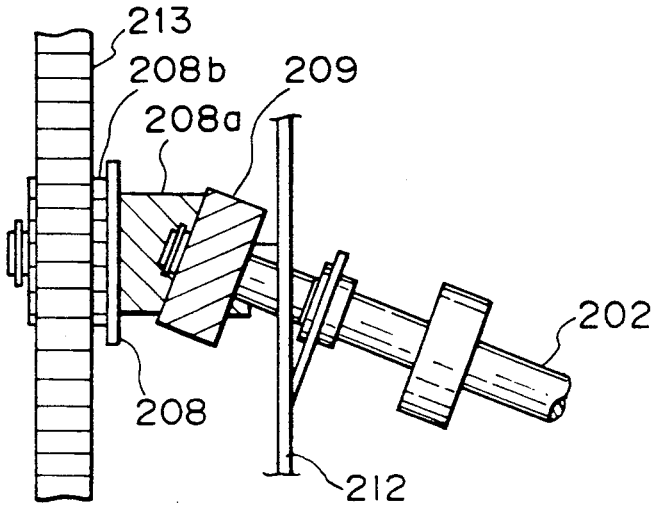
FIG. 14 is an enlarged front view of a drive transmitting arrangement.
Figure 15:
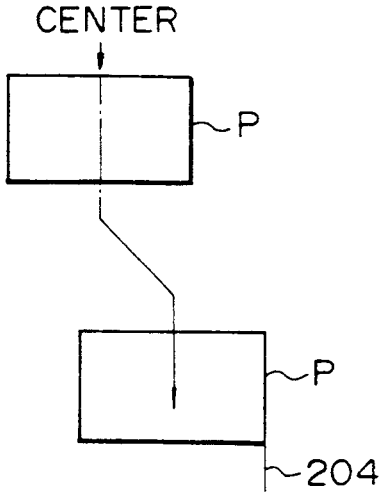
FIG. 15 is a view demonstrating skewing.

FIG. 13 shows a drive system associated with the skew section 200. In FIGS. 11 and 13, a driving force is applied to a timing pulley 210 which is affixed to the shaft of the outlet roller 203. The timing pulley 210 transmits the driving force to the inlet roller 201 via a timing pulley 206 and a double-tooth timing belt 213. The timing pulley 206 is rigidly mounted on the shaft of the inlet roller 201. FIG. 14 shows a drive transmitting portion in an enlarged front view. As shown in FIGS. 11 and 14, since each skew roller 202 has to have the shaft thereof inclined, it is driven by the timing belt 213 via an idler 208 which has a helical gear **208*a* and a timing pulley 208*a*. FIG. 15 shows the skew motion of a copy sheet schematically. As shown, a paper sheet P begins moving askew as soon as its trailing edge moves away from the inlet roller 201, ends the skew motion when its end abuts against the reference guide 204, and then moves straight ahead under the action of the outlet roller 203**.

Figure 16:
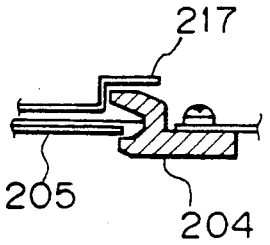
FIG. 16 is a partly sectional view of a reference guide portion.

The reference guide 204 is shown in a fragmentary section in FIG. 16. In the illustrative embodiment, the reference guide 201 is fastened by screws to a drive guide 205 which faces a driven guide 217.

The paper sheet moved away from the skew section 200 is guided by the transport guide 308 and driven guides 309 and 310 and driven by the transport roller 301 and driven rollers 305 and 306 to the deflecting section B. The deflecting section B has the discharge roller 304, driven roller 307, driven guide plate 311, and pawls 312. The pawls 312 each is actuated by a solenoid, i.e., it is opened or closed by a solenoid on the basis of a designated mode to stack copy sheets in the associated bin 350.

Figure 20:
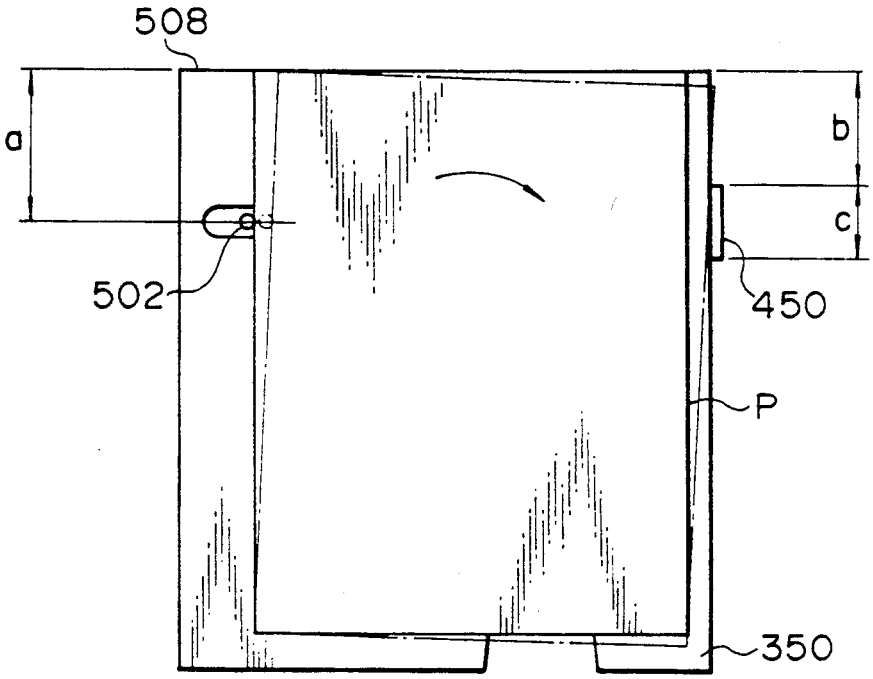
FIGS. 20 and 21 are plan views representative of a relation between bins and paper sheets.
Figure 21:
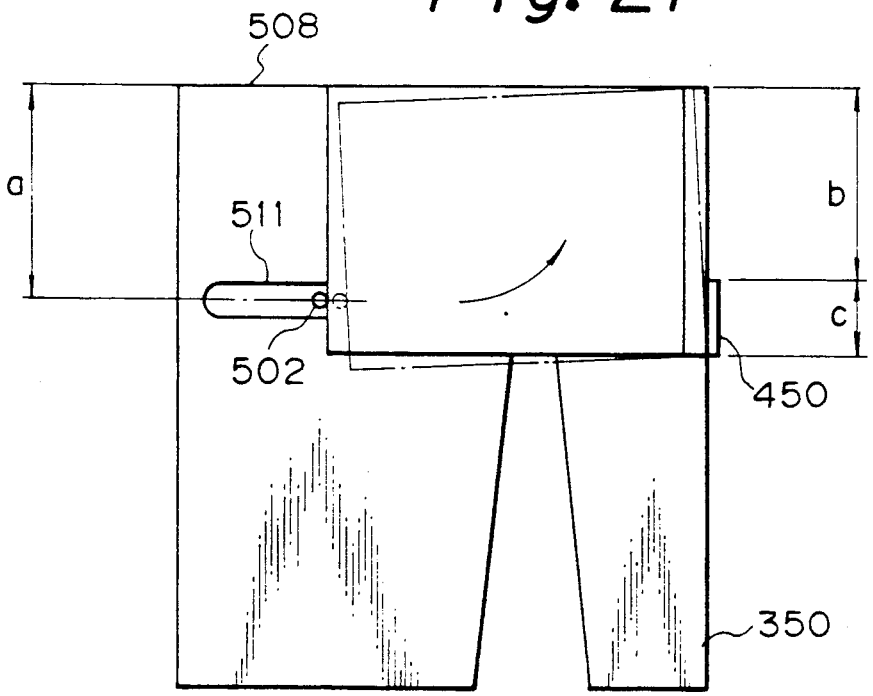

The jogging unit will be described with reference to FIGS. 17 to 19. As shown, a bin fence 450 extends upright from one side edge of each bin 350 while an upright wall 508 extends from another side edge of the bin 350 which is perpendicular to the edge where the bin fence 450 is positioned. An elongate slot 511 is formed through the bin 350 in close proximity to the edge opposite to the edge where the bin fence 450 is positioned. As shown in FIG. 18, the elongate slot 511 extends toward the bin fence 450 over a predetermined distance. The distance a of the slot 511 to the upright wall 508 is smaller than the sum of the distance b between the bin fence 450 and the upright wall 508 and the width c of the fin fence 450. In the illustrative embodiment, the distance a lies in the range of 125 to 140 millimeters which was found to be favorable by experiments. Specifically, should the dimension a be smaller than 124 millimeters, a moment would act on a paper sheet P of relatively large format such as A3, as shown in FIG. 20. Conversely, should the dimension a be greater than 140 millimeters, a moment would act on a paper sheet P of relatively small format such as B5 and fed in a laterally long position, as shown in FIG. 21. Such moments prevented paper sheets from being positioned in an expected panner.

Figure 17:
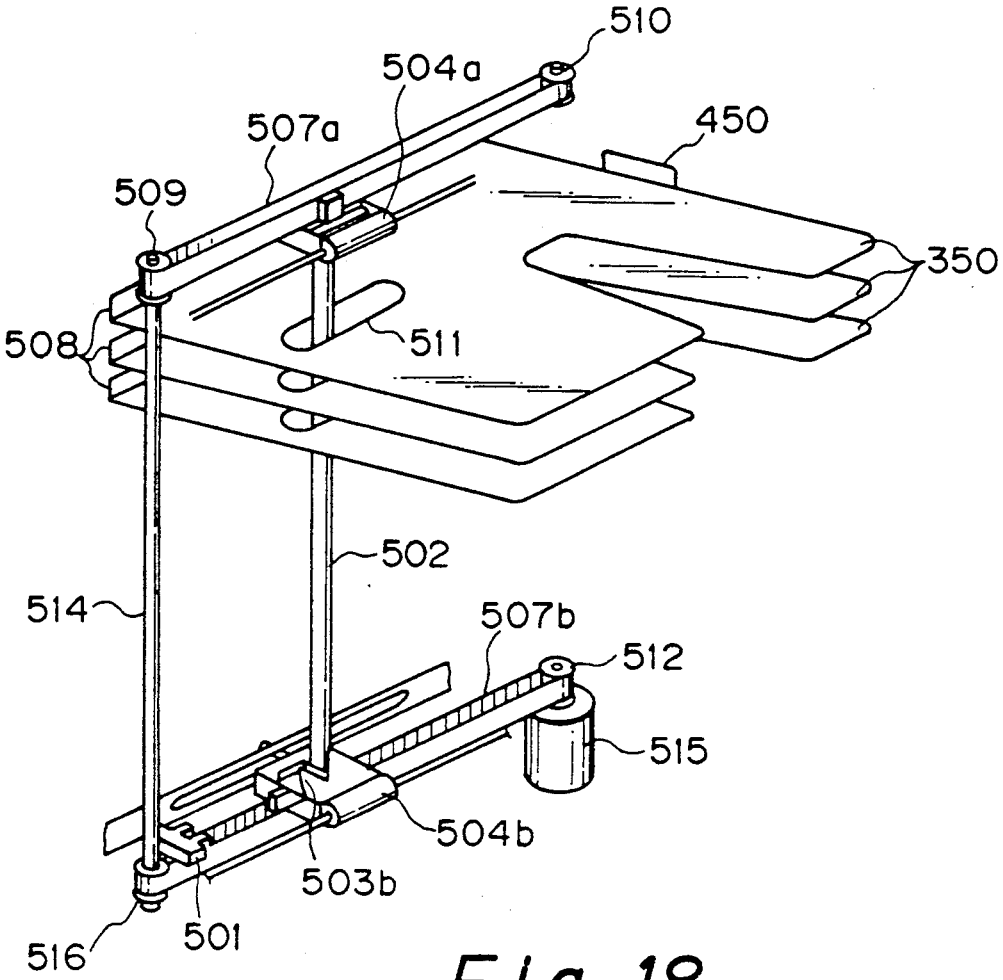
FIG. 17 is a perspective view of a jogging device.
Figure 18:
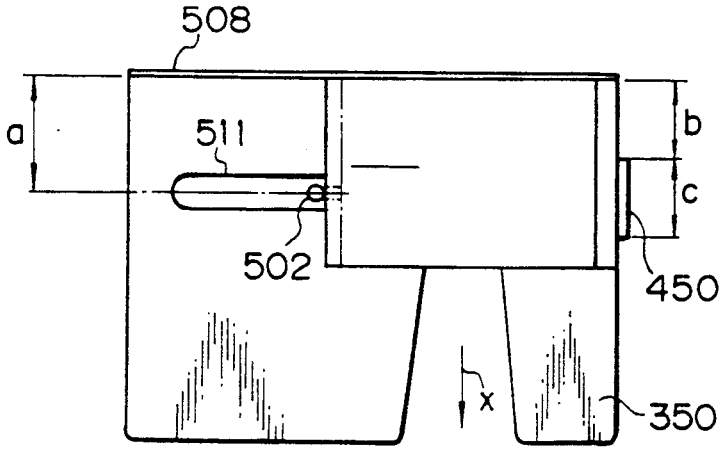
FIG. 18 is a plan view indicating a relation between the jogging device and bins.
Figure 19:
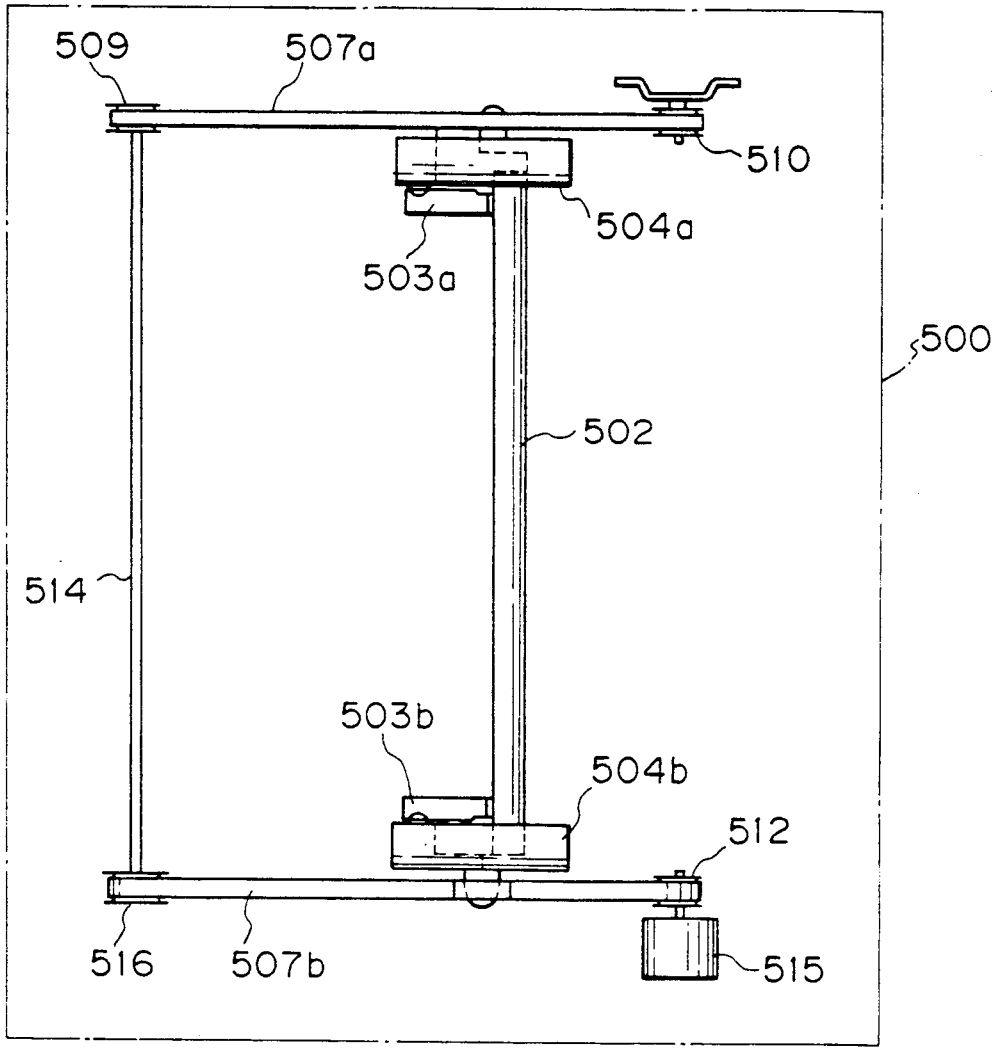
FIG. 19 is a side elevation of the jogging device.
Figure 22:
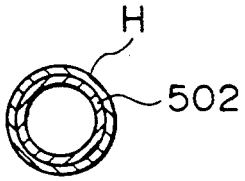
FIG. 22 is a cross-section showing another specific configuration of a jogger shaft.
Figure 23A:
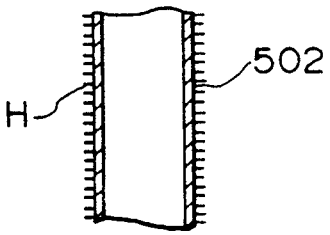
FIGS. 23A and 23B are longitudinal sections each showing another specific configuration of the jogger shaft.
Figure 23B:
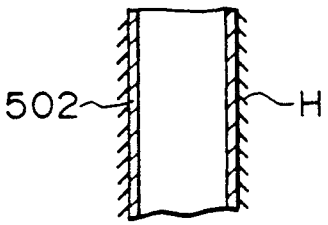
Figure 24:
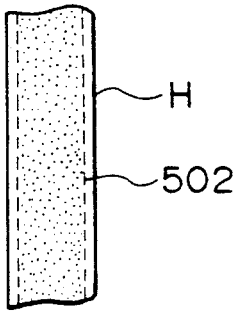
FIG. 24 is a side elevation showing another specific configuration of the jogger shaft.
Figure 25:
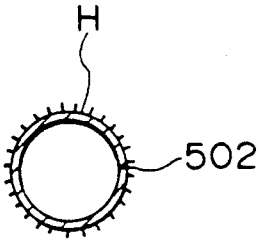
FIG. 25 is a cross-section showing another specific configuration of the jogger shaft.

In FIGS. 17 to 19, the shaft jogger 502 extends upright throughout the slots 511 of the individual bins 350 and functions to position paper sheets by abutting against their edge. The jogger shaft 502 is provided with a high friction surface by rubber, sponge, sand paper, sand blasing or similar technology, as will be described. As shown in FIG. 19, the jogger shaft 502 is constantly biased by leaf springs **503*a* and 503*b* so as to free a paper stack from excessive forces, free individual copy sheets from scratches and creases, and free the motor from overloads. FIGS. 22 to 25 each shows a specific implementation for providing the shaft 502 with a high friction surface. In FIG. 22, rubber, cork, sponge or sandpaper serving as a high friction membeer H is adhered to at least a part of the surface of the shaft 502 which contacts copy sheets. In FIG. 23A, the high friction member H is implemented as horizontally projecting bristles while, in FIG. 23A, it is implemented as downwardly projecting bristles. In FIG. 24, the surface of the shaft 502 is treated by sand blasting to implement the high friction member H. Further, in FIG. 25, the high friction member H comprises powder or particles deposited on the surface of the shaft 502**.

Figure 26:
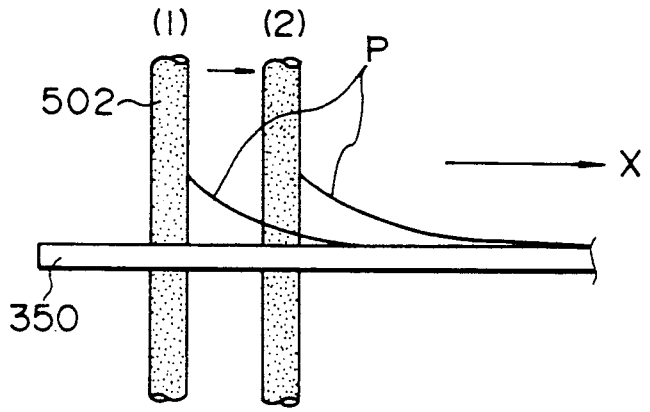
FIG. 26 shows the operation of the jogger shaft.

FIG. 26 shows the interaction of the jogger 502 and the copy sheet P. As the shaft 502 moves to shift the paper sheet P from a position (1) toward a position (2), the high friction member H causes the sheet P to move in a direction X without slipping on the shaft 502 even through the sheet P may have been curled. The paper sheet P, therefore, surely reaches the bin fence 450 and is positioned by the latter with accuracy. To further promote accurate positioning of the paper sheet P, an arrangement may be made such that the shaft 502 moves downward while urging the sheet P in the direction X. This will be successful in correcting the deformation (curl) of the paper sheet P forcibly. In such a configuration, the shaft 502 may be provided with a member rotatable up and down to press a curled portion of the paper sheet.

As shown in FIGS. 17 and 19, the upper and lower ends of the jogger shaft 502 are nested in recesses of holders 504*a* and 504*b*, respectively. Timing belts 507*a* and 507*b* are respectively located above and below the bins 350 and extend in substantially the same direction as the slots 511 of the bins 350. Lugs provided on the holders 504*a* and 504*b* are respectively mated with recesses formed in the timing belts 507*a* and 507*b*, whereby the holders 504*a* and 504*b* are affixed to the associated timing belts 507*a* and 507*b*. Among pulleys 509, 510, 516 and 512 over which the timing belts 507*a* and 507*b* are passed, the pulleys 509 and 516 are respectively affixed to opposite ends of a vertically extending drive shaft 514. The lower timing belt 507*b* is passed over a pulley 512 which is rigidly mounted on the output shaft of a size shift motor 515. The displacement of the jogger shaft 502 based on size is supervised in terms of the number of pulses to be applied to the size shift motor 515.

Specifically, for a certain paper size, the size shift motor 515 drives the jogger shaft 502 to a position spaced apart by a predetermined distance from a paper sheet which will arrive (in the embodiment, 10 millimeters; hereinafter referred to as a first stop position). As soon as such a paper sheet fully enters the bin 350 and drops onto the upright wall 508, the jogger shaft 502 is moved toward the sheet and then brought to a stop when moved beyond the edge of the sheet by a predetermined amount (in the embodiment, 5 millimeters; hereinafter referred to as a second stop position). When the shaft 502 is to be returned after positioning a copy sheet, it may be once brought to a stop at the width corresponding to the paper size (hereinafter referred to a third position) and then moved to its original position. Alternatively, the moving speed of the shaft 502 may be varied during the course of the return. This is to prevent the copy sheet once positioned on the bin 350 from moving away from the bin fence 450 due to its own elasticity. In the illustrative embodiment, the jogger shaft 502 moves from the second stop position to the third stop position at a speed lower than a speed at which the paper sheet urged against the bin fence 450 springs back due to the elasticity thereof. As a result, the position of the paper sheet on the bin 350 is prevented from being disturbed due to spring-back or similar cause.

A reflection type sensor, not shown, is mounted on the holder 504*a* in a position closer to the bin fence 250 than to the shaft 502. After the jogger shaft 502 has positioned the first copy sheet on the bin 350, it is moved by the size shift motor 515 with the above-mentioned sensor searching for the edge of the copy sheet. Since the size shift motor 515 is implemented with a stepping motor, it is possible to find the position of the edge of the copy sheet by counting pulses from the instant when the motor 515 has begun to rotate to the instant when the sensor turns on. Hence, the third position of the jogger shaft 502 can be determined accurately even if the paper size is irregular (in the range of 1 to 2 millimeters). Alternatively, the third position may be simply calculated by use of a paper size signal transmitted from the copier body so as to move the shaft 502 accordingly.

While the paper positioning arrangement has been shown and described in relation to the bin 350, it is similarly applicable to a conventional tray to be loaded with copy sheets. A paper stack is urged against the bin fence 450 and thereby positioned at one edge thereof. Regarding another edge perpendicular to that edge, the paper stack is abutted against the upright wall 508 which is perpendicular to the bin fence 450, by using the inclination of the bin 350.

Each bin 350 is provided with various kinds of devices for promoting accurate and efficient paper positioning and stapling, as follows.

Figure 27:
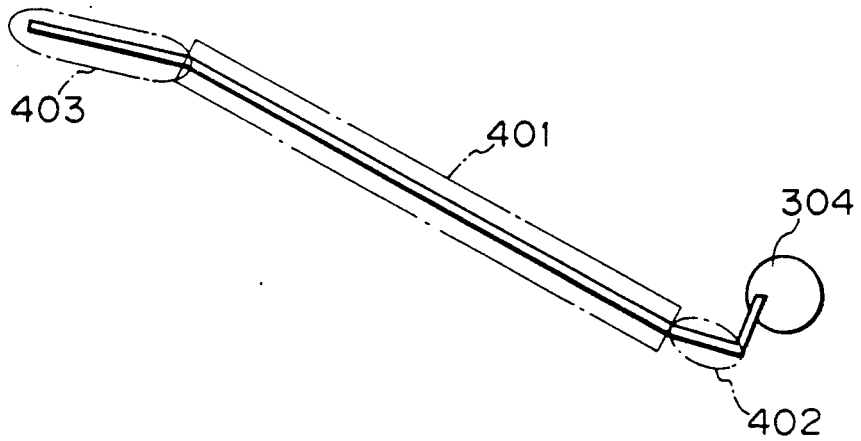
FIG. 27 shows how a bin is mounted.
Figure 28:
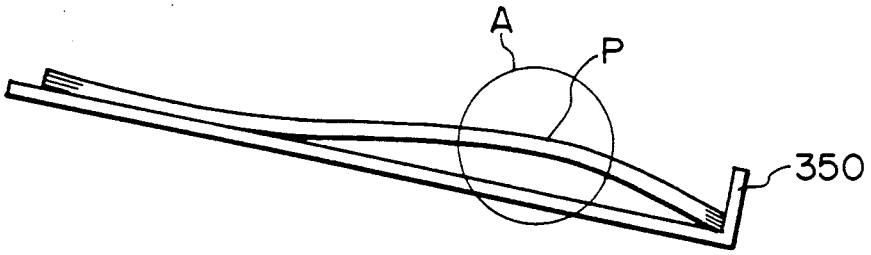
FIG. 28 is a view showing how paper sheets are bent.

FIG. 27 shows the bin 350 in a position mounted on the sorter. As shown, the bin 350 has a main angular portion 401 and auxiliary angular portions 402 and 403 which are smaller in inclination than the main angular portion 401. When the main angular portion 401 is provided with a certain angle (in the illustrative embodiment, 30 degrees), a paper stack begins to bend as the number of paper sheets increases. This is especially true when the individual paper sheets are thin (see portion A, FIG. 28). To prevent this, the auxiliary angular portion 403 bears a part of the weight of the paper stack. In this embodiment, the angle of the auxiliary angular portion 403 is selected to be 15 degrees. However, should the main angular portion 401 be excessively short and the auxiliary angular portiuon 403 be excessively long, the auxiliary portion 403 would bear an excessive part of the weight of the paper stack to thereby prevent the stack from falling along the bin 350. Preferably, the main angular portion and the auxiliary angular portion are dimensioned about 300 millimeters and about 80 millimeters, respectively.

Figure 29:
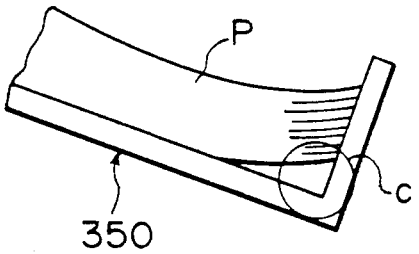
FIGS. 29 and 30 are views for explaining different stacking conditions.
Figure 30:
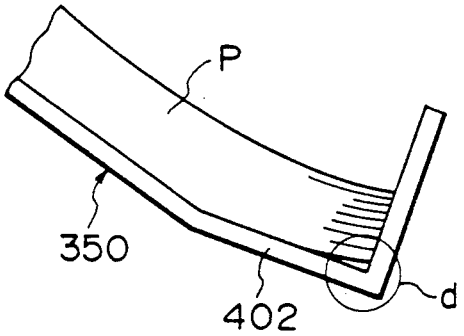

The auxiliary angular portion 402 is a countermeasure against face curl. FIG. 29 shows a bin 350 without the auxiliary angular portion 402 and paper sheets with face curl stack on such a bin 350, while FIG. 30 shows a bin 350 with the auxiliary angular portion 402 and paper sheets with face curl stacked thereon. In FIG. 29, the paper stack P is spaced apart from the bin 350 in a portion c while, in FIG. 30, the clearance between the paper stack P and the bin 350 is not noticeable in a portion d. This indicates that the configuration shown in FIG. 30 allows a greater number of paper sheets with face curl to be stacked together than the configuration shown in FIG. 29. In the illustrative embodiment, the auxiliary angular portion 402 has an angle of 15 degrees and a length of about 20 millimeters.

Figure 31:
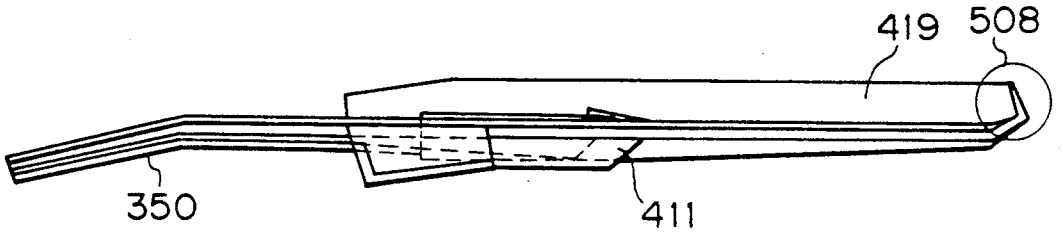
FIG. 31 is a front view of a bin.
Figure 32:
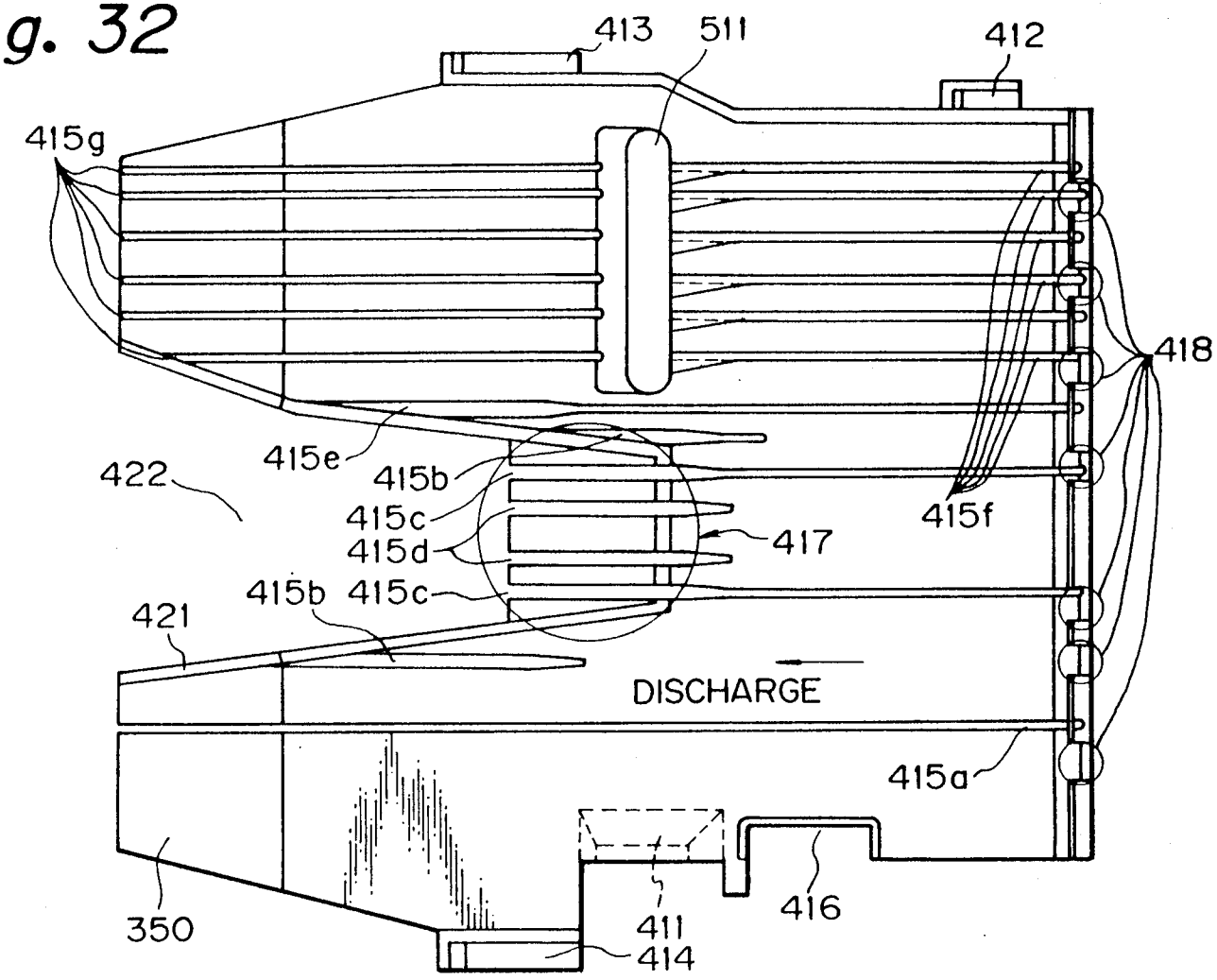
FIG. 32 is a plan view of a bin.
Figure 33:
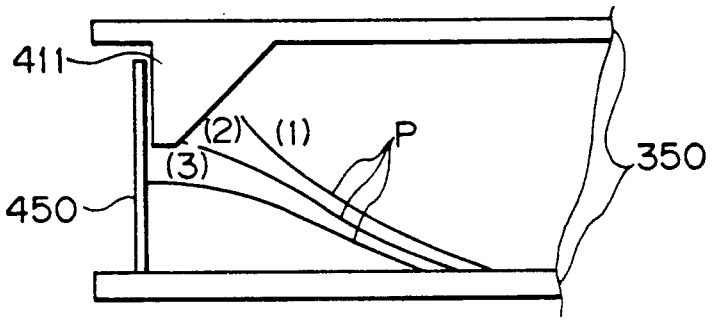
FIGS. 33 and 34 are views useful for understanding the significance of a pressing member.
Figure 34:
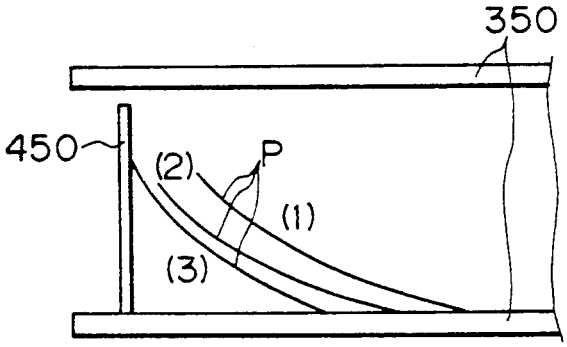

Referring to FIGS. 31 and 32, a projection 411 extends downward from the underside of the bin 350 for the purpose of pressing the curl of a paper sheet. Although a paper sheet driven out onto the bin 350 is positioned in one direction, it is apt to get over the fence 450 when its curl is great. The projection 411 presses such a curl of the paper sheet to promote accurate positioning. FIGS. 33 and 34 show a bin 350 with the projection 411 and a bin 350 without the projection 411, respectively. In FIGS. 33 and 34, a paper sheet sequentially assumes positions (1), (2) and (3). In FIG. 32, the reference numerals 412, 413 and 414 designate projections for fixing the bin 350 in place.

Figure 35:
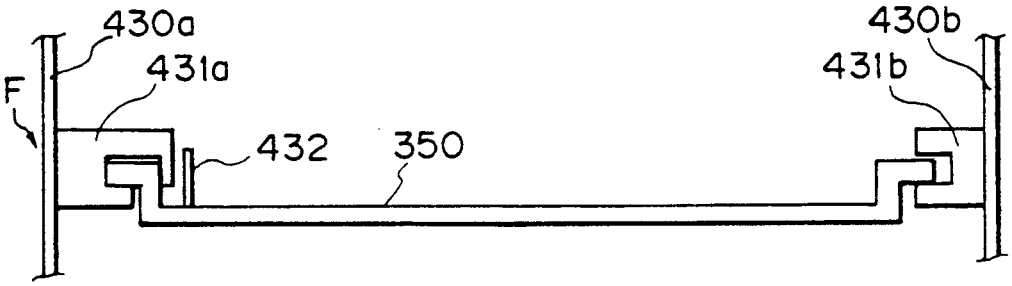
FIG. 35 is a side elevation of a bin.

FIG. 35 shows the bin 350 in a mounted position. In the figure, there are shown side panels 430*a* and 430*b* and bin supports 431*a* and 431*b*. The bin 350 is fixed in place by the bin support 430*a* located at the bin fence side F and is simply held on the other bin support 431*b* while being slightly spaced apart from the latter. Fixing the bin 350 at the bin fence side F maintains the stapling position constant. The small clearance between the bin 350 and the bin support 431*b* successfuly absorbs thermal expansion of the bin 350.

Figure 36:
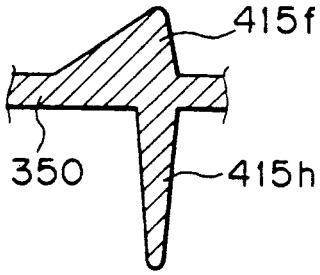
FIGS. 36 and 37 are fragmentary sections each showing a rib.
Figure 37:
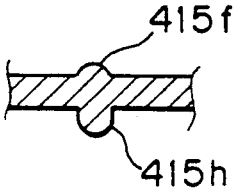

As shown in FIG. 32, the bin 350 is provided with a bin rib 415*a* for allowing a paper sheet to fall smoothly. Bin ribs 415*b*, 415*c* and 415*e* also provided on the bin 350 are higher than the other ribs in their portions close to the notch which is adapted to take out a paper stack, whereby a paper stack is prevented from bending when loaded on the bin 350. The bend of a paper stack would obstruct smooth fall of the stack. When a paper sheet is positioned by the jogger shaft 502 in a bent position, it often fails to be positioned with accuracy since it lacks elasticity. Ribs 415*f* are so configured as to prevent a paper sheet from entering the slot 511. Specifically, as shown in FIG. 36, the ribs 415*f* each protrudes upward and downward in the vicinity of the slot 511 to prevent a paper sheet from entering the slot 511 and to prevent it from entering the not of the overlying bin. The ribs 415*f* are arranged in a position substantially 10 millimeters inward of the edge of the paper size so as to surely guide the edges of those paper sheets which are apt to enter the slot 511. Each rib 415*f* extending upward from the bin 350 has a triangular configuration which is less inclined at one side than at the other side. With such a configuration, the ribs 415*f* guide a stapled paper stack P so that the latter may be discharged without being caught by the former. As shown in FIG. 37, the ribs 415*f* each is configured as comparatively low ribs 415*f* and 415*h* in the vicinity of the upright wall 508 of the bin 350, FIG. 31, and is sequentially increased in height toward the slot 511 for the purpose of accommodating a greater number of paper sheets. Bin ribs 415*g* are aligned with the ribs 415*f* and adapted to promote smooth fall of paper sheets.

Figure 38:
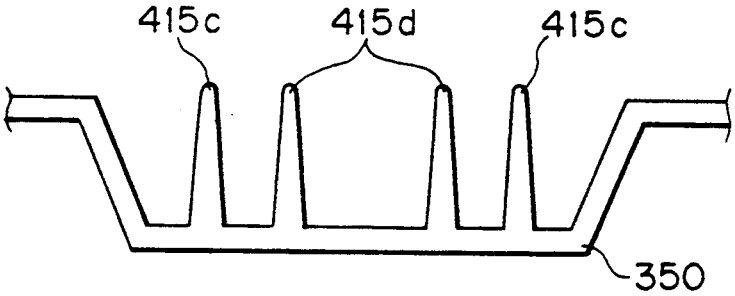
FIG. 38 is a fragmentary side elevation of a bin.

In FIG. 32, the bin 350 is formed with a notch 416 to allow the chuck section to chuck a stack of paper sheets positioned on the bin 350. A portion 417 of the bin 350 is positioned at a lower level than the other part of the bin 350, as best shown in FIG. 38. This portion 417 facilitates the removal of a paper stack of relatively small size. Should the notch 422 be extended deeper into the bin 350 in order to omit the portion 417, the mechanical strength of the bin 350 would be critically lowered. In FIG. 32, the reference numeral 418 designates notches for accommodating a discharge roller.

Figure 39:
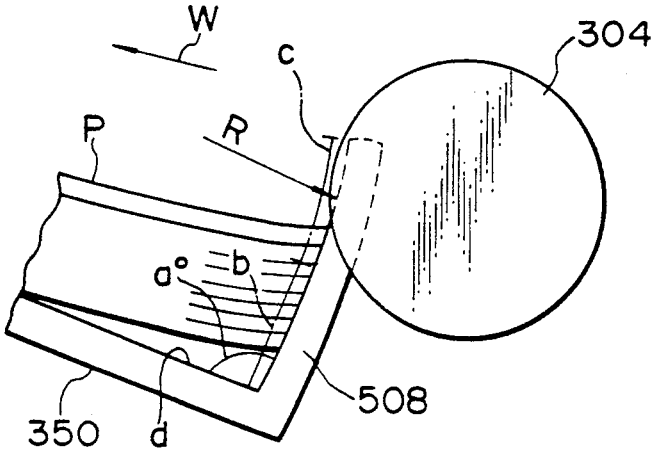
FIG. 39 shows a positional relation between a discharge roller and an upright wall.
Figure 40:
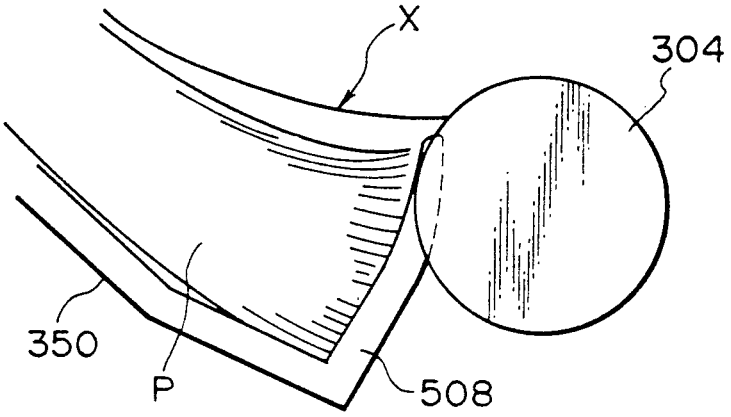
FIG. 40 indicates how the trailing edges of paper sheets get on the upright wall.

FIG. 39 shows a positional relation between the discharge roller 304 and the upright wall 508 of the bin 350. The angle a shown in the figure is slightly greater than 90 degrees. A portion b is straight while a portion c is curved. The dicharge roller 304 protrudes beyond the portion c in the paper discharging direction. The configuration of the upright wall 508 shown in FIG. 39 is effective regarding the positioning accuracy when paper sheets have face curl. However, when more than a certain number of paper sheets with face curl are stacked on the bin 350, the stack P becomes higher than the upright wall 508 with the result that an upper part thereof rides on the wall 508, as indicated by X in FIG. 40. In the illustrative embodiment, the unique configuration of the wall 508 and the unique position of the discharge roller 304 mentioned above are combined to enhance accurate positioning of paper sheets with face curl. In addition, the discharge roller 304 urges the paper sheets downward to eliminate the occurrence shown in FIG. 40. A rib 419 shown in FIG. 31 and a rib 421 shown in FIG. 32 reinforce the bin 350.

Figure 41:
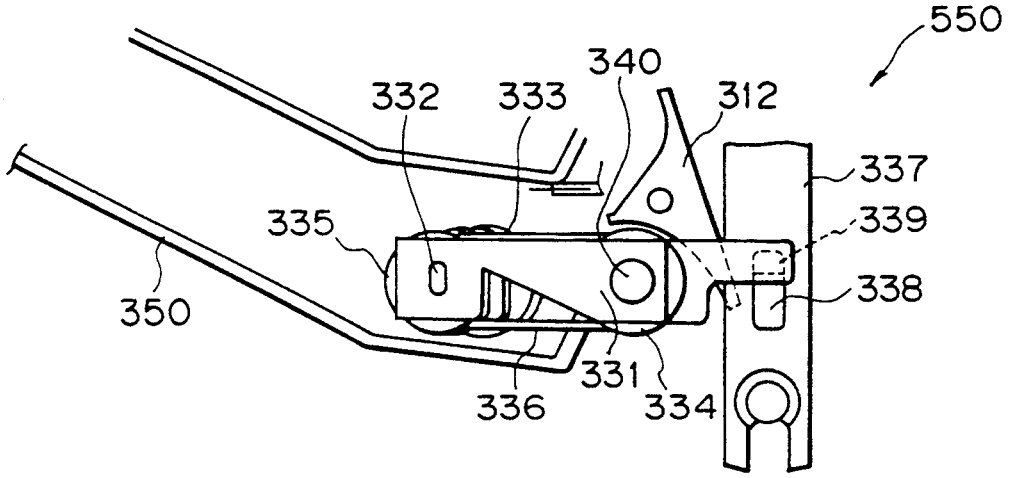
FIG. 41 is a front view of a positioning roller device.
Figure 42:
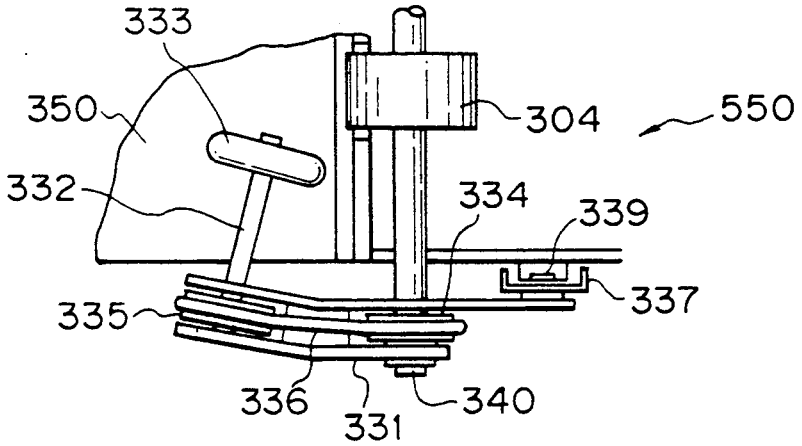
FIG. 42 is a front view of the positioning roller device.

FIGS. 41 and 42 show a positioning roller assembly 550 which promotes more accurate paper positioning with no regard to the kind of paper sheets. As shown, the assembly 550 has a positioning roller 333 mounted on a driven shaft 332 which is in turn retained by a roller holder 331. The roller holder 331 is mounted on a shaft 340 together with the discharge roller 304. A drive pulley 334 is affixed to the discharge roller 304. The positioning roller 333 is driven by the drive pulley 334 in interlocked relation to a driven pulley 335 affixed to the driven shaft 332 by a belt 336. The drive pulley 334 and driven pulley 335 have an inclination of about 10 degrees. The positioning roller 333 shifts a paper sheet obliquely and thereby positions it against both of the bin fence 450 and upright wall 508.

Figure 43:
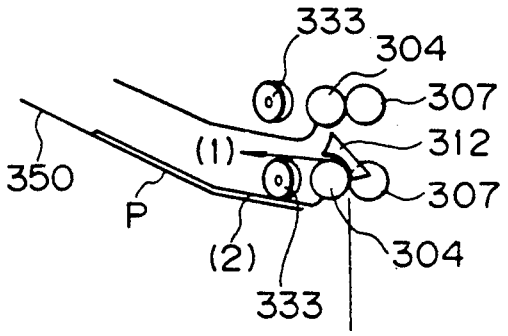
FIG. 43 shows a relation between paper sheets and a positioning roller.
Figure 44:
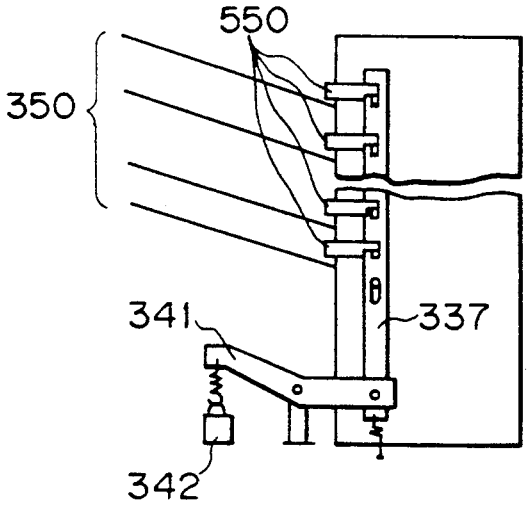
FIG. 44 is a front view showing a condition wherein the positioning roller devices are arranged.
Figure 45:
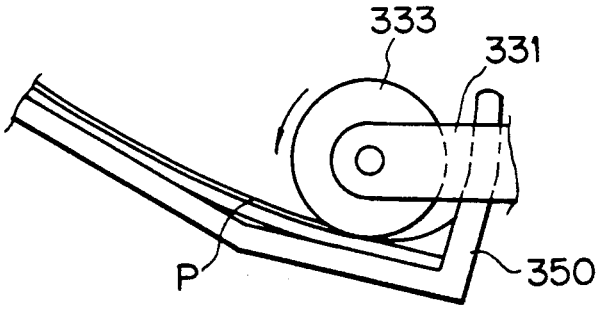
FIG. 45 shows how the positioning roller positions a paper sheet.
Figure 46:
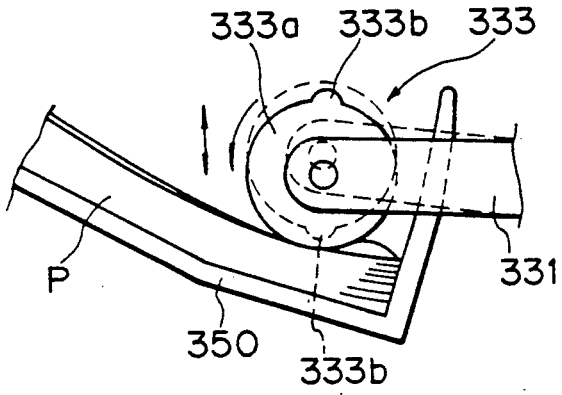
FIGS. 46, 47, and 48 show other specific configurations of the positioning roller.
Figure 47:
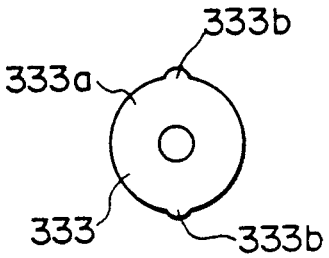
Figure 48:
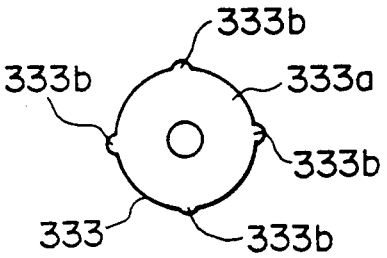

FIG. 43 indicates a positional relation between the positioning roller 333 and a paper sheet P. A paper sheet P transported by the discharge roller 304 and driven roller 307 is fed into the bin 350 through the associated pawl 312. At this instant, the positioning roller 333 is spaced apart from the bin 350 by 5 to 7 millimeters, so that the paper sheet P moves above the roller 333 into the bin 350 (position (1)). The rear edge of the paper sheet P jumps out over the upright wall 508 by 20 to 30 millimeters due to the speed at which the sheet P is driven into the bin 350. The center of the positioning roller 333 is spaced apart by about 15 millimeters from the upright wall 508 and by about 20 millimeters from the bin fence 450. A paper sheet P dropped on the positioning roller 333 is forced to drop by the roller 333 onto the bin 350. The paper sheet P thus laid flat on the bin 350 by the roller 333 is shifted toward the wall 508 due to the inclination of the bin 350 and, as a result, gets under the roller 333 (position (2)). Thereafter, when the rear edge of the paper sheet P contacts or is about to contact the wall 508, the jogger shaft 502 is moved to cause the sheet P into abutment against the bin fence 450, as stated earlier. Subsequently, as shown in FIG. 44, a solenoid 342 is energized to raise a bracket 337. As a result, a pin 339 received in a hole 338, FIG. 41, is raised to cause the roller holder 331 to rotate counterclockwise about the shaft 340, whereby the positioning roller 333 is let fall onto the bin 350. In this condition, the roller 333 in rotation urges the paper sheet P against the wall 508 and bin fence 450. The movement of the shaft 502 and that of the positioning roller 333 described above are completed before the next paper sheet arrives at the bin 350 or before it reaches the position between the roller 33 and the bin 350. The second and successive paper sheets are positioned in the same manner as the first sheet. If the force exerted by the positioning roller 33 on a paper sheet P for the positioning purpose is excessively great, the paper sheet will be bent, as shown in FIG. 45. In the light of this, the transporting force of the positioning roller 333 is selected such that the roller 333 transports a single paper sheet P and, on abutment of the sheet P against the bin fence 450 and wall 508, simply slips on the sheet P. Specifically, as shown in FIG. 46, the positioning roller 333 has a high friction member 333*b* which protrudes from a part of a low friction member 333*a*. Alternatively, a plurality of high friction members 333*b* may be provided on the positioning roller 333, as shown in FIG. 47 or 48. If desired, a member having an adequate degree of friction may be provided on the positioning roller 333 in order to achieve the same advantage.

A stack of paper sheets positioned by the above sequence of steps is stapled or otherwise finished and then taken out in a direction indicated by an arrow x in FIG. 18. The removal of the finished paper stack is easy because no obstruction exists in the direction x.

Figure 49:
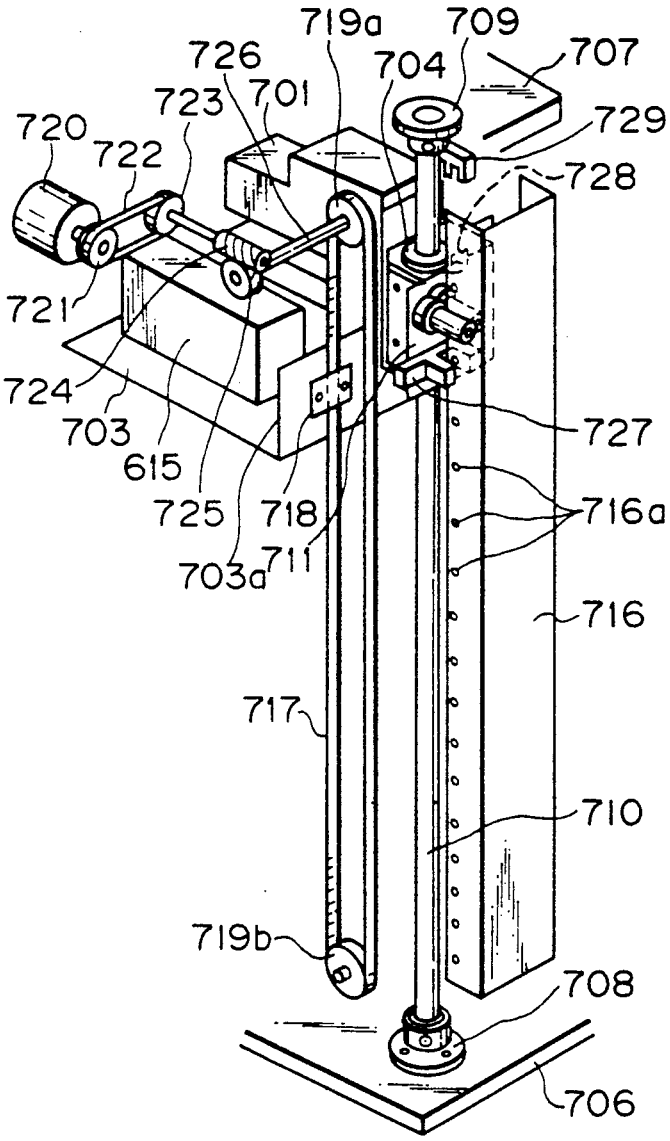
FIG. 49 is a perspective view of a stapler device.
Figure 50:
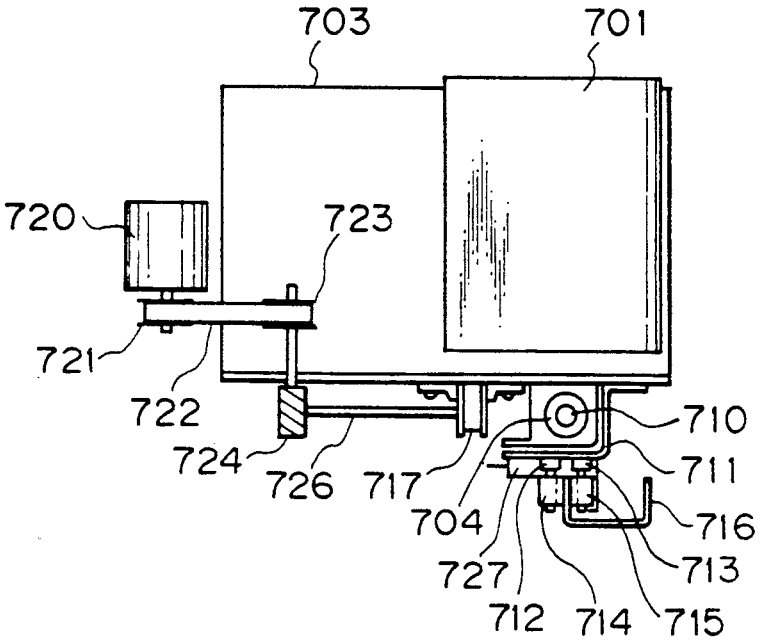
FIG. 50 is a plan view of the stapler device.
Figure 51:
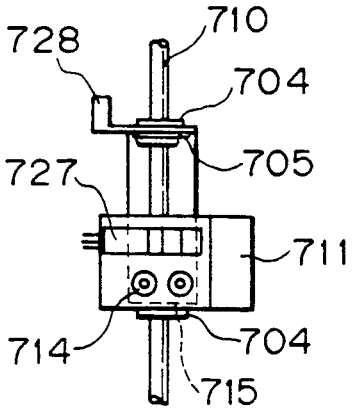
FIG. 51 is a front view of a bearing portion.

Referring to FIGS. 49, 50 and 51, the stapler device 700 located at one side of the bins 350 has a flat bracket 703 which is loaded with the stapler 701 and paper pulling device 615. The stapler 701 sequentially drives staples into paper sheets distributed to and stacked on the individual bins, while the paper pulling device 615 chucks such paper stacks one at a time and carries them substantially in the horizontal direction. One end of the bracket 703 is bent upward, and a bracket 703*a* is affixed to that end of the bracket 703. A bearing 704 shown in FIGS. 50 and 51 is mounted on the bracket 703*a* and affixed to the latter by a stop ring 705. A shaft 710 is retained by holders 708 and 709 which are mounted on a base 706 and an upper panel 707, respectively. The bearing 704 is slidably coupled over the shaft 710. Rollers 714 and 715 are respectively mounted on shafts 712 and 713 which are in turn mounted on the bracket 711. The rollers 714 and 715 hold a bracket 716 therebetween.

A drive belt 717 extends upward and substantially parallel to the side edges of the bins 350. The drive belt 717 is held between and fastened to the bracket 703*a* and a bracket 718 by screws and passed over pulleys 719*a* and 719*b* which are spaced apart by a predetermined distance in the vertical direction. The rotation of a drive motor 720 is transmitted to a pulley 723 by a pulley 721 mounted on the output shaft of the motor 720 and a belt 22. A drive gear 724 is mounted on the same shaft as the pulley 723 while a gear 725 is held in mesh with the drive gear 724. Hence, the rotation of the pulley 723 is transmitted to the drive pulley 719*a* by way of the drive gear 724 and gear 725. The drive pulley 719*a* is mounted on one end of a shaft 726. By such a gearing, the drive belt 717 is driven in a rotary motion to move the stapler 701 and paper pulling device 615 up and down. A position sensor 727 is provided on the bracket 711 in such a manner as to hold it therebetween. The bracket 716 has holes 716*a* at equally spaced positions thereof which correspond to the bins 350. This position sensing mechanism causes the stapler 701 and paper pulling device 615 to be so controlled as to stop at the positions where the individual bins 350 are located. Further, a lug 728 and a sensor 729, FIG. 49, cooperate to define the upper limit position of the bracket 703. Specifically, when the lug 728 enters the sensor 729, the motor 720 is deenergized.

Figure 52:
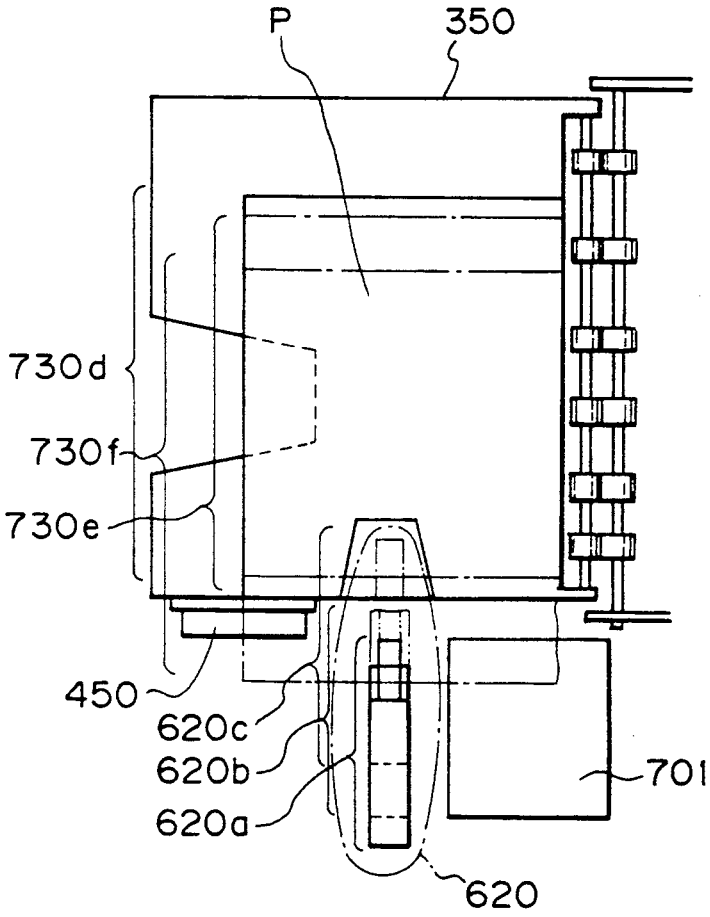
FIG. 52 is a view demonstrating the operation of the stapler device.

The operations of the stapler device 700 will be better understood with reference to FIG. 52 which schematically shows a paper sheet P laid on the bin 350, the chuck section 620, and stapler 701. Specifically, the paper sheet P just entered the bin 350 is located in a position 730*d* and then brought into abutment against the bin 450 by the previously stated jogging device. After the copying operation has been completed, the chuck section 620 advances from a position 620*b* to a position 620*c* both of which are indicated by dash-and-dot lines in the figure. At the position 620*c*, the chuck section 620 closes to chuck the paper stack P and then stops at a position 620*a* as indicated by a solid line in the figure. As a result, the paper stack is shifted to a position 730*f* and stapled by the stapler 701 on the bin 350. Thereafter, the stapled paper stack P is returned to a position 730*e* by a sequence of steps opposite to the above-stated sequence. Then, the stapler unit 700 is moved to the next bin 350 to repeat such a stapling operation. The stapling operation outlined above will be described in detail later.

Referring to FIGS. 53 to 56, the paper pulling device 615 has a chuck section 620 and a mechanism 640 for causing the chuck section 620 to move back and forth substantially in the horizontal direction. The chuck section 620 has an upper and a lower lever 622 and 624 which are rotatably mounted on a base plate 621. A solenoid 626 actuates the upper and lower levers 622 and 624 to cause an upper and a lower chuck 623 and 625 to chuck a paper stack P.

The reciprocating mechanism 640 has a frame 641 and a shaft 642 on and along which the chuck section 620 is slidable. Specifically, a bearing 629 carries the base plate 621 therewith and is slidably mounted on the shaft 642. A timing belt 643 is provided on the frame 641 for moving the chuck section 620 toward and away from the paper stack P. The chuck section 620 and timing belt 643 are affixed to an arm 621*a* extending out from the base plate 621. The timing belt 643 is passed over pulleys 644 and 645. The pulley 644 is mounted on the output shaft of a stepping motor 646. In this condition, the pulley 644 is rotated by the output of the stepping motor 646 to in turn move the timing belt 643. Then, the timing belt 643 causes the chuck section 620 affixed thereby through the arm 621*a* to move in a reciprocating motion. A position sensor 650 is provided on the frame 641 while a plate 630 is provided on the base plate 621 to be sensed by the sensor 650. The position sensor 650 is responsive to the home position of the chuck section 620. It is to be noted that the home position of the chuck section 620 intervenes between a chucking position on the bin 350 and a stapling position.

Figure 53:
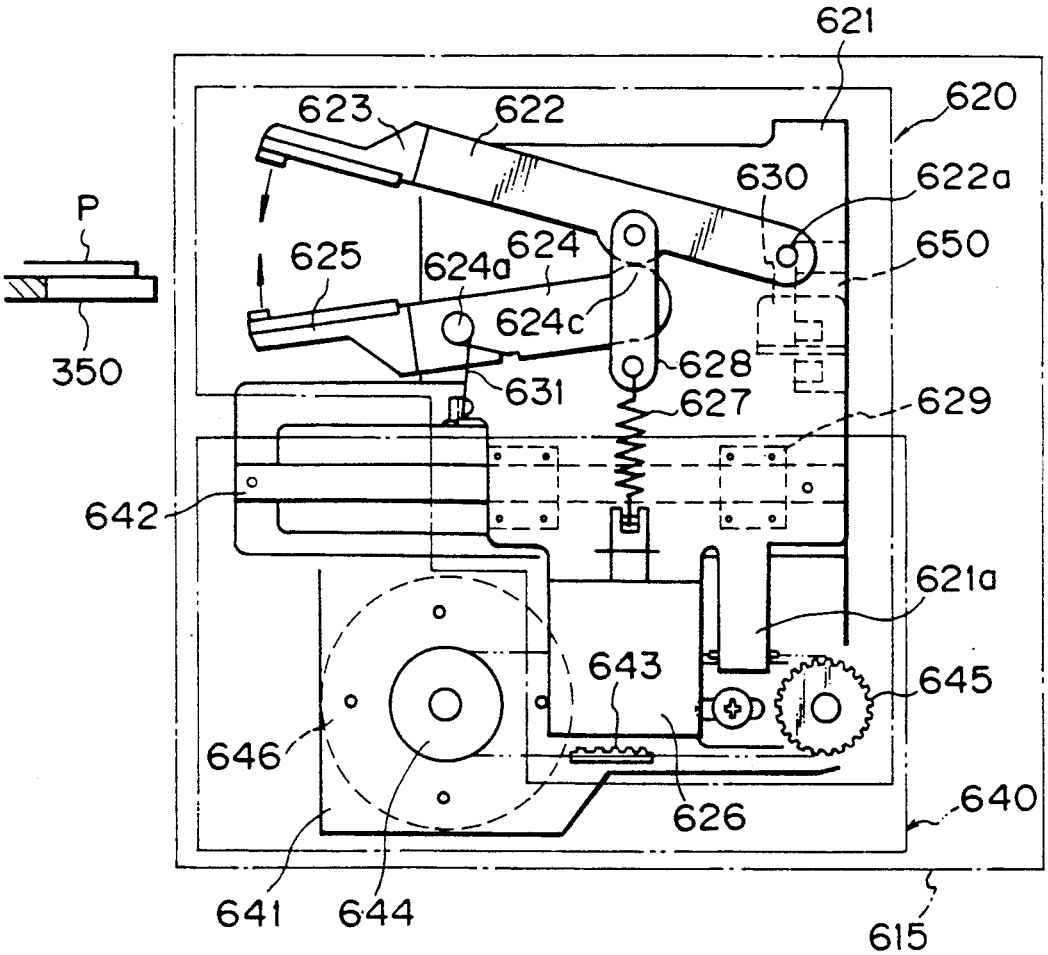
FIG. 53 is a front view of a paper pulling device.

In operation, on the start of a staple mode operation, the drive belt 717, FIG. 49, moves the stapler 701 and paper pulling device 615 up or down. Specifically, as shown in FIG. 53, the stapler 701 and paper pulling device 615 are moved toward one of the bins 350 which is loaded with a paper stack P to be stapled. The stapler 701 and paper pulling device 615 are brought to a stop in the vicinity of the bin 350 of interest on the basis of the output of the position sensor 727, FIG. 49. At this instant, the solenoid 626 is not energized so that the rotatable levers 622 and 624 and, therefore, the chucks 623 and 625 are held in their open position.

Thereafter, the stepping motor 646 is rotated by a predetermined amount to move the timing belt 643 and to thereby move the chuck section 620 toward the paper stack P. The moving speed of the chuck section 620 is controlled by varying the rotation speed of the stepping motor 646. In the illustrative embodiment, when the chuck section 620 having chucked the paper stack P returns to the stapling position, it is sequentially accelerated at the beginning of such a movement and then sequentially decelerated at the end of the same in order to prevent the accurately position paper stack P from being disturbed due to inertia. In this embodiment, the chuck section 620 is accelerated and decelerated on a nearly constant acceleration basis since the maximum inertia of a constant acceleration motion is smallest.

Figure 54:
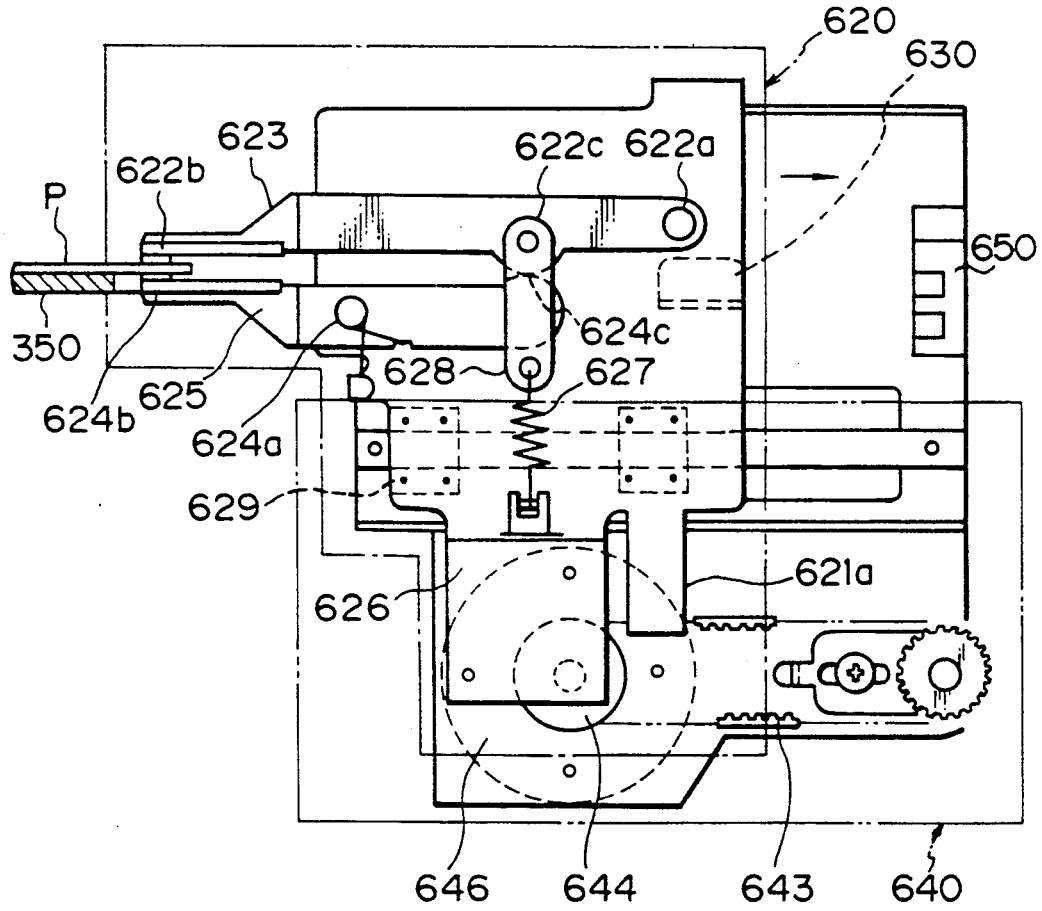
FIGS. 54, 55 and 56 are front views representative of the operation of the paper pulling device.
Figure 55:
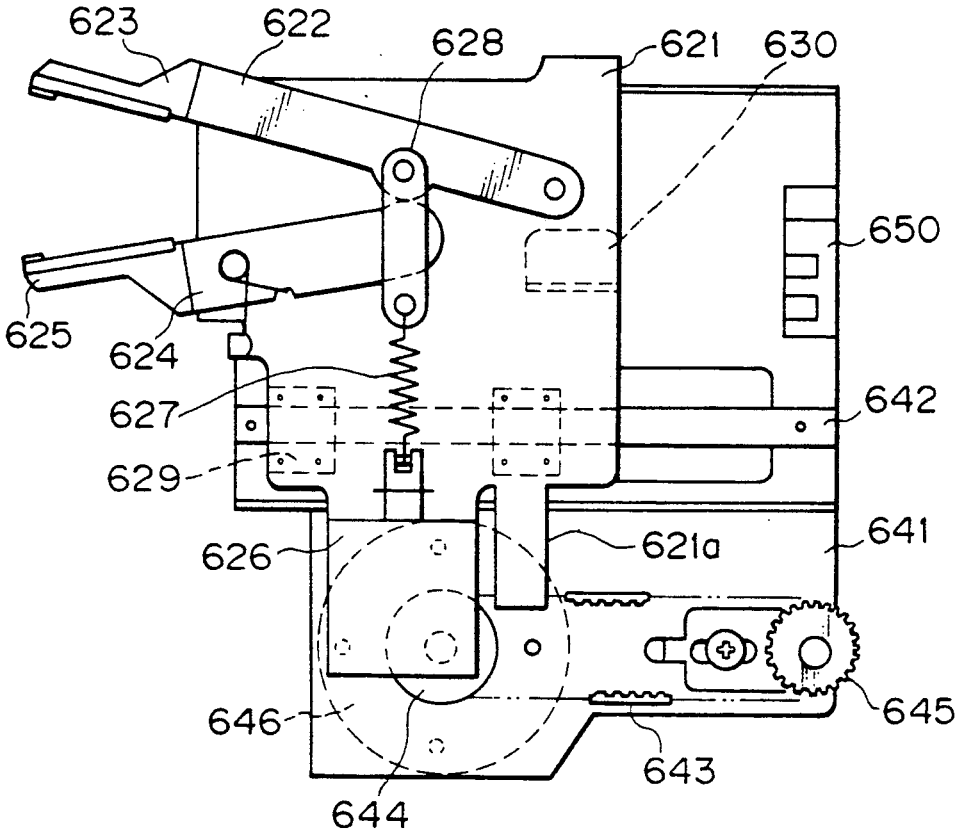

As soon as the chucks 623 and 625 reach a position where they can chuck the paper stack P (FIG. 55), they are stopped there and, at the same time, the solenoid 626 is energized. As a result, the chucks 623 and 625 are closed (FIG. 54) to chuck an edge portion of the paper stack P. More specifically, when the solenoid 626 is turned on, a spring 627 anchored to the solenoid 626 pulls a lever 628 to which the upper lever 622 is connected. As a result, the upper lever 622 is rotated counterclockwise about a fulcrum 622*a* to in turn lower the upper chuck 623. The lower lever 624 contacts the upper lever 622 at a potion 624*c* thereof, so that the movement of the upper lever 622 is transmitted to the lower lever 624. The lower lever 624 is, therefore, rotated clockwise about a shaft 624*a* to raise the lower chuck 625. Consequently, the upper and lower chucks 623 and 625 chuck the paper stack P. The displacement of each of the chucks 623 and 625 is determined by the distances between the fulcrum of rotation of the lever 628 and the points of force and action. In the illustrative embodiment, as shown in FIG. 54, the upper chuck 623 is assume to have a fulcrum 622*a* which is spaced apart by 92 millimeters from a point of action 622*b* and by 33 millimeters from a point of force 622*c*. Hence, the displacement of the chuck 623 is 92:33 which is nearly equal to 2.79:1 in terms of ratio. Regarding the lower chuck 625, the shaft 624*a* is assumed to be spaced apart by 26 millimeters from a point of action 624*b* and by 33 millimeters from a point of force 624*c*, so that the displacement is 26:33 which is nearly equal to 0.79:1 in terms of ratio. More specifically, when the upper chuck 623 moves downward by 3.5, the lower chuck 623 moves upward by 1. Further, the chucking force of the chucks 623 and 625 is determined by the force of the spring 627 anchored to the solenoid 626. As the number of paper sheets P to be chucked by the chucks 623 and 625 increases, the spring 627 becomes longer and, therefore, the chucking force becomes stronger. This frees the paper sheets P from dislocation ascribable to weak chucking force.

Figure 57:
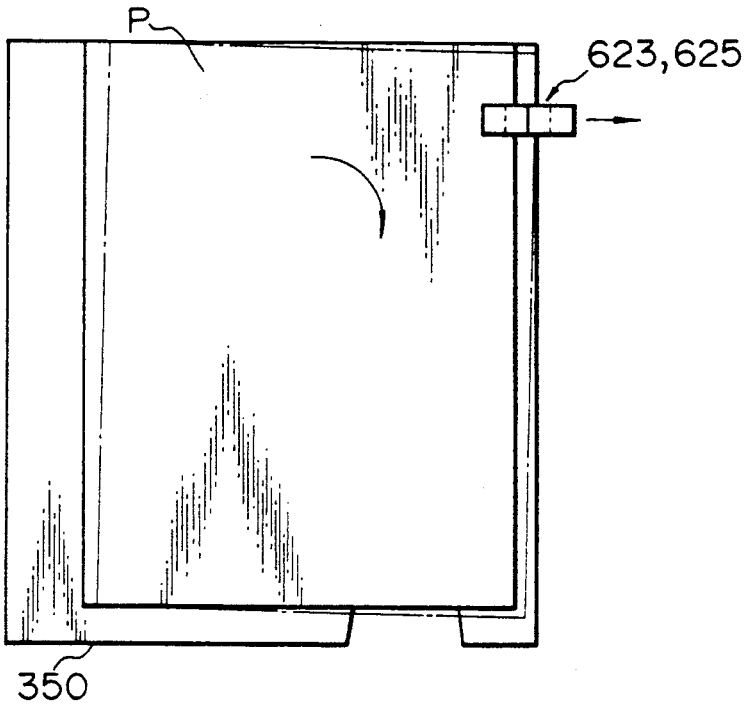
FIGS. 57 and 58 each shows a particular movement of a paper sheet on a bin.
Figure 58:
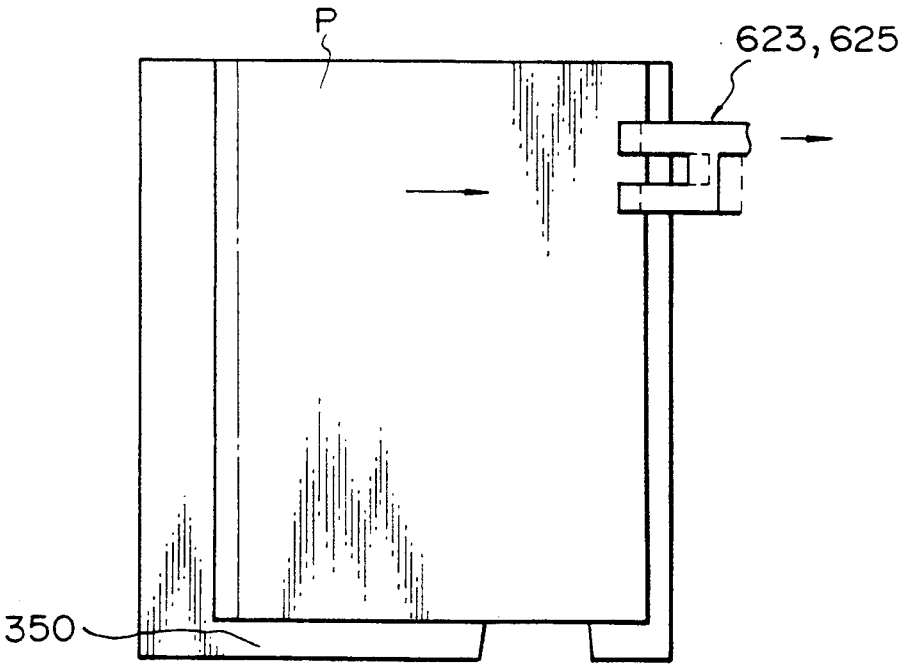

When the chucks 623 and 625 are constructed to grip one point of the paper stack P adjacent to a corner, a moment acts on the paper stack P due to inertia in the event when the paper stack P is pulled, as shown in FIG. 57. Then, the paper stack P will be shifted askew on the bin 350 and thereby stapled in an unexpected position. To eliminate this problem, as shown in FIG. 58, the chucks 623 and 625 may each be bifurcated or otherwise configured to grip the paper stack P at a plurality of points of the latter.

Figure 56:
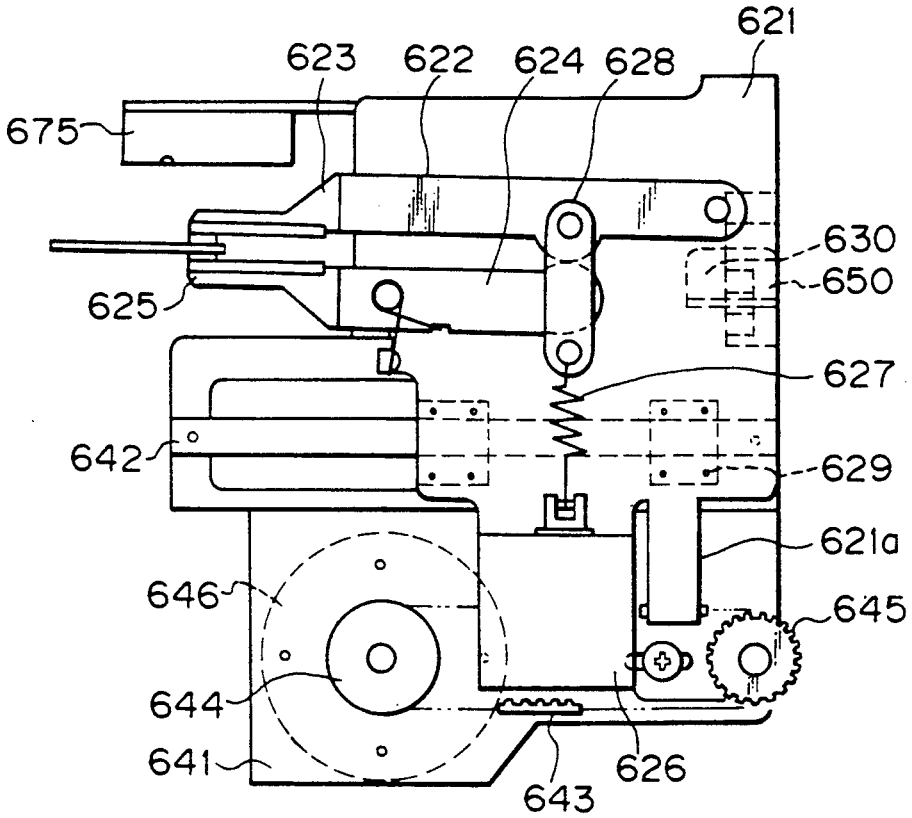

Subsequently, the stepping motor 646 is reversed to cause the chuck section 620 to return to the original position while carrying the paper stack P therewith, as shown in FIG. 56. As a result, the paper stack P is shifted in the substantially horizontal direction toward the stapler 701. As soon as an edge portion of the paper stack reaches a position where it can be stapled, the chuck section 620 is brought to a halt. Thereafter, the stapler 701 is actuated to drive a staple into the edge portion of the paper stack P.

On completion of the stapling operation, the stepping motor 646 is rotated in the forward direction to advance the chuck 620 away from the stapler 701. After the chuck section 620 has returned the paper stack P to the bin 350, the solenoid 626 is deenergized with the result that the upper and lower chucks 623 and 625 are opened. The stepping motor 646 is reversed again to move the chuck section 620 back to the predetermined position. Then, the stapler 701 and paper pulling device 615 are moved downward toward the next bin for repeating the above stapling operation there.

Figure 59:
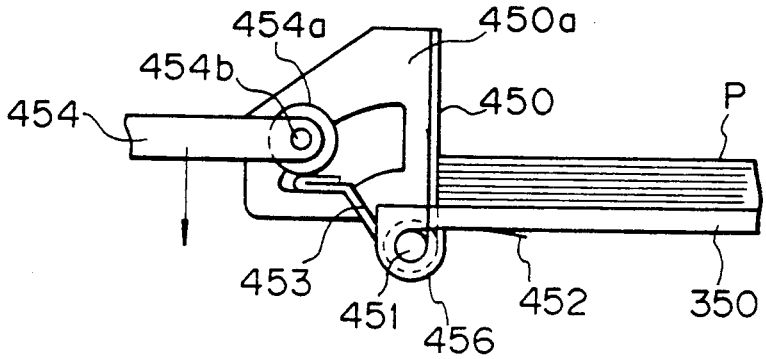
FIG. 59 is a front view of a paper positioning mechanism.
Figure 60:
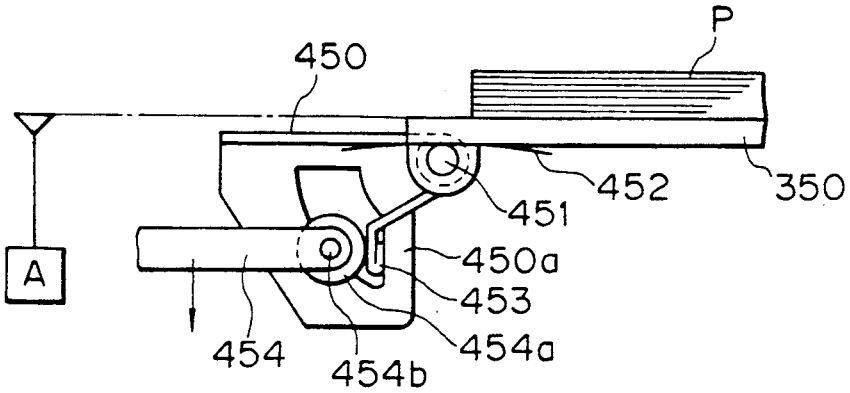
FIGS. 60 and 61 are front views showing the paper positioning mechanism in operation.
Figure 61:
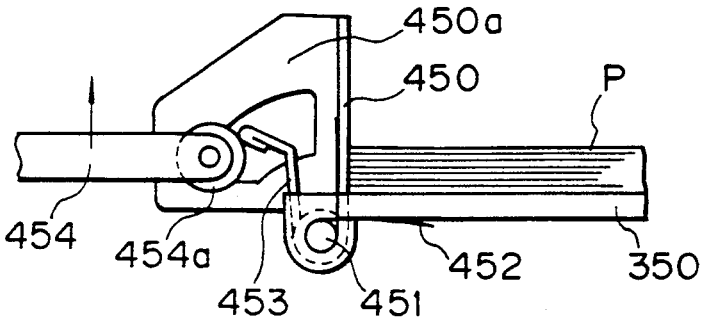

Referring to FIGS. 59 to 61, the paper positioning mechanism will be described more specifically. As shown in FIG. 59, the bin fence 450 extends upward from the edge of the bin 350 which is adjacent to the stapler 701. The bin fence 450 is rotatably mounted on a shaft 451 which extends along the underside of the bin 350. Hence, the bin fence 450 is tiltable to an open position, as shown in FIG. 60. The shaft 451 is journalled to the bin 350 by bearing portions 456 which extend downward from opposite edge portions of the bins 350. A helical spring 452 is wound round the shaft 451 and anchored at opposite ends thereof to the back o the bin fence 450 and the underside of the bin 350. In this configuration, the bin fence 450 is constantly biased by the spring 452 to the upright position thereof.

The bin fence 450 is openable in interlocked relation to the upward and downward movement of the stapler 701. A fence rotating plate 453 provided on the shaft 451 and a fence releasing plate 454 provided on the stapler 701 constitute members for so tilting the bin fence 450. The fence rotating plate 453 is partly received in a sectoral opening formed through one extension 450*a* of the bin fence. When the plate 453 is rotated downward, the lower edge of the sectoral opening of the bin fence 450 abuts against the plate 453 with the result that the bin fence 450 is tilted along with the plate 453. When the plate 453 is rotated upward, it does not contact the bin fence 450 and is free to rotate. A roller 454*a* mounted on the fence releasing plate 454 protrudes to remain in contact with the fence rotating plate 453. When the stapler 701 is elevated or lowered, the roller 454*a* rotates the plate 453 in contact therewith.

While a sorting operation is under way, the bin fence 450 is held in the upright position by the helical spring 452, as shown in FIG. 59. In this condition, the paper sheets P entering the bin 350 one after another are positioned with their edges abutting against the bin fence 450. When the sorting operation is completed, the stapler 701 begins to move downward with the result that the roller 454*a* provided on the stapler 701 contacts the fence rotating plate 453 of the bin 350 and urges the latter downward, as shown in FIG. 60. The plate 453 in turn causes the bin fence 450 to tilt against the action of the helical spring 452, whereby the bin fence 450 is opened. At this instant, the bin fence 450 and plate 453 have been lowered beyond the major surface or plane A of the bin 350. In this condition, the previously stated stapling operation is effected.

When the stapled sheet stack P is returned to the original position on the bin 350, the stapler 701 is lowered toward the next bin 350. As the fence releasing plate 454 is moved away from the fence rotating plate 453 due to the downward movement of the stapler 701, the bin fence 450 is raised to the original position by the spring 452. The movement of the bin 350 and the stapling operation described above occur in all of the bins 350 to which paper sheets P have been distributed.

After all the paper stacks P have been stapled, the stapler 701 is elevated to the uppermost position, i.e. a home position which is higher in level than the first or uppermost bin 350. At this time, although the fence releasing plate 454 contacts the fence rotating plate 453 from below, the plate 453 simply idles upward without rotating the bin fence 450, as shown in FIG. 61. As soon as the plate 454 moves away from the plate 453 due to the elevation of the stapler 701, the plate 453 is returned to the position shown in FIG. 59 due to gravity.

Figure 62:
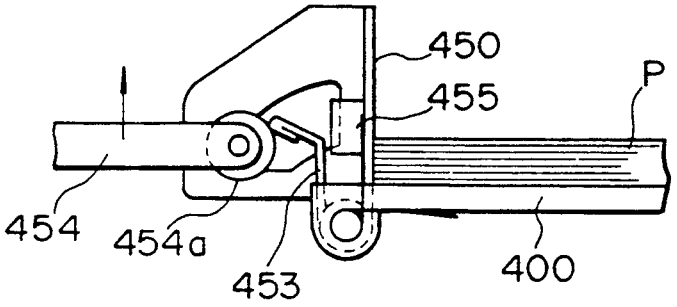
FIG. 62 is a front view showing another specific construction of the paper positioning mechanism.

FIG. 62 shows a modification of the paper positioning mechanism described above. As shown, an elastic member 455 is affixed to the bin fence 450 for the purpose of receiving the fence rotating plate 453. When the plate 453 is idly rotated upward by the returning stapler 701, it abuts against the elastic member 455. As a result, the plate 453 is returned to the original position by the elasticity of the member 455.

Figure 63:
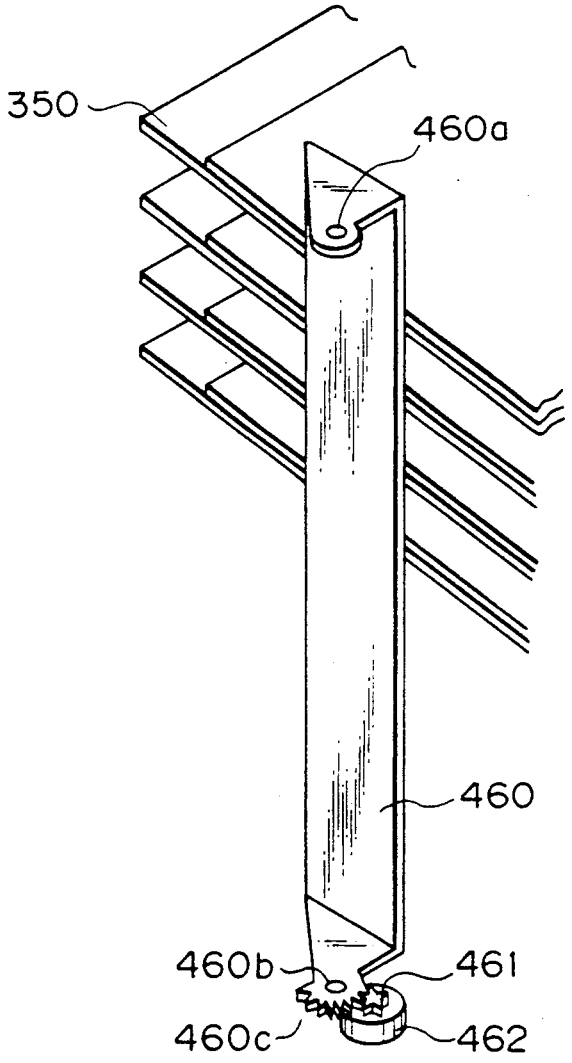
FIG. 63 is a perspective view showing another specific configuration of a bin fence.
Figure 64:
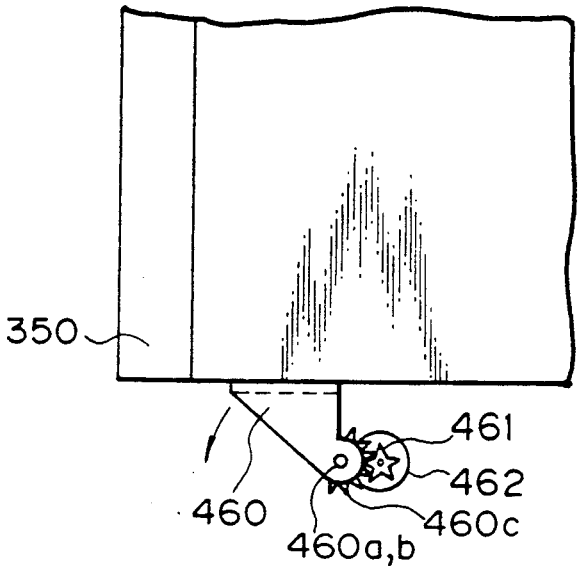
FIGS. 64 is a front view of the bin fence shown in FIG. 63.
Figure 66:
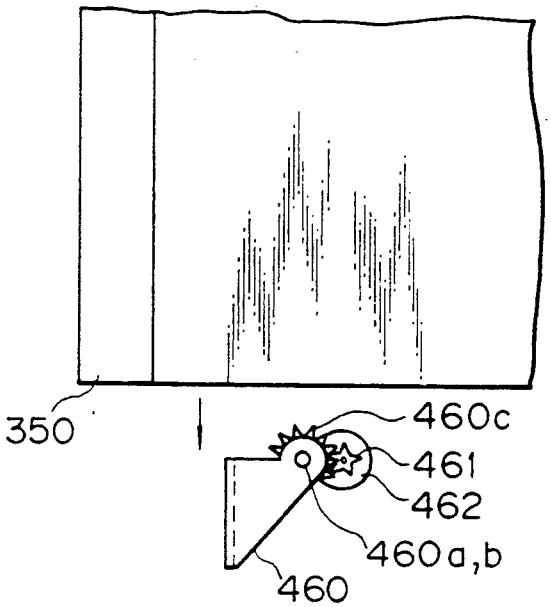
FIG. 66 is a plan view of the fin fence of FIG. 63.
Figure 65:
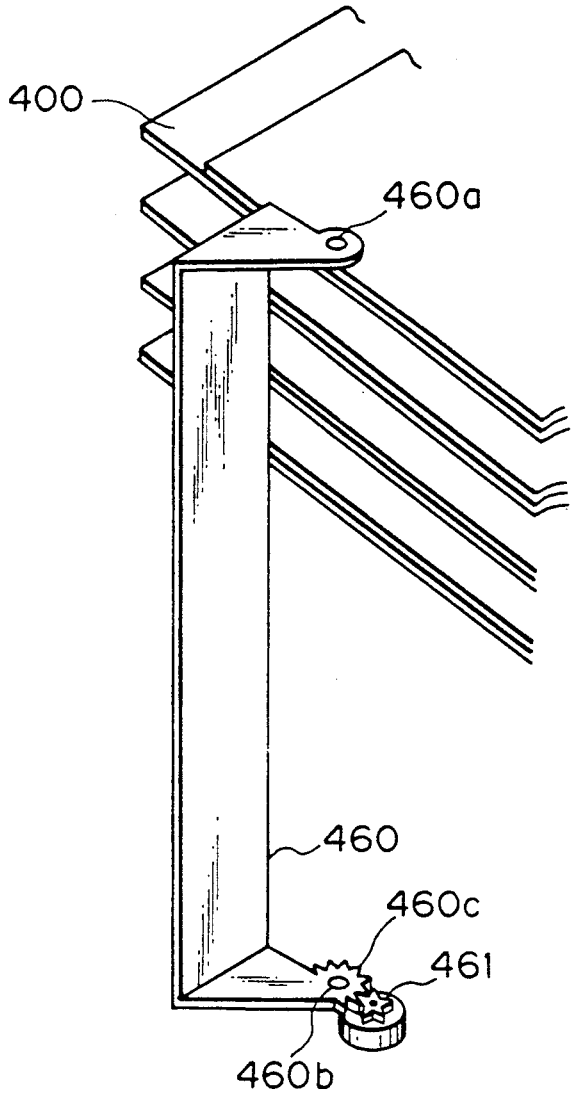
FIG. 65 is a perspective view showing the operation of the bin fence of FIG. 63 in operation.

Referring to FIGS. 63 to 66, another specific configuration of the bin fence 450 will be described. As shown in FIGS. 63 and 64, the bin fence 450 is implemented as a single fence 460 which abuts against all of the bins 350 for positioning paper sheets. Specifically, the fence 460 is rotatable about an upper and a lower fulcrums 460*a* and 460*b* and has a gear 460*c* at the lower fulcrum 460*b*. The gear 460*c* is in mesh with a gear 461 which is driven by a motor 462. To position paper sheets, the fence 460 is brought to the position shown in FIGS. 63 and 64 where it faces the bins 350. During a stapling operation which follows a sorting operation, the fence 450 is rotated by 90 degrees from the position of FIGS. 63 and 64 to the position of FIGS. 65 and 66. In such a position, a paper stack P can be shifted to the stapling position.

Figure 67A:
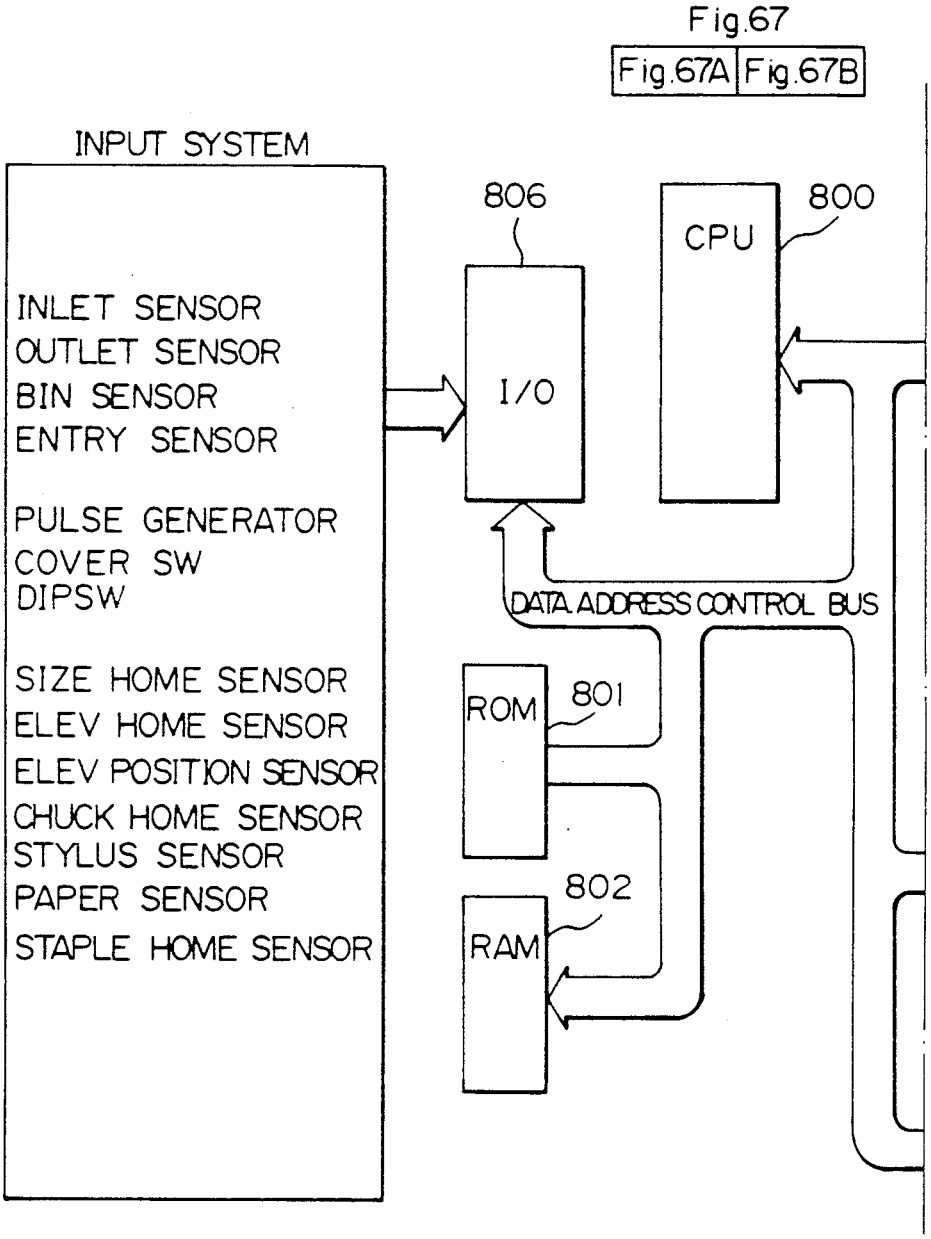
Figure 67B:
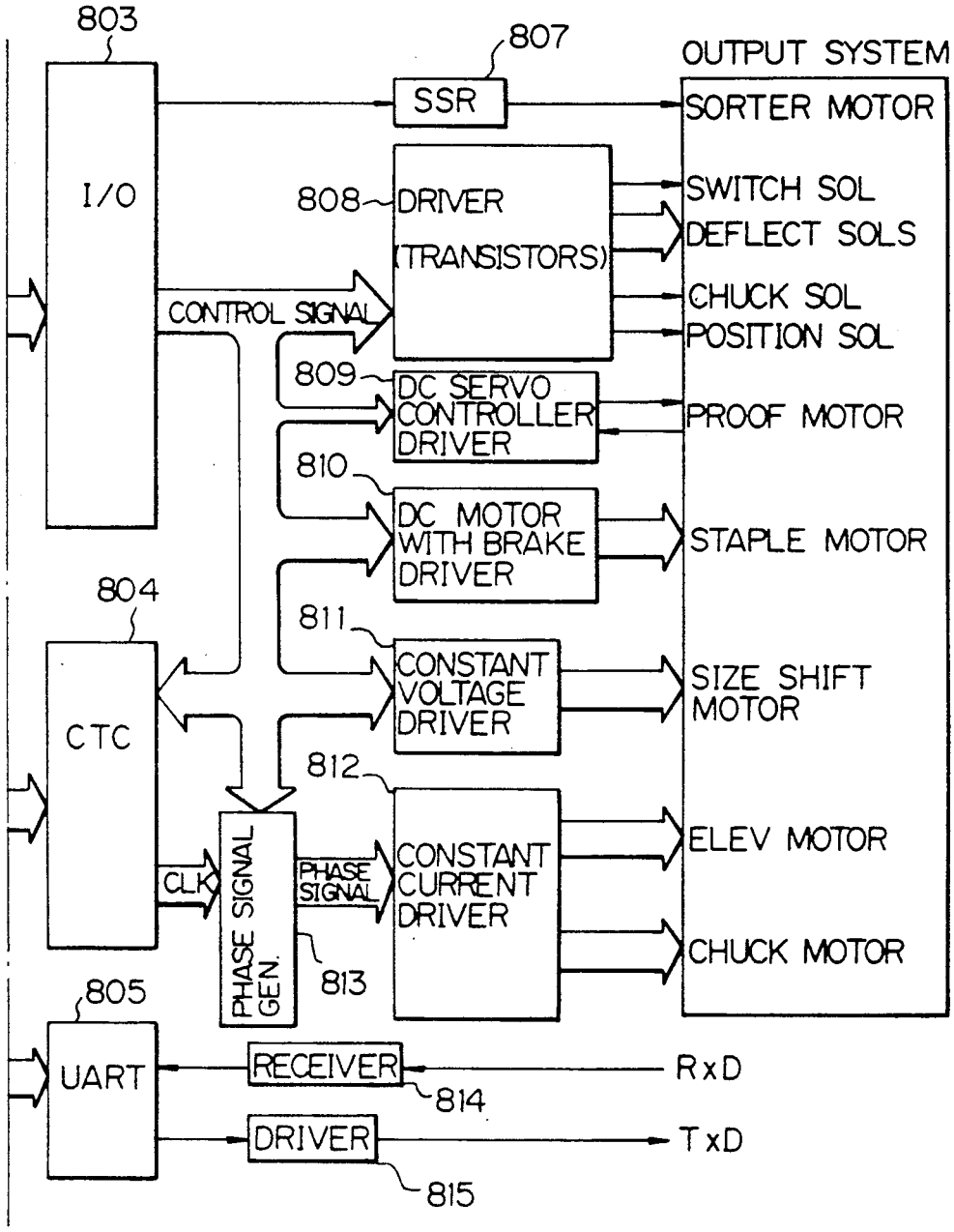

FIG. 67 shows a control system applicable to the illustrative embodiment. As shown, the control system is implemented as a microcomputer control system having a CPU 800, a ROM 801, a RAM 802, I/O ports 803 and 806, a clock timer controller (CTC) 804, and a universal asynchronous receiver transceiver (UART) 805. By using a program stored in the ROM 801 and RAM 802, the CPU 800 receives output signals of sensor switches (SW) via the I/O port 806 and controls various loads via various drivers 808, 809, 810, 811 and 812, a phase signal generator 813 and a SSR 807 in response to the outputs of the I/O port 803 and CTC 804. The control system is connected to the copier by an optical fiber, not shown, via the driver 815 and UART 805 so as to interchange various status and command signals.

Specifically, the sensors and switches (input system) include the inlet sensor 314, outlet sensor 115, bin sensors 321 and 323, discharge sensors 322 and 324, pulse generator 315, cover SW, DIPSW, size home sensor 501, elevation home sensor 729, elevation position sensor 727, chuck home sensor 650, stylus sensor, paper sensor 675, and staple home sensor. The loads (output system) include the sorter motor (AC motor) 313, switching SOL 107, deflecting SOLs, chuck SOLs 626, positioning SOLs 342, proof motor (DC motor) 117, staple motor (DC motor), size shift motor (stepping motor) 515, elevation motor (stepping motor), an chuck motor (stepping motor) 646.

Among the signals interchanged between the control system and the copier, signals sent from the copier and meant for the stapler unit 700 include a sorter start signal, copier paper discharge signal, staple end signal, system reset signal, service call reset signal (S.C reset), status request signal, mode signal, size signal, and bin designate signal. Signals sent from the stapler 700 to the copier include a type identification signal, paper-on-tray signal, stack over signal, bin over signal, cover open signal, no stylus signal, JAM signal, staple inhibit signal, paper discharge signal, WAIT signal, BUSY signal, end-of-mode signal, staple count signal, and error signal.

Figures 1, 68A:
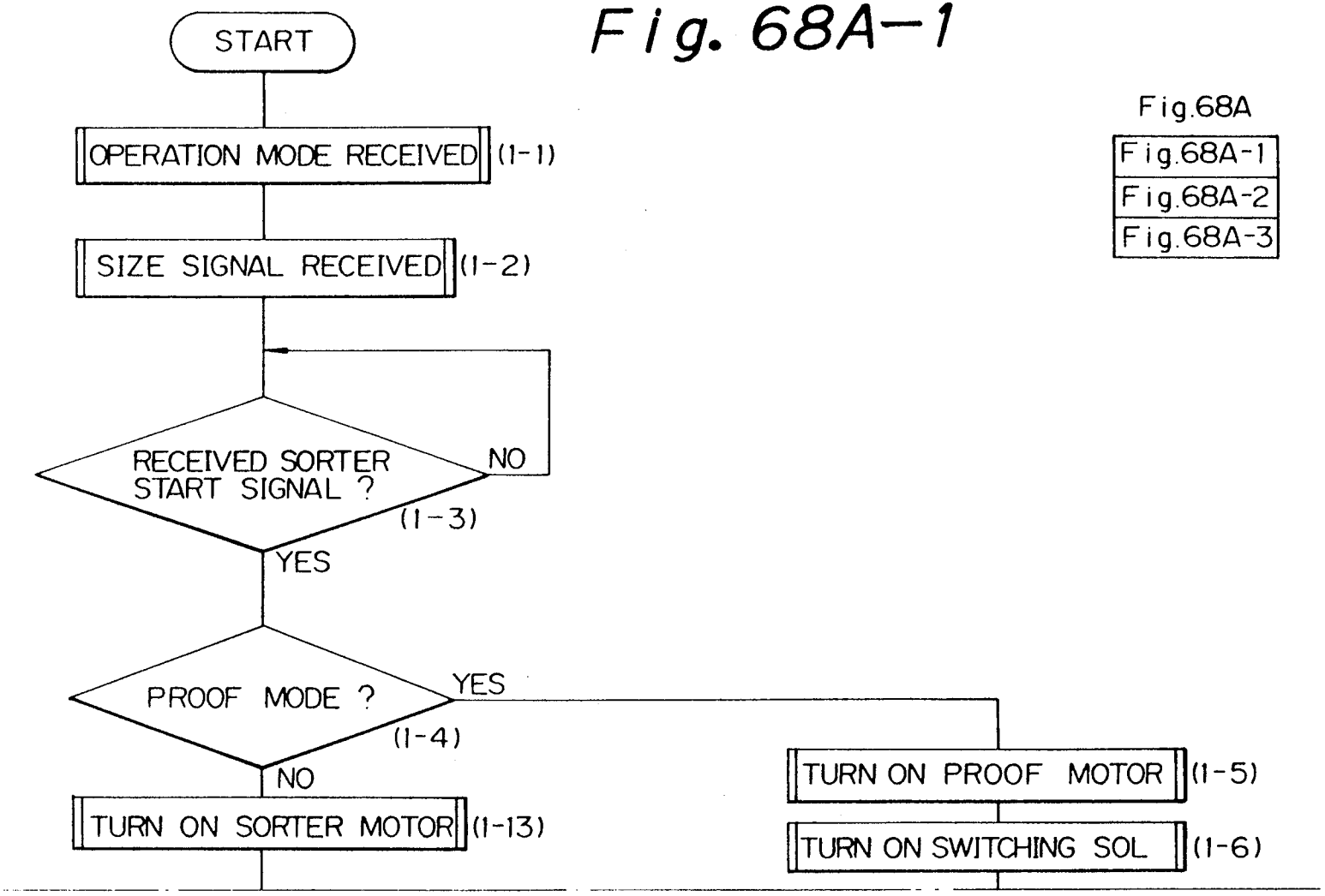
Figures 2, 68A:
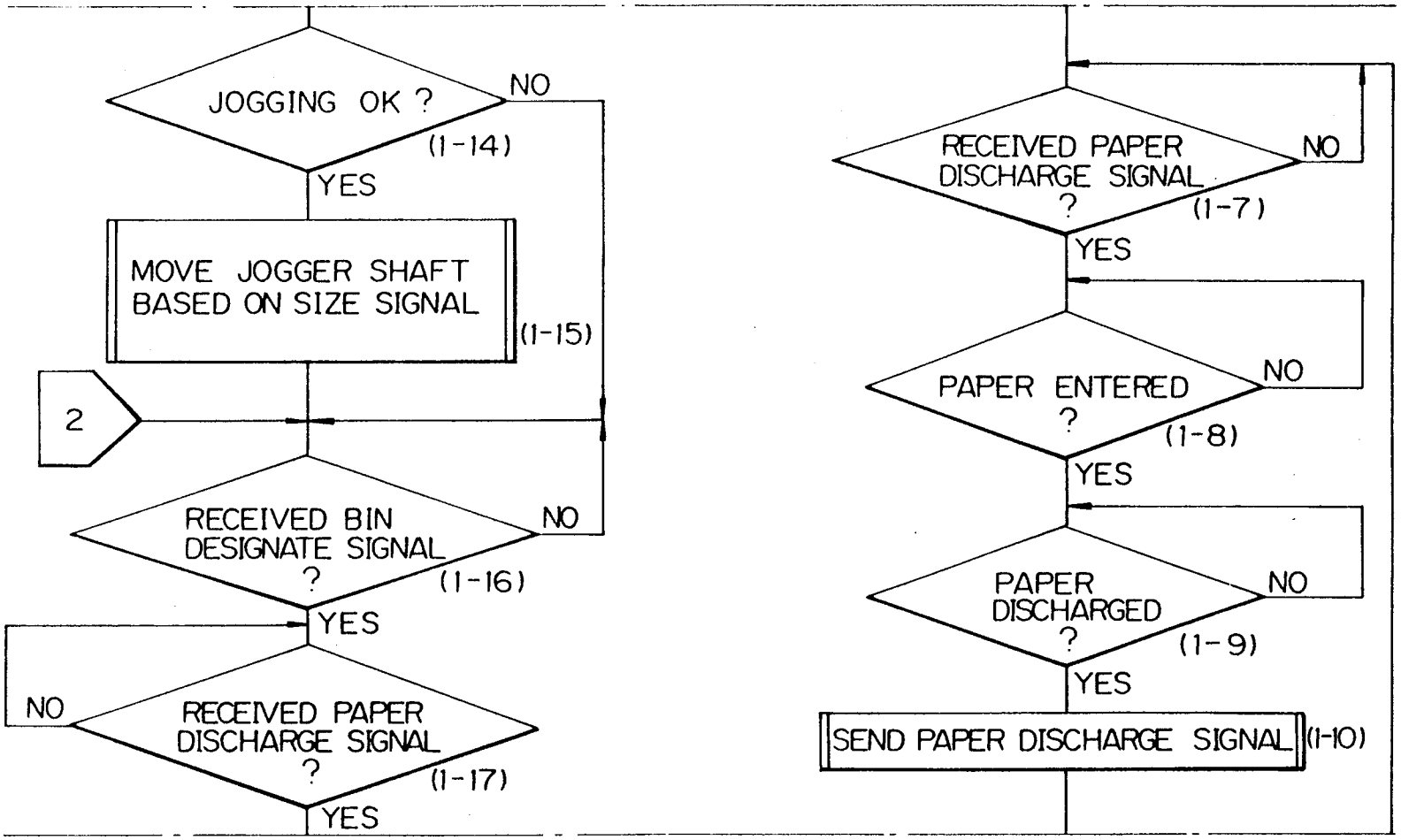
Figures 3, 68A:
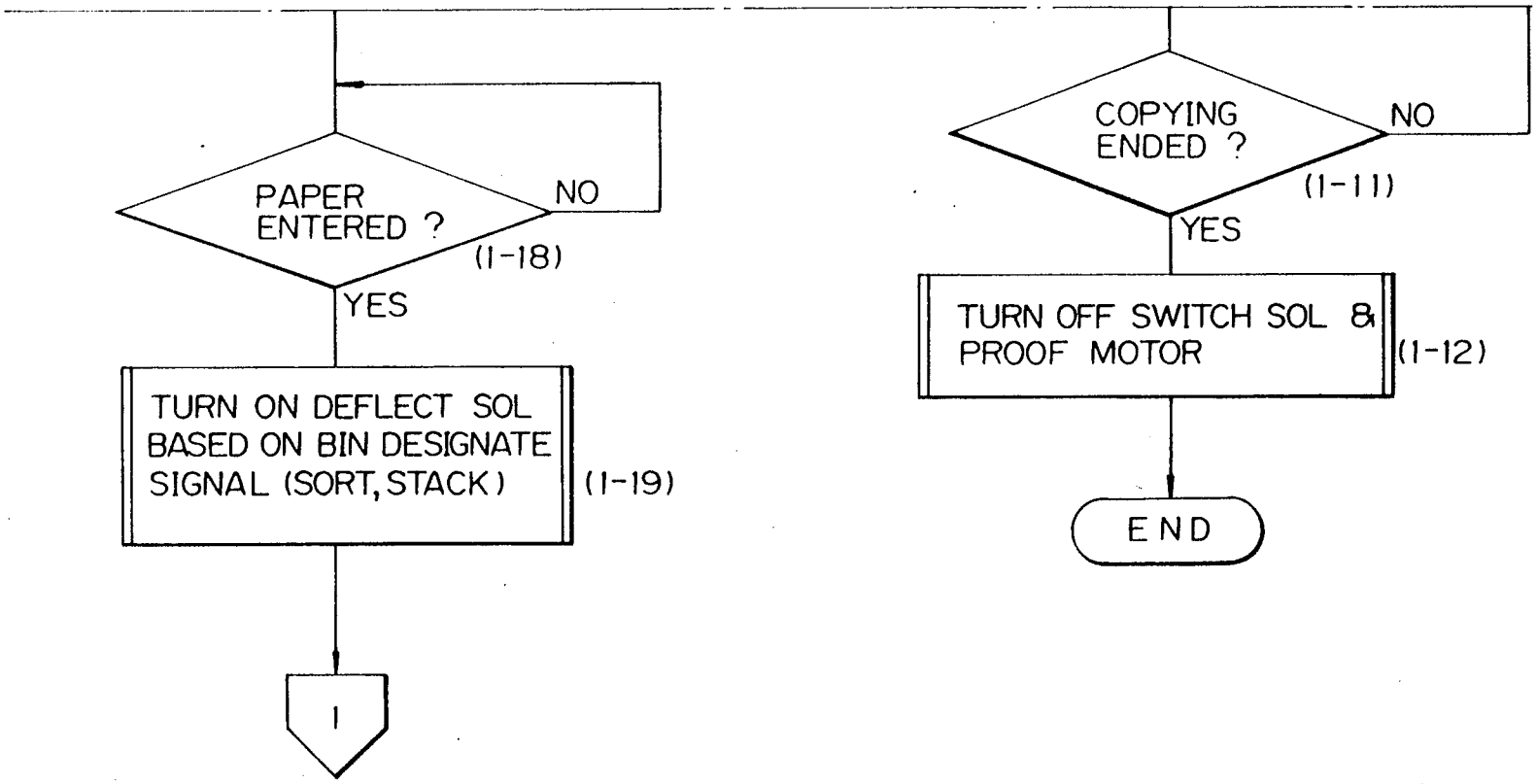
Figures 1, 68B:
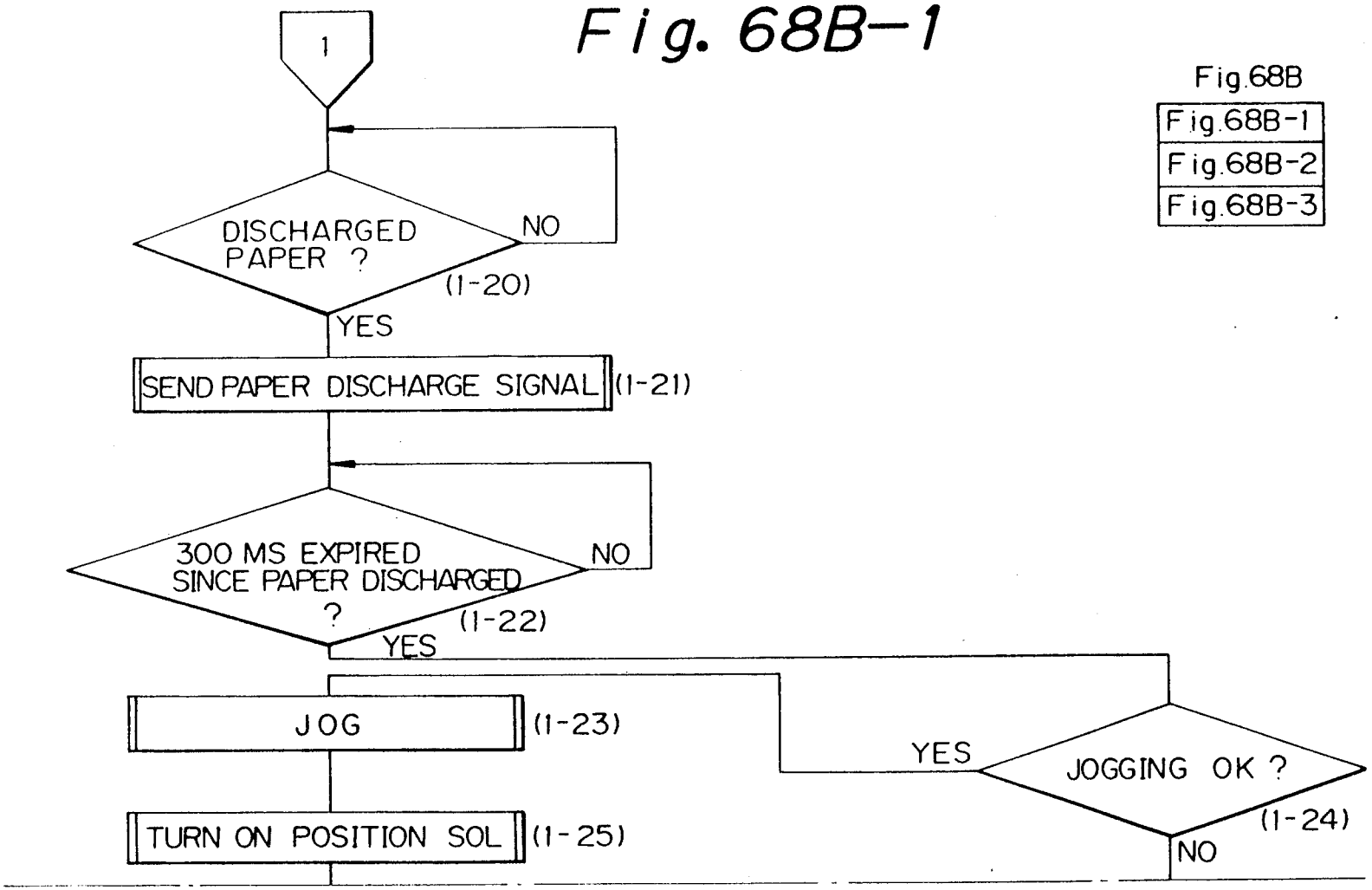
Figures 2, 68B:
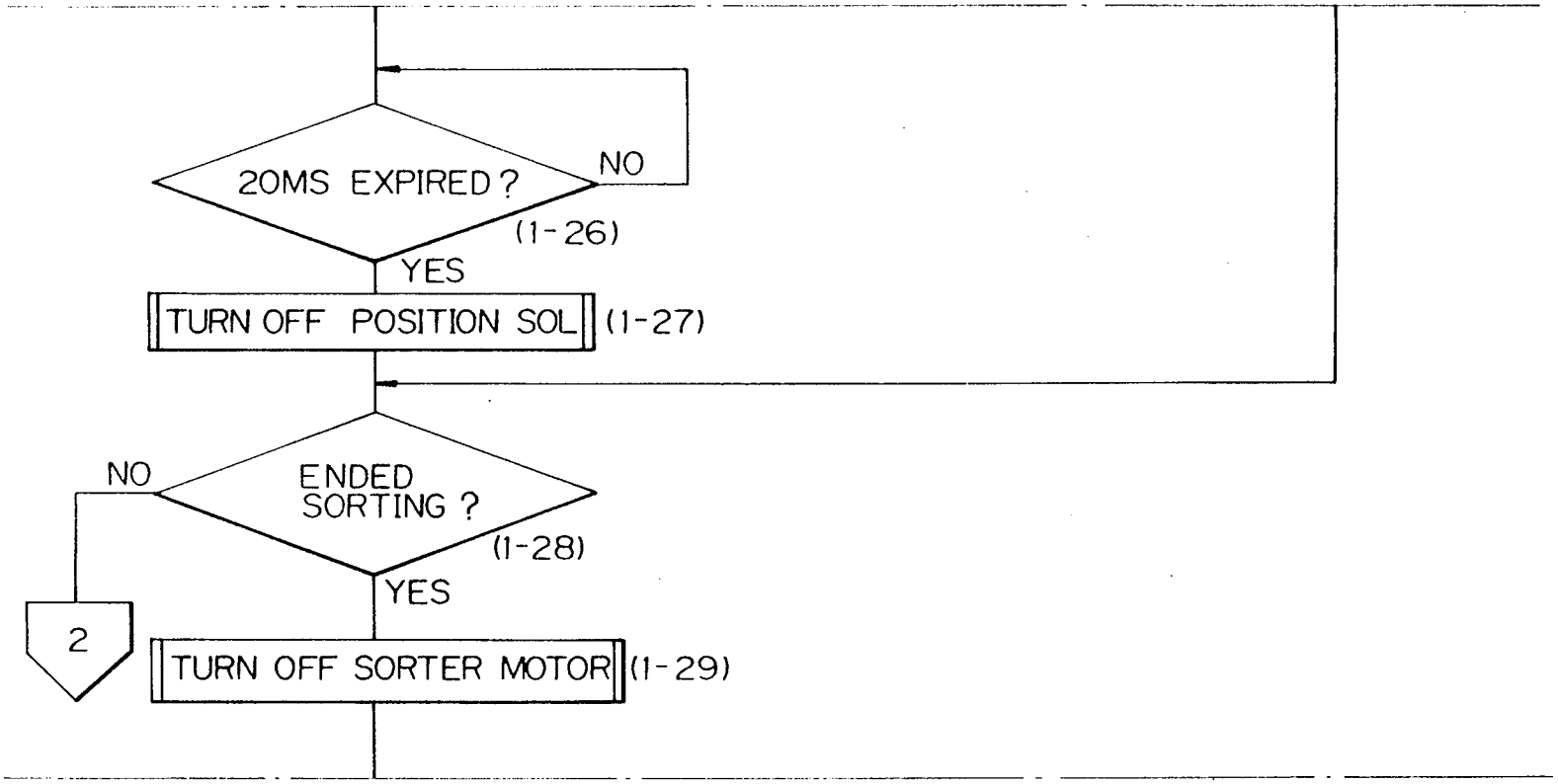
Figures 3, 68B:
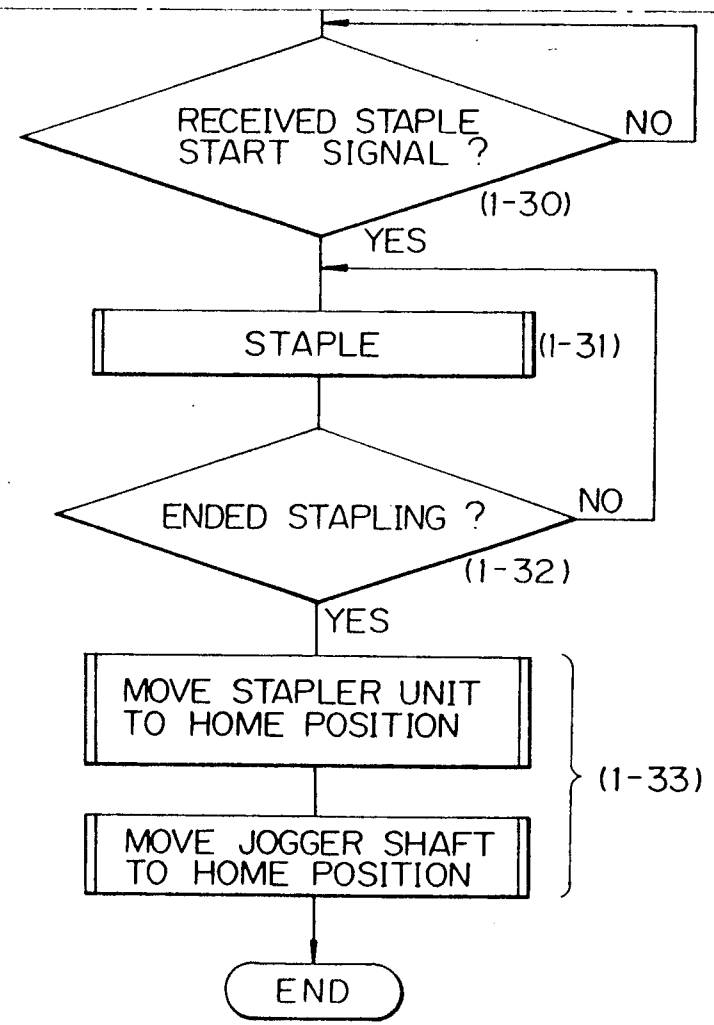

FIGS. 68A and 68B are flowcharts demonstrating the overall operation of the illustrative embodiment. As shown, the control system receives a mode signal from the copier (step S1-1). After the start of a copying operation, the system receives a size signal (S1-2) and then a sorter start signal (S1-3). In response, either the sort motor (for sorting or stacking) or the proof motor (for proof or interrupt) is turned on as indicated by the mode signal. The proof mode (S1-4) will be described first.

After the proof motor 117, FIG. 5, has been turned on (S1-5), the switching SOL 107, FIG. 7, is energized (S1-6). On receiving a paper discharge signal (S1-7), the control system steers a paper sheet come in through the inlet guide 102 (S1-8) toward the proof tray 116 (S1-9). After the discharge of the paper sheet onto the proof tray 116, a paper discharge signal is sent to the copier (S1-10) to inform the copier of the discharge of the received paper sheet. The steps described so far are repeated until the copying operation ends (S1-11). Of course, the control system is performing jam detection, although not shown. When the copying operation is completed, the switching SOL 107 and proof motor 117 are turned off (S1-12). Then, the system awaits the next copying operation.

The sort or stack mode operation is as follows. After the sorter motor 313, FIG. 5, has been turned on (S1-13), whether or not jogging is allowable is determined on the basis of the size signal, for example. If the answer of the decision is positive (YES) (S1-14), the jogger shaft 502 is shifted to a position matching the size signal (S1-15). When the copier drives a paper sheet thereoutof, it sends a bin designate signal and a discharge signal to the control system (S1-16). A bin 350 of interest is decided on the reception of the discharge signal (S1-17). Then, a paper sheet from the copier enters the sorter (S1-18). On the turn-on of the inlet sensor 314, a deflecting solenoid (SOL) designated by the bin designate signal is turned on (S1-19), whereby the paper sheet is steered to the bin 350 of interest.

When the paper sheet is driven out onto the designated bin 350 (S1-20), a paper discharge signal is sent to the copier (S1-21) to report that the paper sheet has been surely discharged onto the bin 350. In response, the copier determines the next destination, the destination after jam recovery, etc. When a suitable period of time necessary for the paper sheet to be settled on the bin 350 (e.g. 300 milliseconds; step 1-22), the size shift motor 515, FIG. 17, is turned on to shift the jogger shaft 502 (S1-23) so as to position the paper sheet in the direction (lateral) perpendicular to the paper discharge direction. It is to be noted that the shaft 502 is shifted at a particular timing which is based on the discharge of the trailing edge of a copy sheet as sensed by the sensors 322 and 324 (S1-24).

It sometimes occurs that after the positioning operation a paper sheet fails to reach the end of the bin 350 or to the bin fence 450 due to curl, scratch or fold on the paper surface and/or substantial static electricity. In the light of this, the positioning solenoid 342 is turned on (S1-25) simultaneously with the shift of the jogger shaft 502. As a result, the positioning roller 333 in rotation is brought into contact with the upper surface of the paper sheet to press the curl and urge it to the end portion (predetermined period of time=200 milliseconds; S1-

26). The positioning roller 333 is associated with all of the bins 350, and all the positioning rollers 333 are lowered at the same time by the positioning SOL 342. Thereafter, the positioning SOL 342 is deenergized (S1-27).

The above sequence is executed every time a paper sheet is discharged so as to position it (sorting or stacking) (S1-28). As the sorting or stacking operation ends, the sorter motor 313 is turned off (S1-29) and stapling is effected. In response to a staple start signal (S1-30), the stapler unit 700 is actuated (S1-31) to staple a stack of paper sheets. On completion of the stapling operation (S1-32), the stapler device 700 and jogger shaft 502 are returned to their home positions (S1-33).

Figure 69:
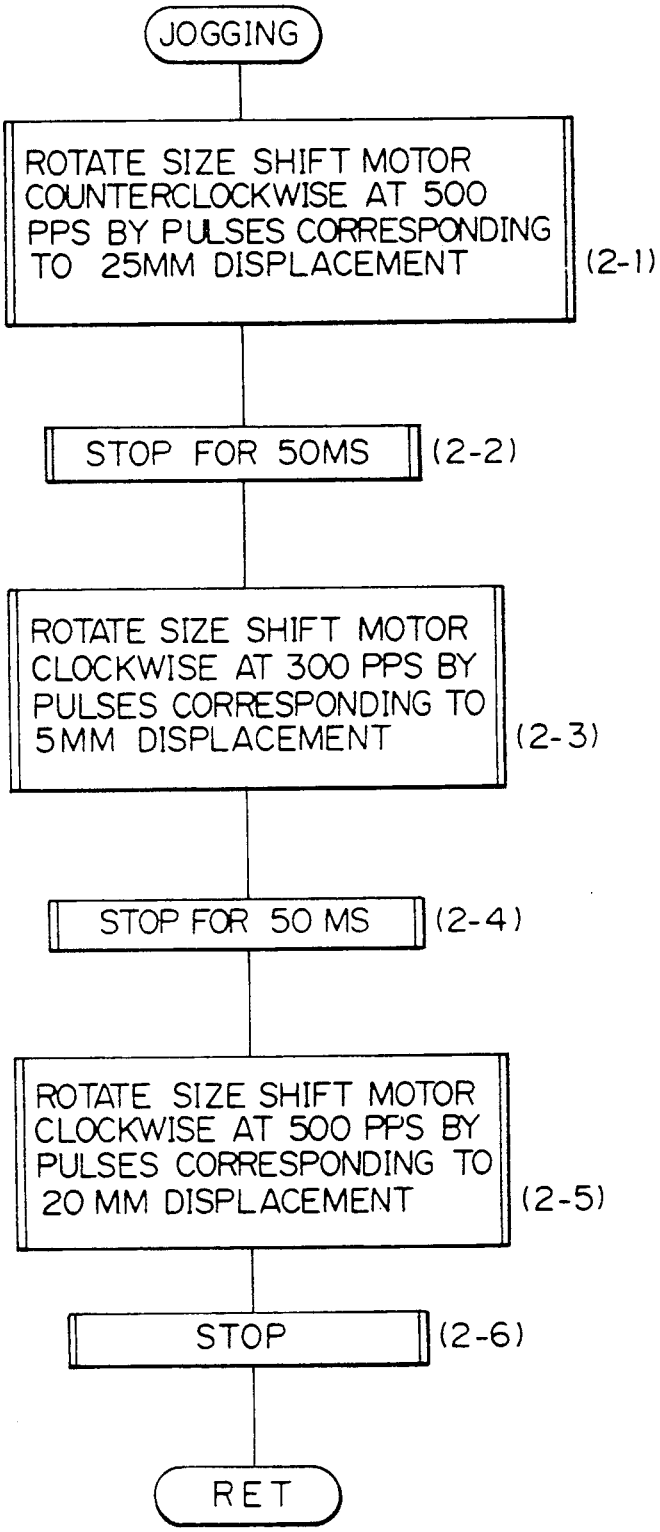
FIG. 69 is a flowchart representative of a paper positioning sequence.
Figure 70:
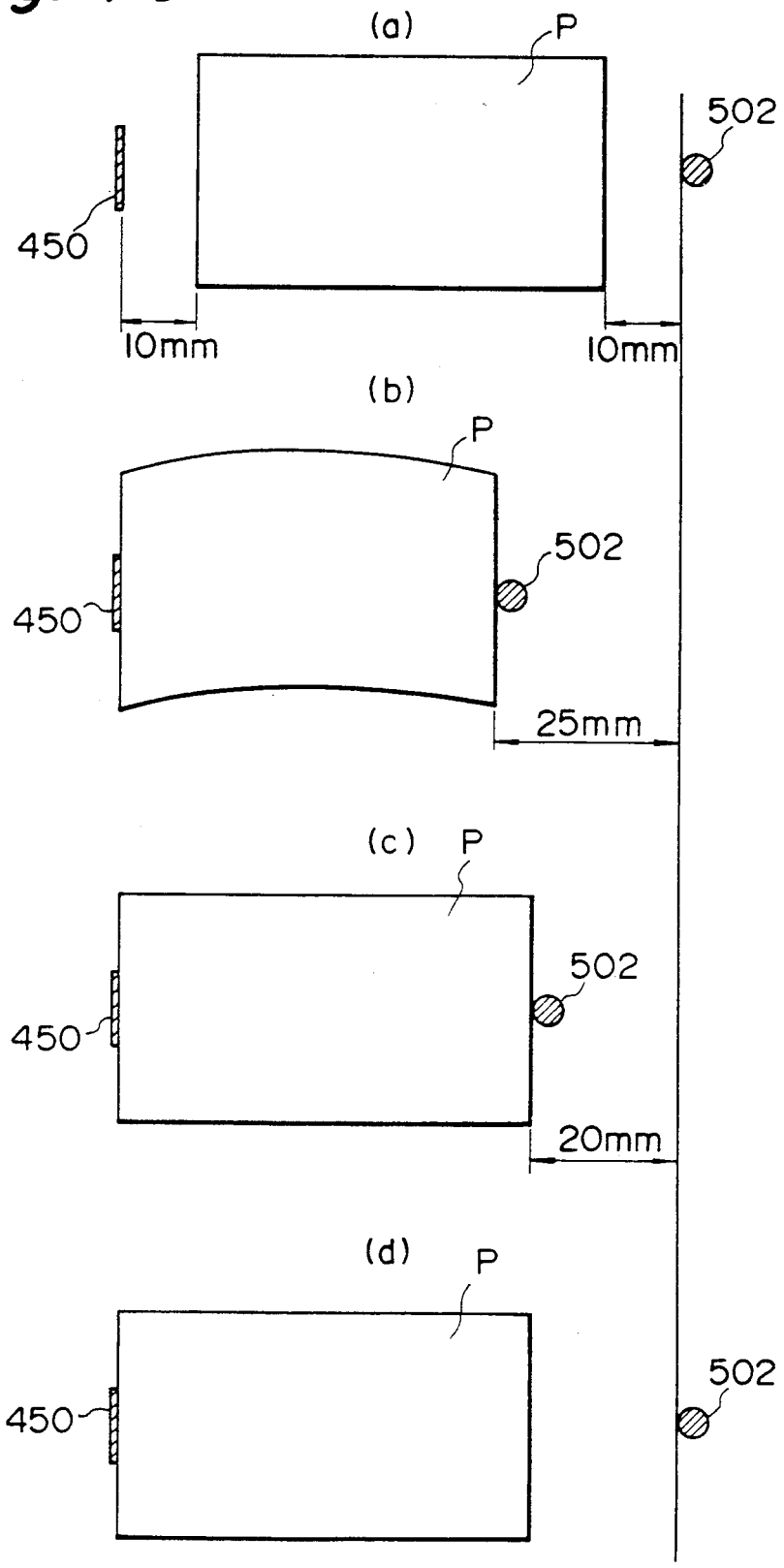
FIG. 70 shows the movement of the jogger shaft.

The paper positioning operation and the movement of the jogger shaft 502 will be described with reference to FIGS. 69 and 70. The jogger shaft 502 is held in a halt beforehand in a particular position matching the size signal (in the embodiment, a position about 10 millimeters spaced apart from the edge of a paper sheet which will be discharged), as stated earlier. Any suitable position may be selected so long as it prevents the shaft 502 from catching a paper sheet P and thereby causing it to jam or fold itself (FIG. 70(*a*)). On the lapse of about 300 milliseconds after the discharge of a paper sheet onto the bin 350, the jogging operation occurs.

First, a phase signal in the form of pulses the number of which is associated with a displacement of 25 millimeters is fed from the I/O port 803 to the constant voltage driver 811. As a result, the size shift motor (stepping motor) 515 is rotated counterclockwise to move the jogger shaft 502 by about 25 millimeters toward the paper sheet (S2-1; FIG. 70(*b*)). The moving speed of the shaft 502 may be, but not limited to, about 500 pps. The gist is that the moving speed does not crease, scratch or fold the paper sheet P. Consequently, the paper sheet on the bin 350 is shifted by an extra amount of about 5 millimeters and thereby urged against the bin fence 450. If desired, an extra amount of feed other than 5 millimeters may be selected if it is capable of coping with irregular lengths of paper sheets P and implementing sure positioning.

After urging the paper sheet P against the bin fence 450, the shaft 502 is once brought to a halt (in the embodiment 50 milliseconds); S2-2). This step is not essential, however, since it is simply to switch the rotating direction of the size shift motor 515. Thereafter, the motor 515 is rotated clockwise by the number of pulses associated with a displacement of 5 millimeters, so that the shaft 502 may move 5 millimeters away from the paper sheet (S2-3); FIG. 70(*c*)). At this time, the moving speed of the shaft 502 is selected to be about 300 pps. Nevertheless, any other speed may be selected so long as it is lower than the speed at which the paper sheet P springs back after the extra amount of feed, i.e., the position of the paper sheet P is not disturbed due to elasticity. Stopped after the 5 millimeters return, the shaft 502 serves as a bin fence at the opposite side to the bin fence 450. This, coupled with the fact that the shaft 502 remains in a halt for 50 milliseconds (S2-4), insures the position of the paper sheet P. Subsequently, the shaft 502 is returned to the initial position to prepare for the next paper sheet (S2-5; FIG. 70(*d*)) and stopped there (S2-6). At this time, the moving speed of the shaft 502 need only be the speed at which the shaft 502 will be in time for the discharge of the next paper sheet. In the case that complete positioning is not attainable (paper sheets with substantial curl), the entire or a part of the jogging operation may be effected a plurality of times with a single paper sheet.

Figure 71:
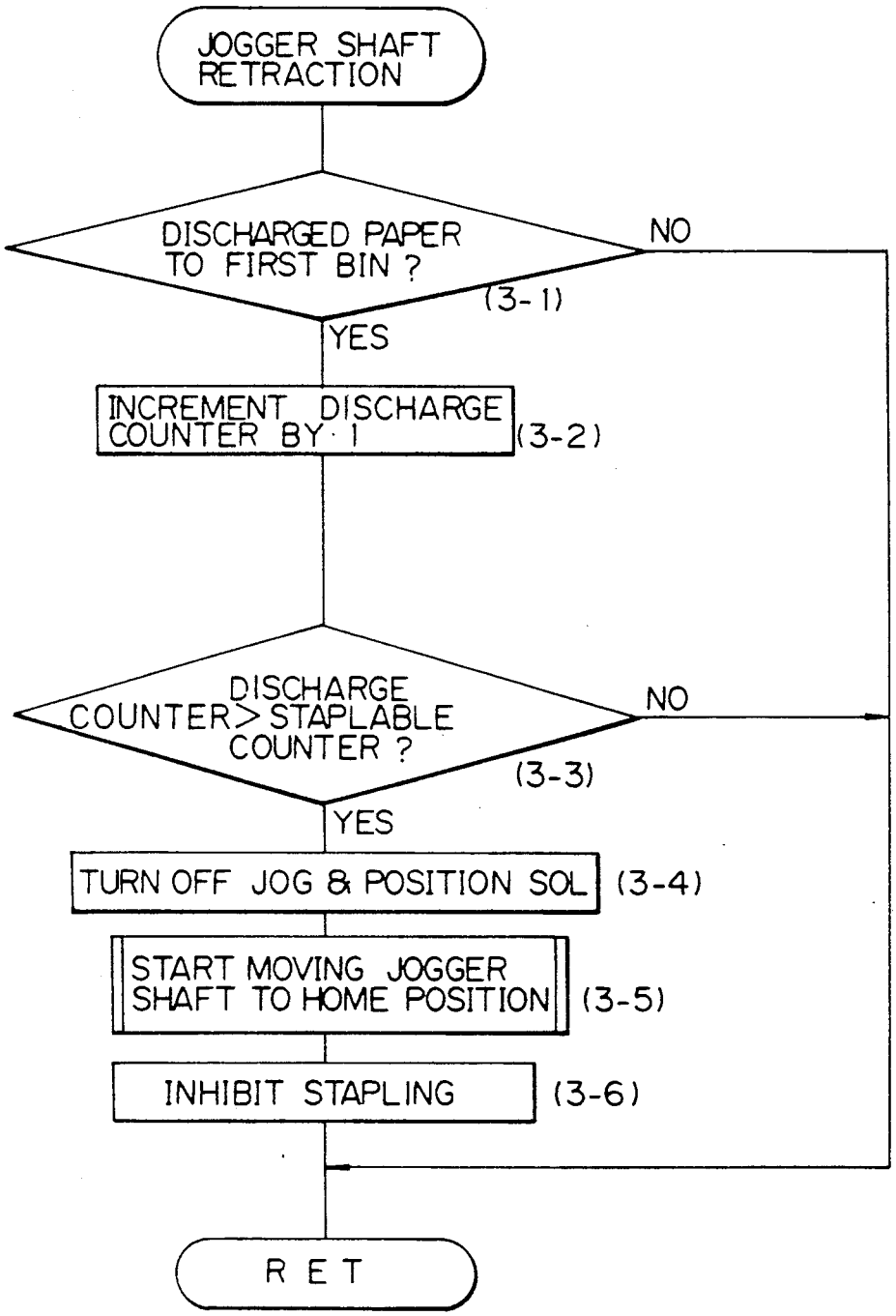
FIG. 71 is a flowchart showing a jogger shaft retracting procedure.

Assume that more than a predetermined number of paper sheets which can be stacked on the bin 350 (in the embodiment, thirty paper sheets) are driven out onto the bin 350. Then, stapling the discharged paper sheets is inhibited, and the shaft 502 is retracted to the home position without performing the jogging movement, as will be described with reference to FIG. 71.

The number of paper sheets stacked on the bin 350 is detected by counting paper sheets (S3-2) which are sequentially discharged onto the first bin (S3-1). When it is decided that the number of paper sheets on the first bin has exceeded the number which can be stapled (S3-3), the shaft's jogging operation and the roller's positioning operation are interrupted (S3-4). Then, the shaft 502 is retracted to the home position (S3-5). Afterwards, the positioning operation is not performed with paper sheets which may be discharged. Stapling the paper sheets already stacked on the bin 350 is also inhibited (S3-6).

The stapling operation will be described with reference to FIGS. 72A to 72I. When paper sheets exist on the bins 350 after the sorting operation, the copier sends a staple start signal to the sorter. On receiving the staple start signal, the control system resets a sequence counter to 0 (S4-1). The stapler device 700 located at the home position is moved to the first bin 350 whose paper stack is to be stapled (S4-2). After the stapler unit 700 has reached the first bin 350, the program is executed on the basis of the value of a staple sequence counter shown in FIG. 72A. On the arrival of the stapler device 700 at the first bin, the staple sequence counter is set from 0 to 1 (S4-3).

When the value of the staple sequence counter is 1 (S4-4), the chuck motor (stepping motor) 646 is turned on (S4-5, FIG. 72B) to thereby move the chuck section 620, FIG. 53, forward. In this instance, the displacement is determined by the number of pulses (S4-6). By this displacement, chuck 620 is moved from the home position to the position where it can chuck the paper stack. When the chuck section 620 is fully advanced (S4-7), the staple sequence counter is set to 2 (S4-8).

When the staple sequence counter is 2, the chuck SOL 626 is turned on (S4-9, FIG. 72C) to chuck the paper sheet. Then, the staple sequence counter is set to 3 (S4-10).

When the staple sequence counter is 3, a timer is started (S4-11, FIG. 72D) to hold the state for 0.2 second. On the lapse of 0.2 second (S4-12), the timer is stopped (S4-13) and the staple sequence counter is set to 4 (S4-14). This is successful in absorbing the response time of the chuck SOL 626 and insuring the chuck.

When the staple sequence counter is 4, the chuck motor 646 is turned on (S4-15, FIG. 72E) to return the chuck 620 toward the home position. Then, the chuck home sensor 650 responsive to the arrival of the chuck section 620 to the home position is turned on (S4-16), the chuck section 620 is brought to a stop at the home position, and the chuck motor 646 is turned off (S4-117). Subsequently, the staple sequence counter is set to 5 (S4-18). At this instant, the chuck motor 646 is driven in a nearly constant acceleration motion. In the illustrative embodiment, the speed is increased from from 600 pps to 2000 pps in a slow-up mode.

Figures 1, 2, 72A:
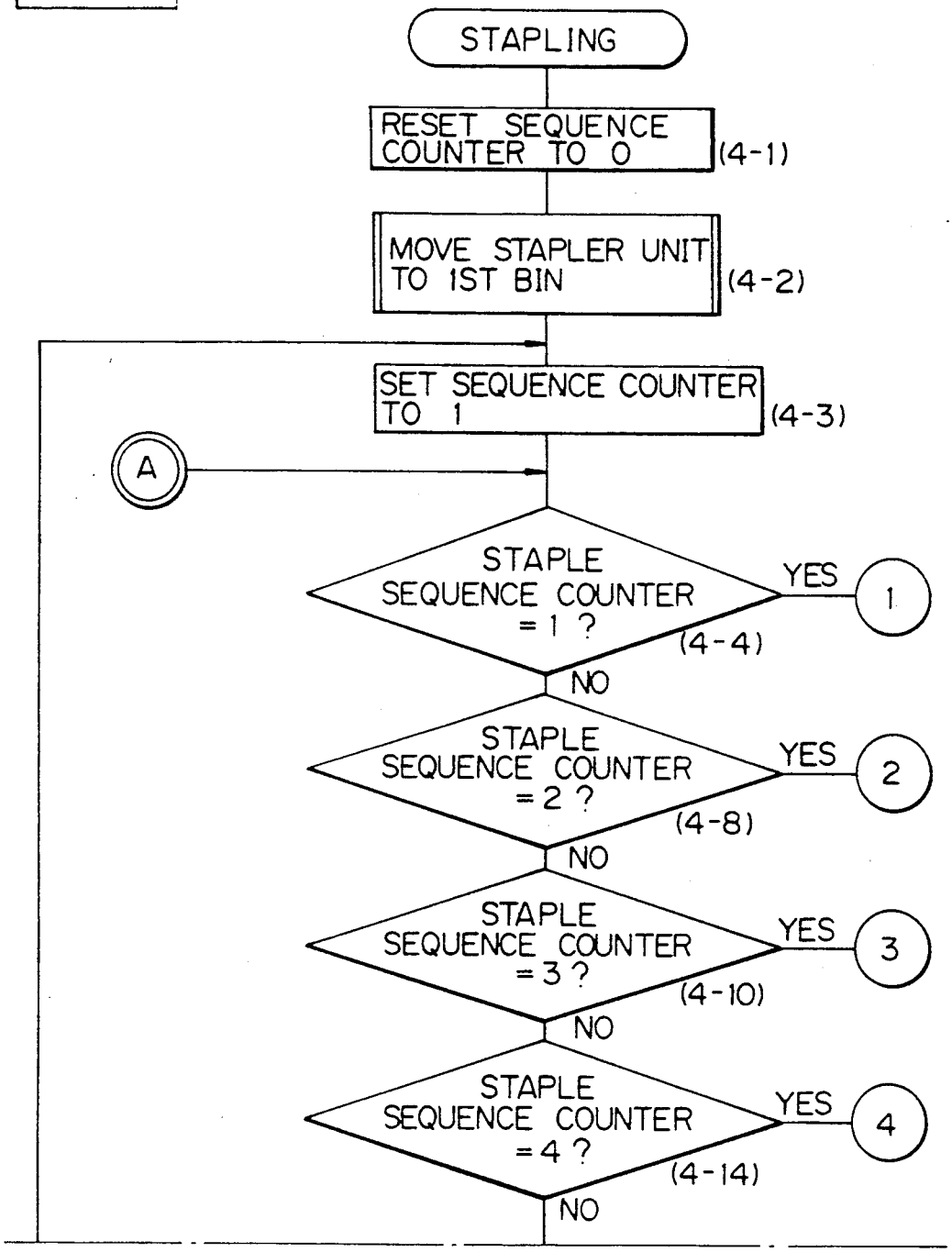
Figures 2, 72A:
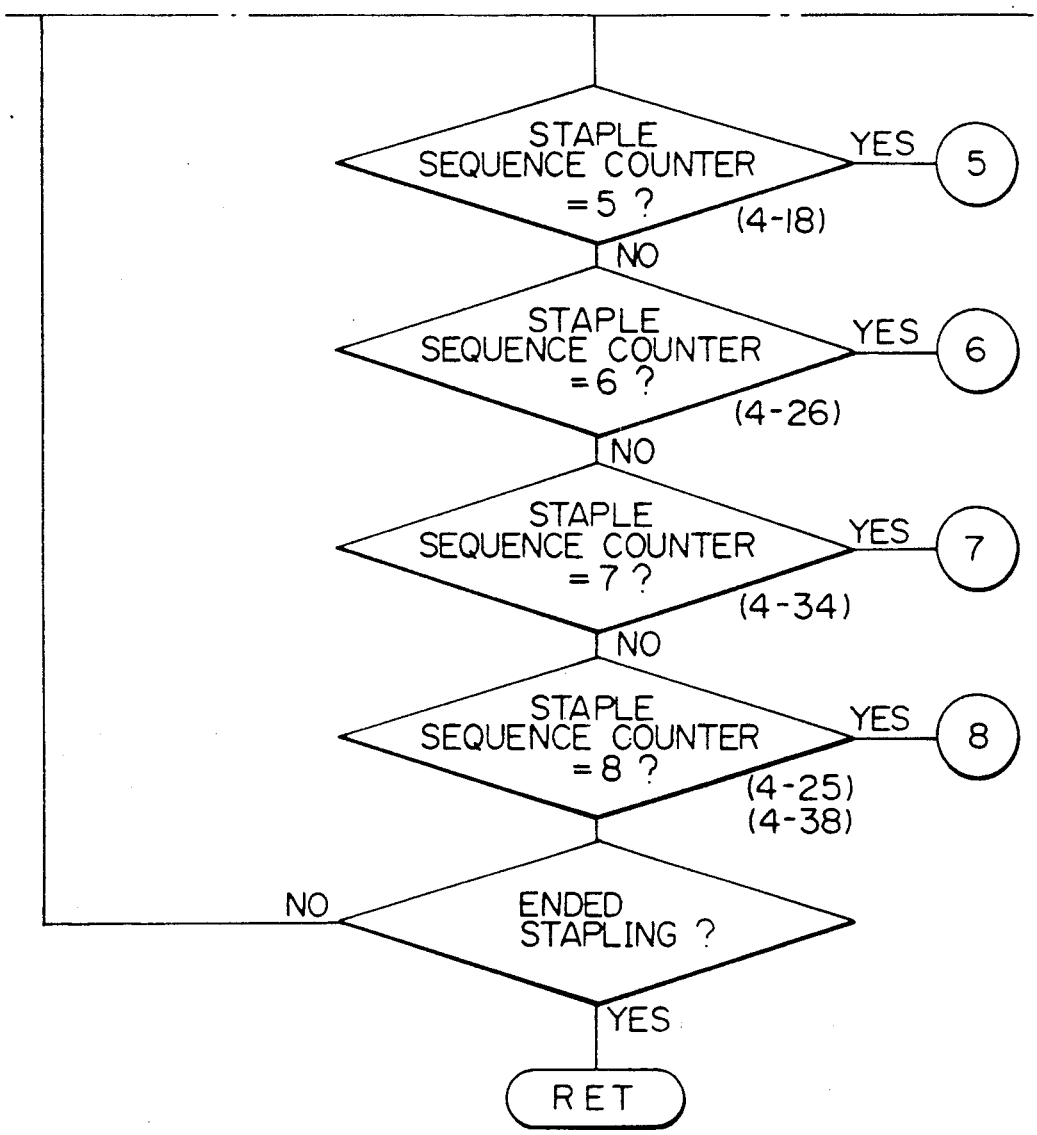
Figure 72B:
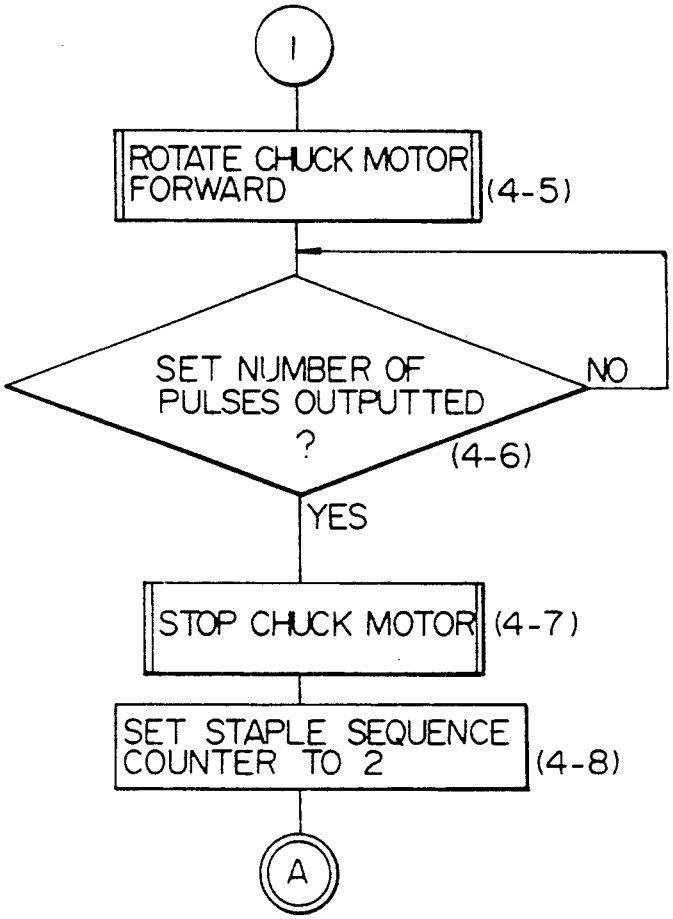
Figure 72C:
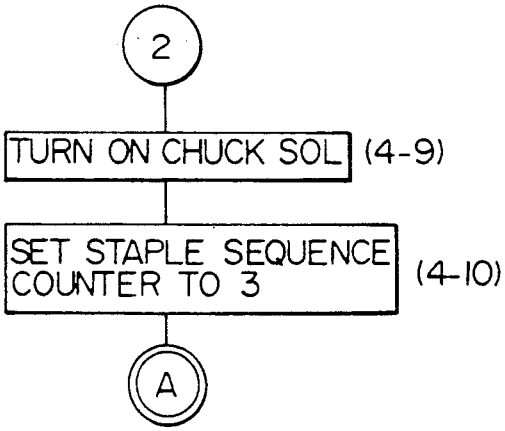
Figure 72D:
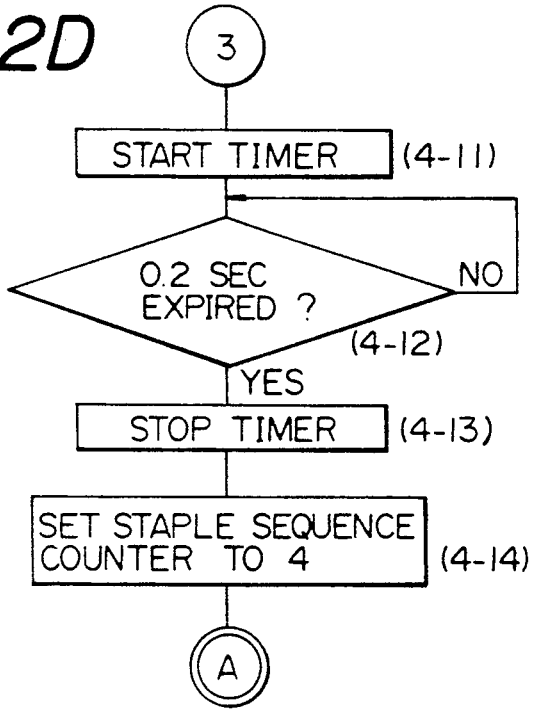
Figure 72E:
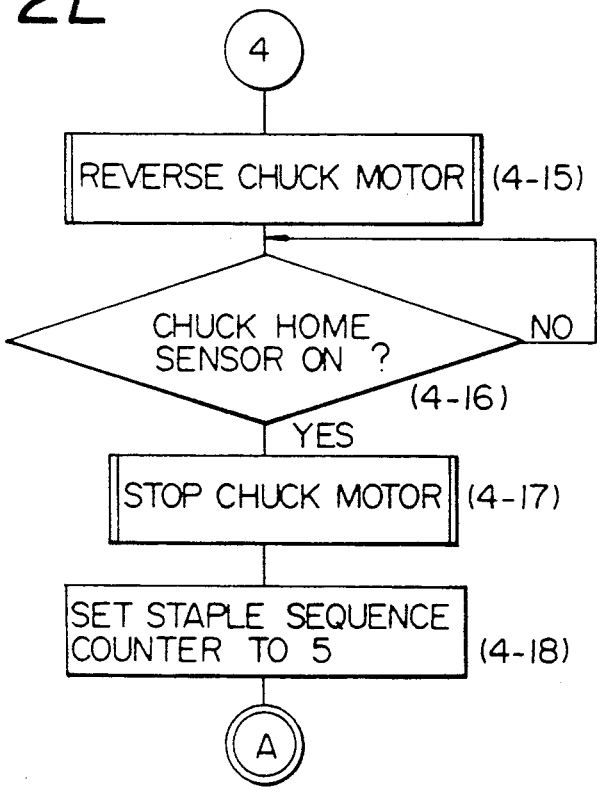
Figure 72F:
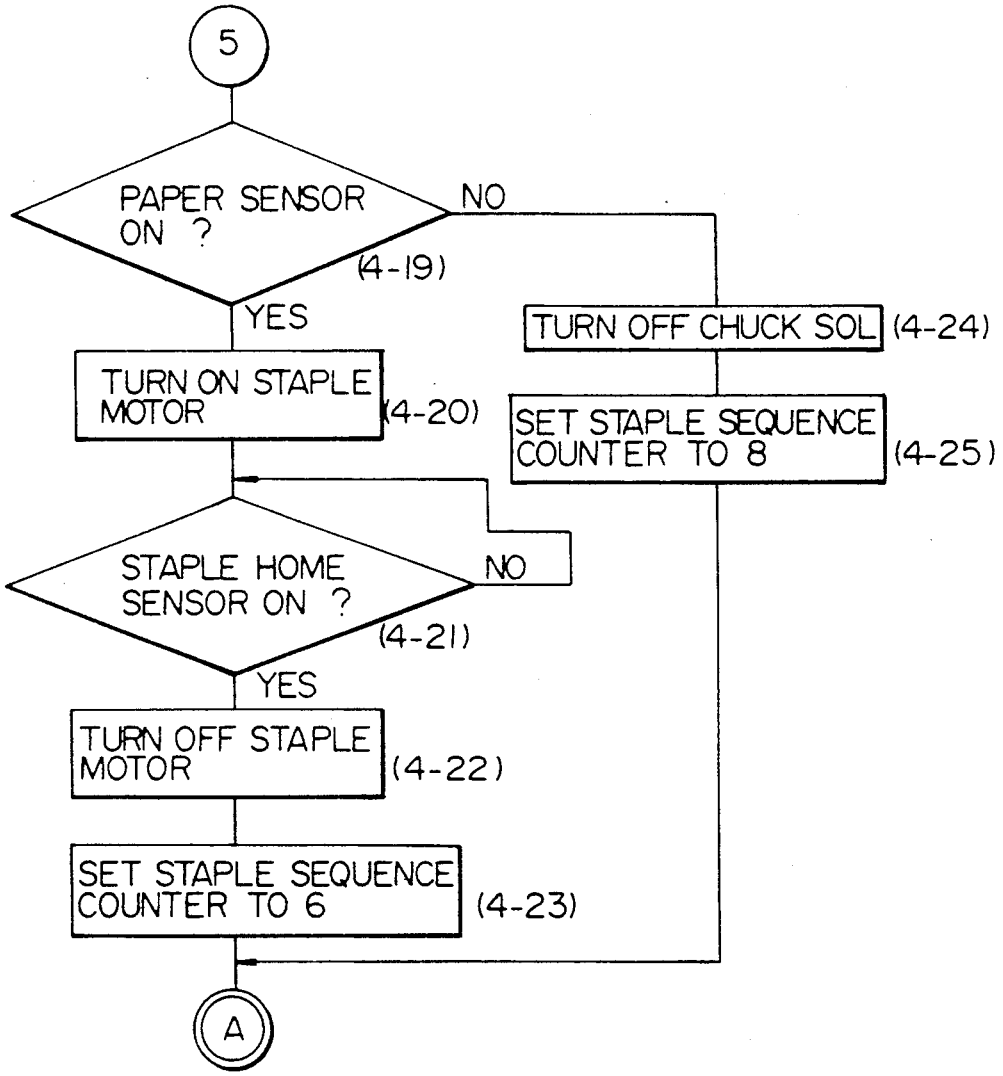
Figure 72G:
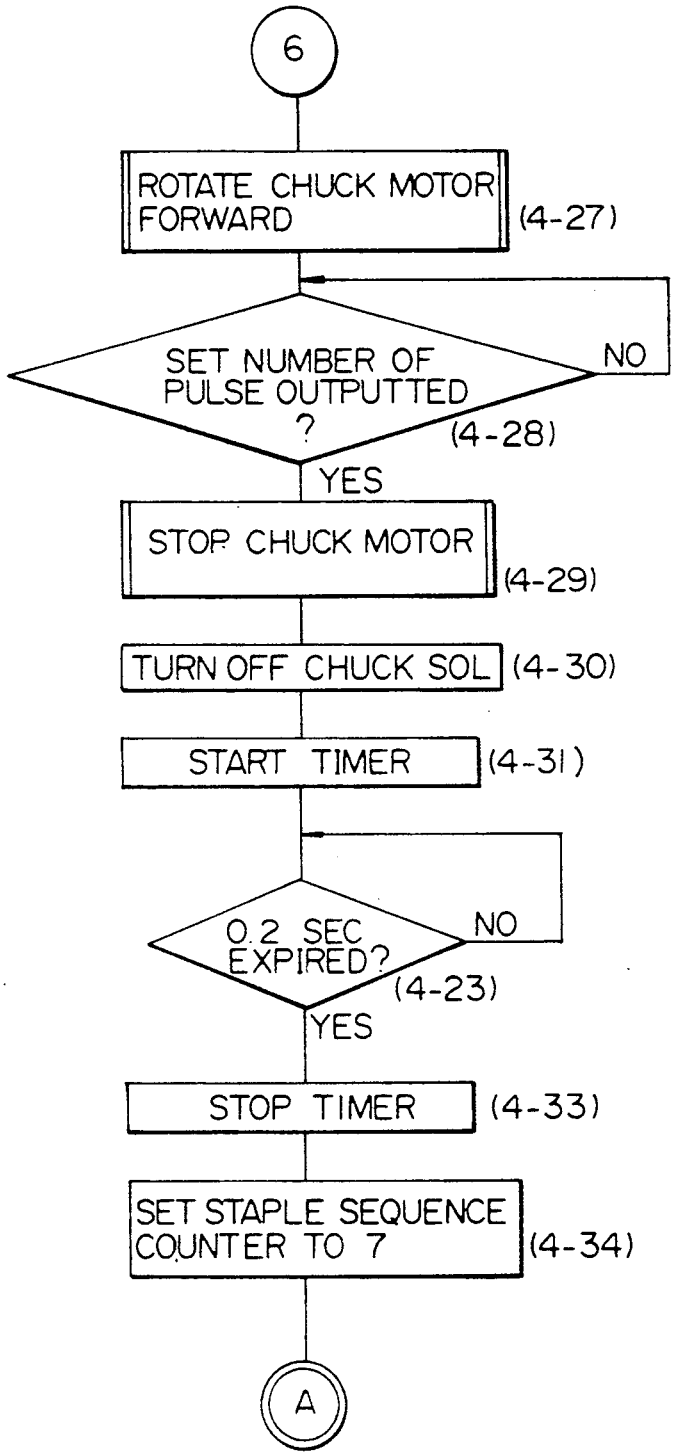
Figure 72H:
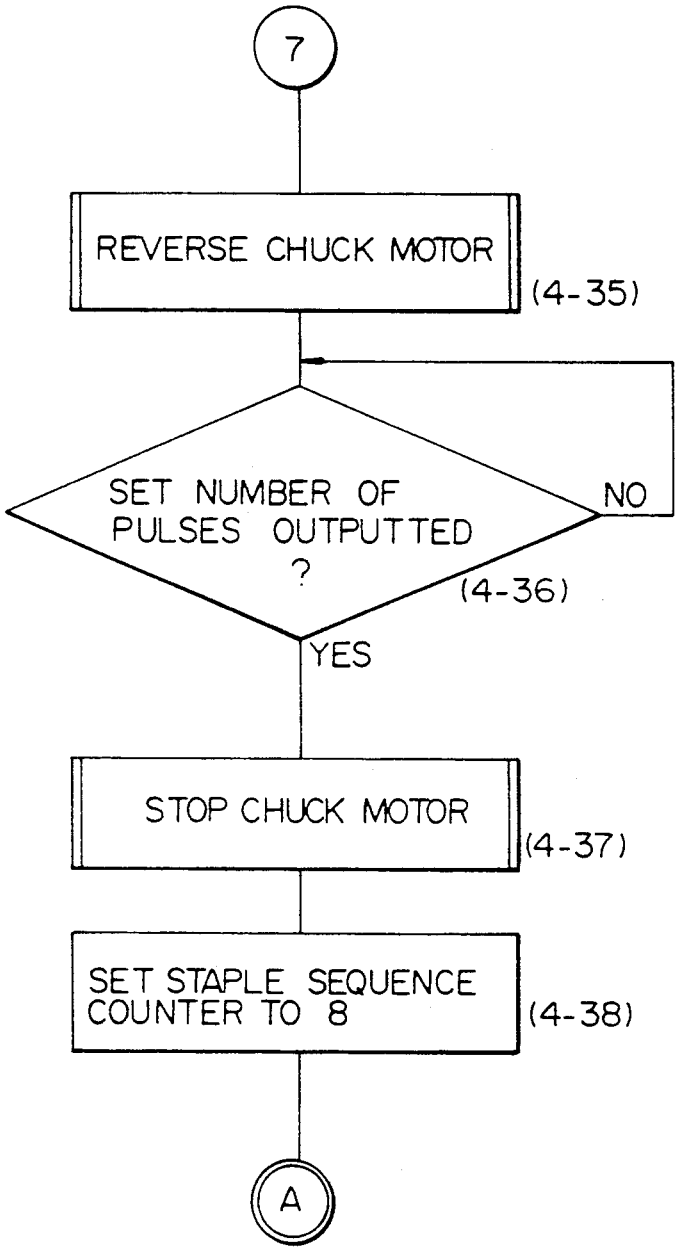
Figure 72I:
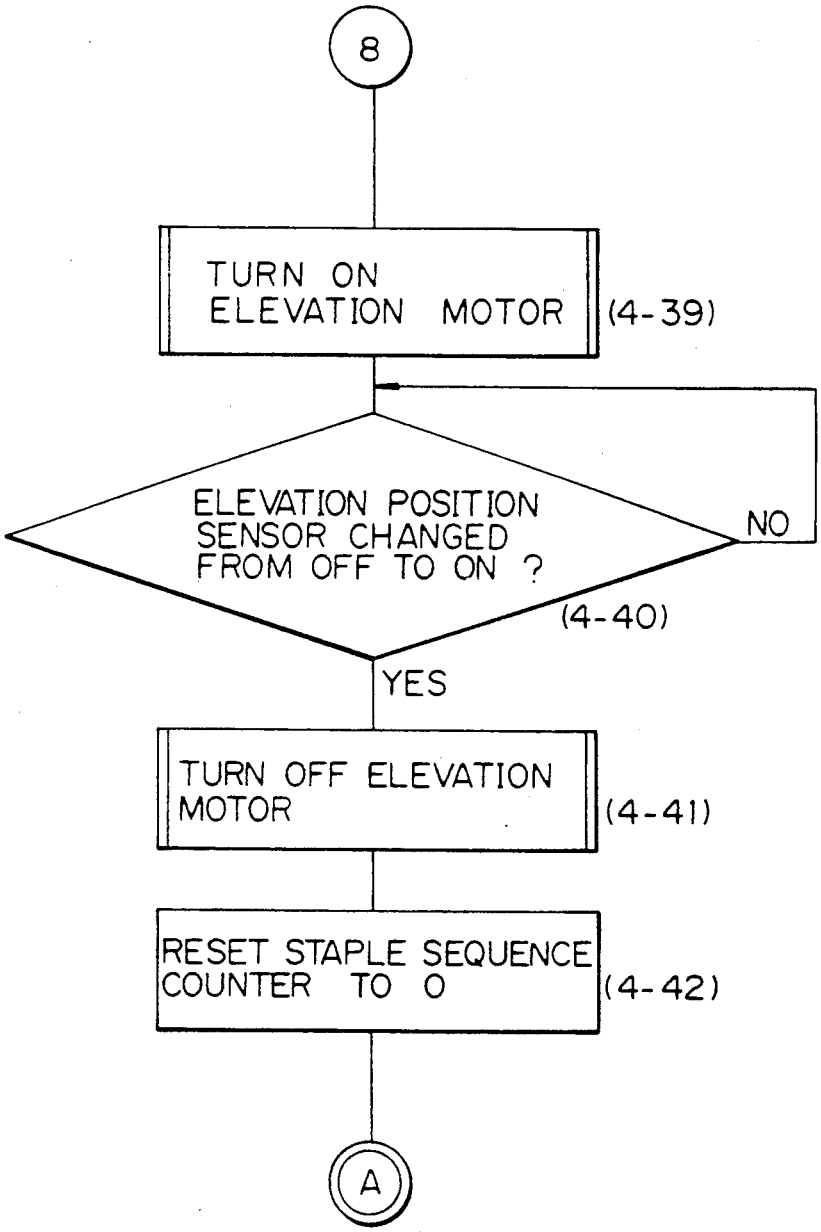

When the staple sequence counter is 5, the output of the paper sensor 675, FIG. 56, is checked (S4-19, FIG. 72F). If the answer of the step S4-19 is positive (YES), the staple motor is turned on (S4-20) to staple the paper stack. Whether or not the stapling action has completed is determined by referencing the output of the staple home sensor (S4-21). If it has completed, the stapling operation is ended (S4-22). Then, the staple sequence counter is set to 6. If the answer of the step S4-19 is negative (NO), the stapling operation is not performed and, instead, the chuck SOL 626 is turned off (S4-24). Thereafter, the sequence counter is set to 8 (S4-25).

When the staple sequence counter is 6 (S4-26), the chuck motor 646 is again moved forward (S4-27, FIG. 72G) to return the stapled paper stack to the bin 350. After the chuck motor 646 has been rotated by a predetermined number of pulses (S4-28), it is stopped (S4-29) and the chuck SOL 626 is turned off (S4-30) to open the chuck arms 622 and 624. Thereupon, the timer is started (S4-31) and, on the lapse of the response time of 0.2 second of the chuck SOL 626 (S4-32), it is stopped (S4-33). Subsequently, the staple sequence counter is set to 7 (S4-34).

When the staple sequence counter is 7, the chuck 620 is shifted to a position where it can be lowered to the next bin 350 without contacting the bin 350 with the stapled paper stack. Such a procedure reduces the interval per bin between the chucking and the end of stapling and thereby increases the system productivity. Specifically, the chuck motor 646 is started (S4-35), moved backward by the predetermined number of pulses (S4-36), and then stopped (S4-37). Subsequently, the staple sequence counter is set to 8 (S4-38).

Figure 73A:
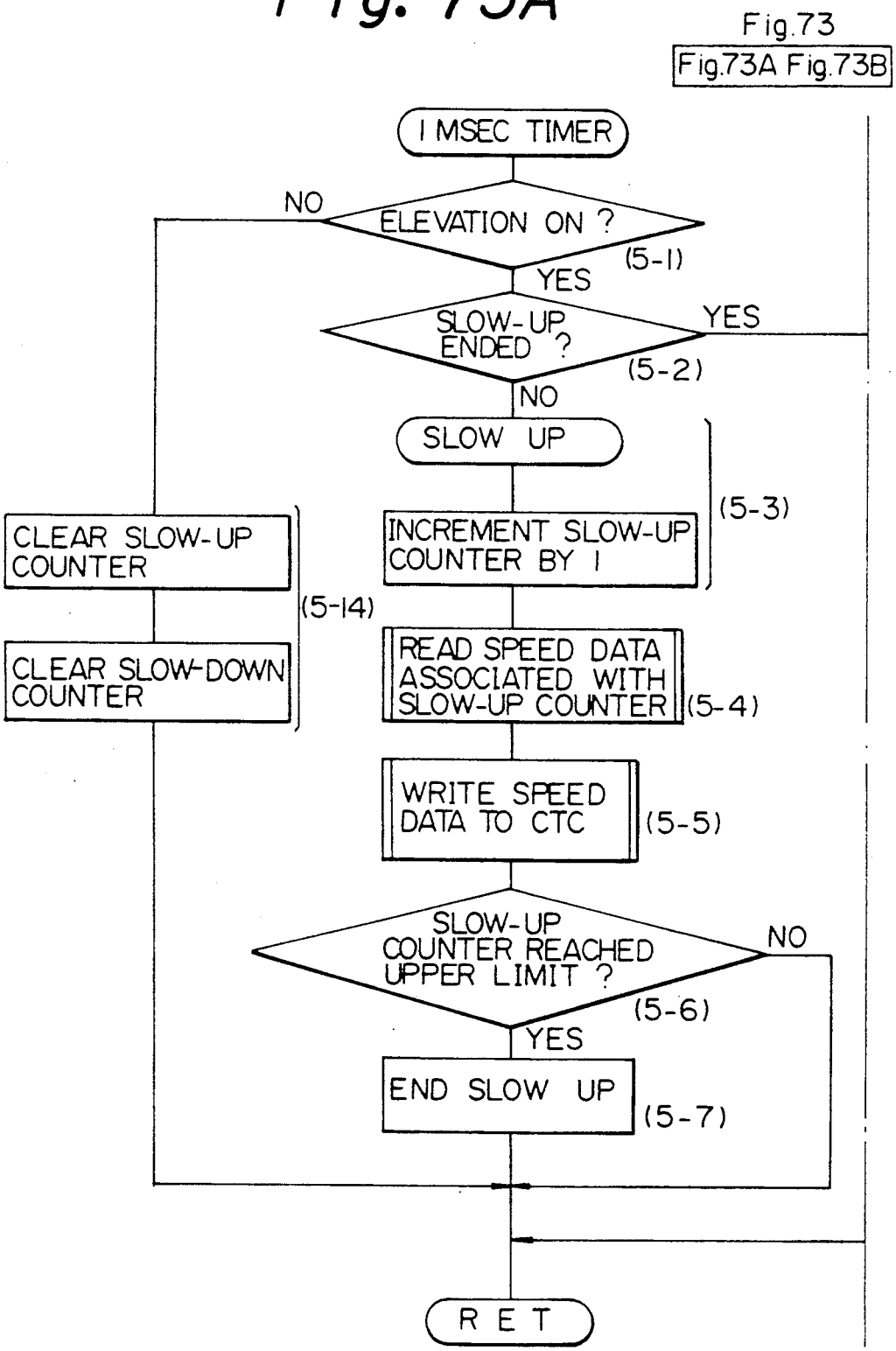

When the staple sequence counter is 8, meaning that the stapling operation has completed, the elevation motor 720 is turned on (S4-39. FIG. 73I) to elevate the stapler unit 700. As soon as the elevation home sensor 729 turns on (S4-40), the elevation motor 720 is deenergized (S4-41) and the staple sequence counter is reset to 0 (S4-42).

The sequence of steps associated with the values 0 to 8 of the staple sequence counter is executed until the stapling operation completes. Subsequently, the size shift motor 515 is turned on. When the size home sensor 501 turns on, the motor 515 is turned on. It is to be noted that the return of the stapler unit 700 to the home position and the movement of the jogger shaft 502 may be effected at the same time or in the opposite order to the illustrative embodiment. Regarding the jogger shaft 502, it may be moved after all the paper stacks on the bins 350 have been removed, i.e., when the bin sensors 321 and 323 have turned off.

The slow-up and slow-down functions associated with the up-down movement will be described. This functions are such that the moving speed is sequentially increased at the beginning of an up-down movement, and maintained constant on reaching a predetermined value, and that the moving speed is sequentially decreased at the end of an up-down movement before a bin of interest is reached, maintained constant on reaching a predetermined value, and then decreased to zero at the bin of interest. With such functions, it is possible to promote effective use of the torque of the elevation motor 720 and to insure accurate stops.

Figure 73B:
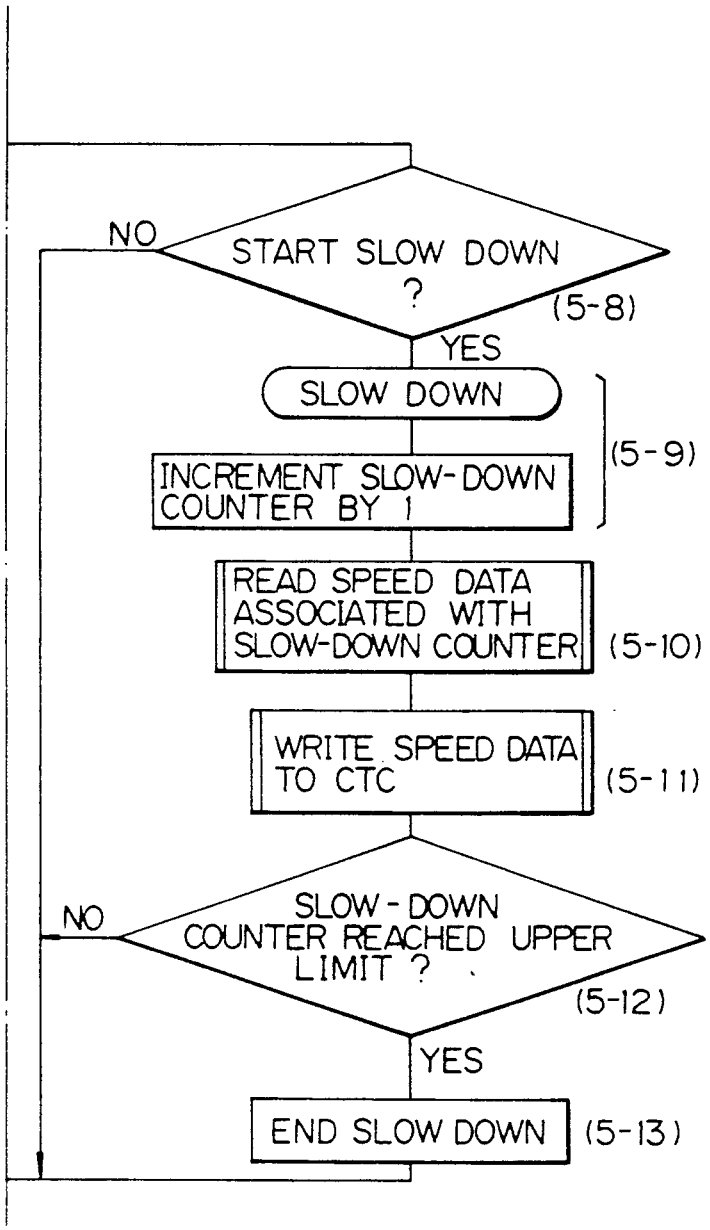

FIG. 73 is a flochart demonstrating the slow-up and slow-down procedures. As shown, in a subroutine which is called every 1 millisecond, if the slow-up operation has not been completed (S5-2) after the turn-on of the elevation motor 720 (S5-1), a slow-up counter is incremented by 1 every time the subroutine is called (S5-3). Among a group of speed data stored in the ROM 801 and set such that the speed sequentially increases, speed data is read out on the basis of the value of the slow-up counter (S5-4) and set in the CTC 804 (S5-5). In response, the CTC 804 generates frequencies based on the speed data and feeds them to the phase signal generator 813, FIG. 67. The phase signal generator 813 delivers a phase signal to the constant current driver 812 with the result that the elevation motor 720 is rotated at speeds associated with the speed data.

When the slow-up counter reaches a predetermined value (S5-6), the slow-up sequence is ended (S5-7) so that the elevation motor 720 is rotated at a constant speed.

On the lapse of a predetermined period of time, a slow-down sequence begins (S5-8). A slow-down counter is incremented every time the subroutine is called (S5-9). Among a group of speed data loaded in the ROM 801 and set such that the speed sequentially decreases, speed data associated with the value of the slow-down counter is read out (S5-10) and set in the CTC 804 (S5-11). Then, the CTC 804 generates frequencies based on the speed data and delivers them to the phase signal generator 813. In response, the phase signal generator 813 feeds a phase current to the constant current driver 812 to drive the elevation motor 720 at speeds associated with the speed data.

When the slow-down counter reaches a predetermined value (S5-12), the slow-down sequence is ended (S5-13). Thereafter, the elevation motor 720 is rotated at a constant speed. As the stapler reaches a bin of interest, the slow-up and slow-down counters are cleared (S5-14). The chuck motor 646 is also subjected to such a slow-down sequence.

Figure 74:
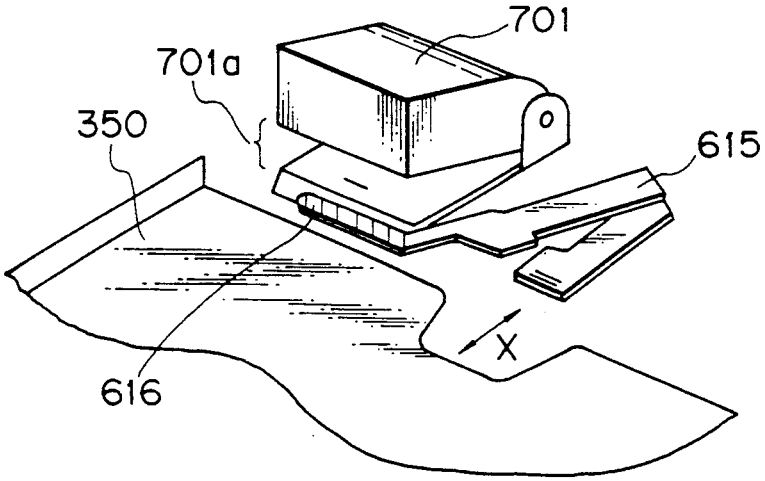
FIG. 74 is a perspective view showing another specific configuration of the paper pulling device.
Figure 75:
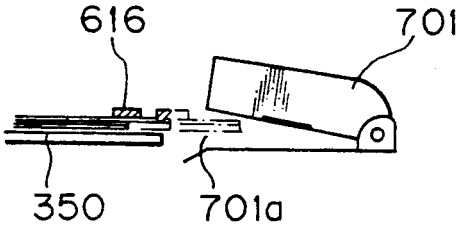
FIG. 75 is a view useful for understanding an advantage attainable with the configuration of FIG. 74.

FIGS. 74 and 75 show another specific configuration of the paper pulling device 615 which is essentially similar to the configuration described with reference to FIG. 53 and successive figures, except for an extension 616. Specifically, the extension 616 of the paper pulling device is so located as to face the opening 701 of the stapler 701 for pressing a paper sheet. As shown in FIG. 75, the extension 616 is positioned at a slightly lower level than the top of the opening 701*a* of the stapler 701. The paper pulling device 615 with the extension 616, therefore, can surely guide a paper sheet from the opening 701*a* to the stapling position even if the paper sheet is noticeably curled and tends to lift itself beyond the top of the opening 701*a*.

In summary, it will be seen that the present invention provides a finisher which positions paper sheets surely and accurately with no regard to the degree of elasticity of the paper sheets.

Various modifications will become possible for those skilled in the art after receiving the teachings of the present disclosure without departing from the scope thereof.

What is claimed is:

1. A finisher for finishing paper sheets, comprising:

a sorter comprising a plurality of bins arranged one above another for receiving paper sheets transported one after another thereto;

a stapler for stapling a stack of the paper sheets discharged onto each of said bins; and a paper positioning device for positioning the stack of paper sheets on said bin;

said paper positioning device comprising a bin fence provided on each of said bins of said sorter and extending along one side edge of said bin, and a positioning member reciprocatingly movable from a standby position toward said bin fence and to said standby position away from said bin fence and, during a reciprocating motion, stopping at least a first stop position, a second stop position and a third stop position for positioning the stack of paper sheets in contact with an edge of said stack;

wherein on said bin a distance between said first stop position and said bin fence is greater than a size of the paper sheets discharged onto said bin, a distance between said second stop position and said bin fence being smaller than the size of said paper sheets, a distance between said third stop position and said bin fence being equal to the size of said paper sheets.

2. A finisher as claimed in claim 1, further comprising drive means for driving said positioning member, and a sensor for sensing the size of the paper sheets discharged onto said bin.

3. A finisher as claimed in claim 2, further comprising control means for controlling said drive means such that said positioning member starts moving from said standby position and, after having stopped at said first to third positions, returns to said standby position at a variable speed.

4. A finisher as claimed in claim 1, wherein an elongate slot is formed through said bin adjacent to a side edge opposite to said side edge where said bin fence exists and extending toward said bin fence, said positioning member comprising a jogger shaft extending upright throughout said slots which are formed through said individual bins.

5. A finisher as claimed in claim 4, wherein a high friction member is provided on a surface of said jogger shaft.

6. A finisher for finishing paper sheets, comprising:

a tray for stacking paper sheets which are transported one after another thereto;

a fence provided on said tray and extending along one side edge of said tray; and a positioning member reciprocatingly movable from a standby position toward said fence and to said standby position away from said fence and, during a reciprocating motion, stopping at least a first stop position, a second stop position and a third stop position for positioning the stack of paper sheets in contact with an edge of said stack;

wherein on said tray a distance between said first stop position and said fence is greater than a size of the paper sheets discharged onto said tray, a distance between said second stop position and said fence being smaller than the size of said paper sheets, a distance between said third stop position and said fence being equal to the size of said paper sheets.

* * * * *